US010483643B2

(12) United States Patent
Mikami

(10) Patent No.: US 10,483,643 B2
(45) Date of Patent: Nov. 19, 2019

(54) SMALL ANTENNA AND CALCULATION APPARATUS

(71) Applicant: DENSO CORPORATION, Kariya, Aichi-pref. (JP)

(72) Inventor: Seishin Mikami, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 131 days.

(21) Appl. No.: 15/743,634

(22) PCT Filed: Jun. 16, 2016

(86) PCT No.: PCT/JP2016/002906

§ 371 (c)(1),
(2) Date: Jan. 10, 2018

(87) PCT Pub. No.: WO2017/022162

PCT Pub. Date: Feb. 9, 2017

(65) Prior Publication Data

US 2018/0198207 A1 Jul. 12, 2018

(30) Foreign Application Priority Data

Jul. 31, 2015 (JP) ..... 2015-152027
Dec. 14, 2015 (JP) ..... 2015-243143

(51) Int. Cl.
*H01Q 7/00* (2006.01)
*H01Q 5/35* (2015.01)
(Continued)

(52) U.S. Cl.
CPC ..... *H01Q 5/35* (2015.01); *H01Q 5/357* (2015.01); *H01Q 7/005* (2013.01); *H01Q 9/28* (2013.01)

(58) Field of Classification Search
CPC .....
H01Q 5/35; H01Q 5/357; H01Q 7/00; H01Q 7/005; H01Q 9/26; H01Q 9/28
See application file for complete search history.

(56) References Cited

U.S. PATENT DOCUMENTS 5,608,417 A * 3/1997 de Vall ..... G06K 7/10336 340/572.5
7,525,509 B1 * 4/2009 Robinson ..... H01Q 1/38 343/787
(Continued)

FOREIGN PATENT DOCUMENTS

JP 2005260567 A 9/2005
JP 2007020133 A 1/2007
(Continued)

*Primary Examiner* — Hoang V Nguyen
(74) *Attorney, Agent, or Firm* — Harness, Dickey & Pierce, P.L.C.

(57) ABSTRACT

A small antenna includes: a first element having a pair of conductors with a power feeding point; and a second element as a conductor arranged to sandwich a dielectric body. A part of the first and second elements has an inductance shape. A first resonance mode with a same current direction of the first element as the second element has a first resonant frequency. A second resonance mode with an opposite current direction of the first element to the second element has a second resonant frequency. A length from each power feeding point to the inductance shape is determined to hold the first resonant frequency within a range from a frequency slightly higher than the second resonant frequency to a high anti-resonant frequency of the second resonance mode, or a range from a frequency slightly lower than the second resonant frequency to a low anti-resonant frequency of the resonance mode.

33 Claims, 31 Drawing Sheets

(51) Int. Cl.
*H01Q 9/28* (2006.01)
*H01Q 5/357* (2015.01)

(56) References Cited

U.S. PATENT DOCUMENTS

| | | | |
|---|---|---|---|
| 2011/0122038 | A1 | 5/2011 | Koide et al. |
| 2016/0240926 | A1 | 8/2016 | Mikami |

FOREIGN PATENT DOCUMENTS

| | | | |
|---|---|---|---|
| JP | 2011103703 | A | 5/2011 |
| JP | 2011130411 | A | 6/2011 |
| JP | 2015076678 | A | 4/2015 |

* cited by examiner

| Fad | Fa0 | Fau | Ra | ⊿ad | ⊿au | ⊿a |
|---|---|---|---|---|---|---|
| 889 | 922 | 943 | 0.33 | 0.036 | 0.023 | 0.029 |

| Fbd | Fb0 | Fbu | Rb | ⊿bd | ⊿bu | ⊿b |
|---|---|---|---|---|---|---|
| 991 | 1028 | 1084 | 0.38 | 0.036 | 0.054 | 0.045 |

SMALL ANTENNA AND CALCULATION APPARATUS

CROSS REFERENCE TO RELATED APPLICATIONS

This application is a U.S. National Phase Application under 35 U.S.C. 371 of International Application No. PCT/JP2016/002906 filed on Jun. 16, 2016 and published in Japanese as WO 2017/022162 A1 on Feb. 9, 2017. This application is based on and claims the benefit of priority from Japanese Patent Applications No. 2015-152027 filed on Jul. 31, 2015, and No. 2015-243143 filed on Dec. 14, 2015. The entire disclosures of all of the above applications are incorporated herein by reference.

TECHNICAL FIELD

The present disclosure relates to a small antenna and a calculation apparatus which are capable of downsizing a deformed folded dipole antenna.

BACKGROUND ART

Patent Literature 1 discloses a deformed folded dipole antenna including a first element forming a dipole antenna made of a conductor formed of a line and a second element disposed opposite to the first element across an insulator, which is made of a conductor formed of a line. In the deformed folded dipole antenna, a tip of the first element and a tip of the second element are connected to each other, and the first element and the second element are further bent. As a small antenna obtained by further downsizing the deformed folded dipole antenna, a small antenna disclosed in Patent Literature 2 has been known. In the small antenna, a part of a linear portion of an element of the deformed folded dipole antenna is configured to have an inductance shape (a crank shape or a shape whose shape width decreases toward a tip of the shape, for example, a triangular shape or a semielliptical shape).

On the other hand, as an antenna improved in a return loss of the deformed folded dipole antenna, a configuration disclosed in Patent Literature 3 has been known. In this configuration, a line width of the element of the deformed folded dipole antenna is adjusted so as to adjust an impedance and improve the return loss.

A deformed folded dipole antenna with an improved return loss (refer to Patent Literature 3) suffers from a problem that downsizing is difficult. On the other hand, there is a problem that makes it difficult to improve the return loss satisfactorily even if the configuration of Patent Literature 3 is applied to the downsized dipole antenna with a part of the linear portion formed in an inductance shape (refer to Patent Literature 2).

PRIOR ART LITERATURES

Patent Literature

Patent Literature 1: JP-2005-260567-A
Patent Literature 2: JP-2015-76678-A
Patent Literature 3: JP-2011-130411-A

SUMMARY

It is an object of the present disclosure to provide a small antenna and a calculation apparatus which are capable of being reduced in size and improving a return loss.

According to a first aspect of the present disclosure, a small antenna includes: a first element that includes a pair of conductors provided by a wire, one end portion of each of the pair of conductors being a power feeding point; and a second element that is arranged to face the first element with sandwiching a dielectric body, and includes a conductor provided by a wire. A part of the wire of each of the first element and the second element has an inductance shape with three or more bending structures or an inductance shape with a spiral structure. A first resonance mode, in which a current direction of current flowing through the first element is same as a current direction of current flowing through the second element, has a first resonant frequency. A second resonance mode, in which the current direction of current flowing through the first element is opposite to the current direction of current flowing through the second element, has a second resonant frequency. A length from each power feeding point to the inductance shape is determined to hold the first resonant frequency of the first resonance mode within a range from a frequency slightly higher than the second resonant frequency of the second resonance mode to a high anti-resonant frequency of the second resonance mode, or a range from a frequency slightly lower than the second resonant frequency of the second resonance mode to a low anti-resonant frequency of the resonance mode.

According to a second aspect of the present disclosure, a small antenna includes: a first element that includes a wire and a wide conductor; and a second element that is arranged to face the wire of the first element with sandwiching a dielectric body, and includes a conductor provided by a wire. A connecting portion between the wire of the first element and the wide conductor has a power feeding point, and an end portion of the second element has a power feeding point. A part of the wire of each of the first element and the second element has an inductance shape with three or more bending structures or an inductance shape with a spiral structure. A first resonance mode, in which a current direction of current flowing through the first element is same as a current direction of current flowing through the second element, has a first resonant frequency. A second resonance mode, in which the current direction of current flowing through the first element is opposite to the current direction of current flowing through the second element, has a second resonant frequency. A length from each power feeding point to the inductance shape is determined to hold the first resonant frequency of the first resonance mode within a range from a frequency slightly higher than the second resonant frequency of the second resonance mode to a high anti-resonant frequency of the second resonance mode, or a range from a frequency slightly lower than the second resonant frequency of the second resonance mode to a low anti-resonant frequency of the second resonance mode.

According to a third aspect of the present disclosure, a calculation apparatus for designing a small antenna, which includes: a first element that has a pair of conductors provided by a wire, one end portion of each of the pair of conductors being a power feeding point; and a second element that is arranged to face the first element with sandwiching a dielectric body, and has a conductor provided by a wire, a part of the wire of each of the first element and the second element having an inductance shape with three or more bending structures or an inductance shape with a spiral structure, receives the first resonant frequency and the second resonant frequency, and calculates one of an admittance, an impedance, a reflection coefficient, and a return loss of the small antenna. A first resonance mode, in which a current direction of current flowing through the first element is same as a current direction of current flowing through the second element, has a first resonant frequency. A second resonance mode, in which the current direction of current flowing through the first element is opposite to the current direction of current flowing through the second element, has a second resonant frequency.

According to a fourth aspect of the present disclosure, a calculation apparatus for designing a small antenna, which includes: a first element that has a wire and a wide conductor; and a second element that is arranged to face the wire of the first element with sandwiching a dielectric body, and has a conductor provided by a wire, a connecting portion between the wire of the first element and the wide conductor having a power feeding point, and an end portion of the second element having a power feeding point, a part of the wire of each of the first element and the second element having an inductance shape with three or more bending structures or an inductance shape with a spiral structure, receives the first resonant frequency and the second resonant frequency, and calculates one of an admittance, an impedance, a reflection coefficient, and a return loss of the small antenna. A first resonance mode, in which a current direction of current flowing through the first element is same as a current direction of current flowing through the second element, has a first resonant frequency. A second resonance mode, in which the current direction of current flowing through the first element is opposite to the current direction of current flowing through the second element, has a second resonant frequency.

According to a fifth aspect of the present disclosure, a calculation apparatus for designing a small antenna, which includes: a first element that has a pair of conductors provided by a wire, one end portion of each of the pair of conductors being a power feeding point; and a second element that is arranged to face the first element with sandwiching a dielectric body, and has a conductor provided by a wire, a part of the wire of each of the first element and the second element having an inductance shape with three or more bending structures or an inductance shape with a spiral structure, receives one resonant frequency of the first element and the second element, and calculates one of an other resonant frequency of the first element and the second element and an antenna shape.

According to a sixth aspect of the present disclosure, a calculation apparatus for designing a small antenna, which includes: a first element that has a wire and a wide conductor; and a second element that is arranged to face the wire of the first element with sandwiching a dielectric body, and includes a conductor provided by a wire, a connecting portion between the wire of the first element and the wide conductor having a power feeding point, and an end portion of the second element having a power feeding point, a part of the wire of each of the first element and the second element having an inductance shape with three or more bending structures or an inductance shape with a spiral structure, receives one resonant frequency of the first element and the second element, and calculates one of an other resonant frequency of the first element and the second element and an antenna shape.

According to a seventh aspect of the present disclosure, a small antenna includes: a first element that includes a pair of conductors provided by a wire, one end portion of each of the pair of conductors being a power feeding point; and a second element that is arranged to face the first element with sandwiching a dielectric body, and includes a conductor provided by a wire. A part of the wire of each of the first element and the second element has an inductance shape with three or more bending structures or an inductance shape with a spiral structure. A length from a center of each of the first element and the second element to the inductance shape is determined to separate a first resonant frequency of a first resonance mode, in which a current direction of current flowing through the first element is same as a current direction of current flowing through the second element, from a second resonant frequency of a second resonance mode, in which the current direction of current flowing through the first element is opposite to the current direction of current flowing through the second element. A width of at least a part of each wire other than the inductance shape of the first element or the second element is configured to be wider than a width of the inductance shape.

In each of the embodiments described above, downsizing can be achieved and the return loss can be improved.

BRIEF DESCRIPTION OF DRAWINGS

The above and other objects, features and advantages of the present disclosure will become more apparent from the following detailed description made with reference to the accompanying drawings. In the drawings:

FIGS. 1A to 1D illustrate a first embodiment of the present disclosure, in which FIG. 1A is a diagram illustrating a configuration of a first element side of a deformed folded dipole antenna, FIG. 1B is a longitudinal sectional side view illustrating the deformed folded dipole antenna, FIG. 1C is a diagram illustrating a configuration of a second element side of the deformed folded dipole antenna, and FIG. 1D is an enlarged view of an inductance shape;

FIGS. 3A to 3C illustrate a conventional configuration (No. 1) in which FIG. 3A is a diagram illustrating a configuration of a first element side of a deformed folded dipole antenna, FIG. 3B is a longitudinal sectional side view illustrating the deformed folded dipole antenna, and FIG. 3C is a diagram illustrating a configuration of a second element side of the deformed folded dipole antenna;

FIGS. 4A to 4C illustrate a conventional configuration (No. 2) in which FIG. 4A is a diagram illustrating a configuration of a first element side of a deformed folded dipole antenna, FIG. 4B is a longitudinal sectional side view illustrating the deformed folded dipole antenna, and FIG. 4C is a diagram illustrating a configuration of a second element side of the deformed folded dipole antenna;

FIGS. 10A to 10C illustrate a configuration (No. 1) of the present disclosure in which FIG. 10A is a diagram illustrating a configuration of a first element side of a deformed folded dipole antenna, FIG. 10B is a longitudinal sectional side view illustrating the deformed folded dipole antenna, and FIG. 10C is a diagram illustrating a configuration of a second element side of the deformed folded dipole antenna;

FIGS. 22A to 22C illustrate a third embodiment of the present disclosure in which FIG. 22A is a diagram illustrating a configuration of a first element side of a deformed folded monopole antenna, FIG. 22B is a longitudinal sectional side view illustrating the deformed folded monopole antenna, and FIG. 22C is a diagram illustrating a configuration of a second element side of the deformed folded monopole antenna;

FIGS. 27A to 27D illustrate a fifth embodiment of the present disclosure, in which FIG. 27A is a diagram illustrating a configuration of a first element side of a deformed folded dipole antenna, FIG. 27B is a longitudinal sectional side view illustrating the deformed folded dipole antenna, FIG. 27C is a diagram illustrating a configuration of a second element side of the deformed folded dipole antenna, and FIG. 27D is an enlarged view of an inductance shape;

FIGS. 31A to 31D illustrate a sixth embodiment of the present disclosure, in which FIG. 31A is a diagram illustrating a configuration of a first element side of a deformed folded dipole antenna, FIG. 31B is a longitudinal sectional side view illustrating the deformed folded dipole antenna, FIG. 31C is a diagram illustrating a configuration of a second element side of the deformed folded dipole antenna, and FIG. 31D is an enlarged view of an inductance shape;

FIGS. 33A to 33D illustrate a seventh embodiment of the present disclosure, in which FIG. 33A is a diagram illustrating a configuration of a first element side of a deformed folded dipole antenna, FIG. 33B is a longitudinal sectional side view illustrating the deformed folded dipole antenna, FIG. 33C is a diagram illustrating a configuration of a second element side of the deformed folded dipole antenna, and FIG. 33D is an enlarged view of an inductance shape;

FIGS. 35A and 35B illustrate an eighth embodiment of the present disclosure in which FIG. 35A is a diagram illustrating a configuration of a first element side of a deformed folded dipole antenna, and FIG. 35B is a diagram illustrating a configuration of a second element side of the deformed folded dipole antenna;

EMBODIMENTS

Hereinafter, a first embodiment of the present disclosure will be described with reference to FIGS. 1A to 20. The present disclosure improves a return loss by improving a deformed folded dipole antenna disclosed in Patent Literature 2. First, a process of disclosure by the present inventors will be described.

Figure 4A:
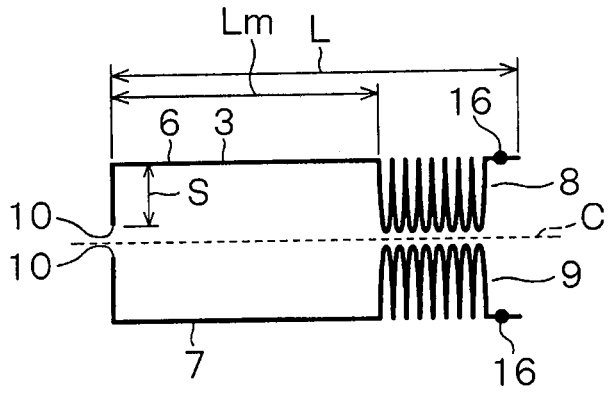
Figure 4B:
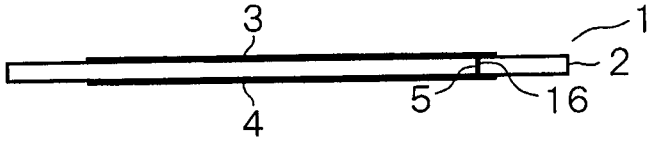
Figure 4C:
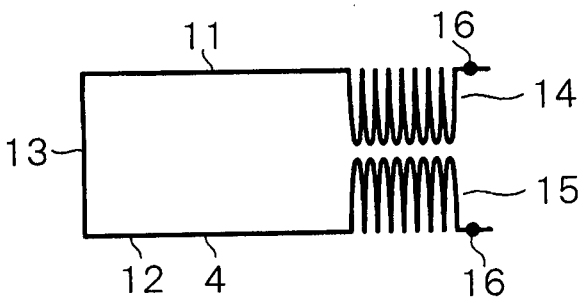

FIGS. 4A to 4C illustrate a deformed folded dipole antenna 1 of Patent Literature 2. The deformed folded dipole antenna 1 includes a first element 3 formed of a conductor pattern (a conductor formed of a line) on one surface of a dielectric substrate 2 (refer to FIG. 4B), a second element 4 that is formed of a conductor pattern on the other side of the dielectric substrate 2, and a short-circuit element 5 for short-circuiting the first element 3 and the second element 4.

As illustrated in FIG. 4A, the first element 3 has a first L-shaped portion 6 and a second L-shaped portion 7 symmetrical with respect to a center plane C in an antenna width direction. Tip portions of the respective long side portions of those L-shaped portions 6 and 7 are provided with inductance shapes 8 and 9. Feeding points 10 are provided at facing portions of tip portions of the respective short side portions of the L-shaped portions 6 and 7. As illustrated in FIG. 4C, the second element 4 is formed in substantially the same shape as that of the first element 3. The second element 4 includes a pair of opposite side portions 11 and 12, and a coupling side portion 13 that couples one ends of those opposite side portions 11 and 12 with each other. Inductance shapes 14 and 15 are provided at the other end portions of the opposite side portions 11 and 12, respectively. The short-circuit element 5 includes through holes 16 (refer to FIG. 4B) which connect the respective tip portions of the L-shaped portions 6 and 7 of the first element 3 to the tip of the respective other end portions of the opposite side portions 11 and 12 of the second element 4.

Figure 3A:
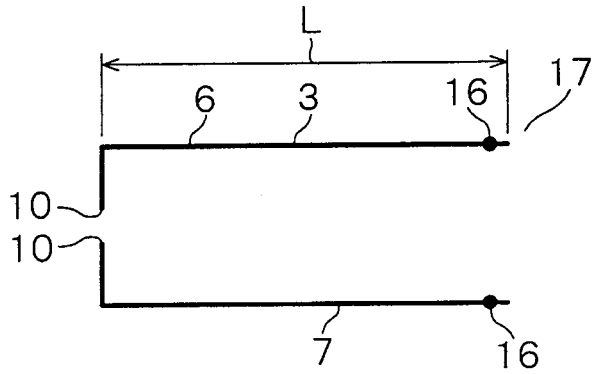
Figure 3B:
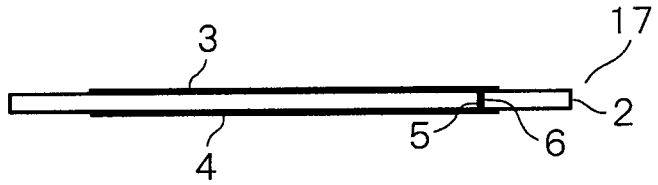
Figure 3C:
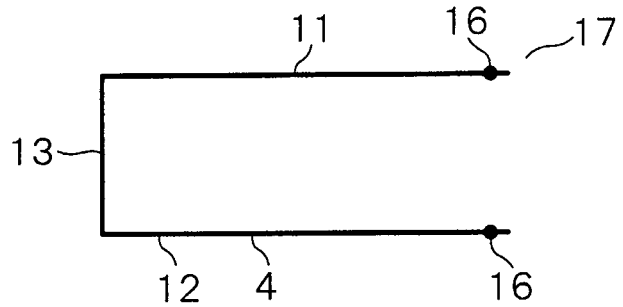

FIGS. 3A to 3C illustrate a deformed folded dipole antenna 17 that is configured such that the inductance shapes 8, 9, 14, and 15 are not provided in the L-shaped portions 6 and 7 of the first element 3 and the opposite side portions 11 and 12 of the second element 4.

Figure 5:
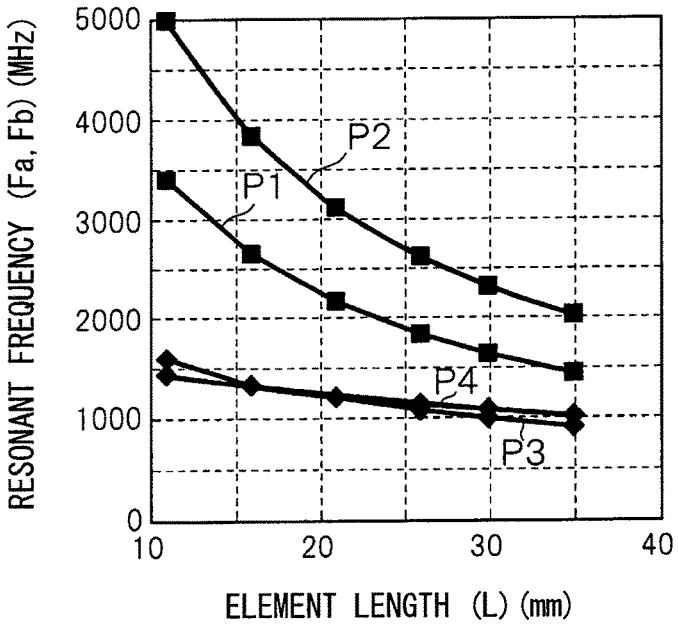
FIG. 5 is a characteristic diagram illustrating a relationship between a resonant frequency and an element length.

In the deformed folded dipole antennas 1 and 17 configured as described above, there are a resonance mode (referred to as resonance mode A) in which directions of respective currents flowing through the first element 3 and the second element 4 are the same direction, and a resonance mode (referred to as resonance mode B) in which the directions of the respective currents flowing through the first element 3 and the second element 4 are opposite to each other. In this example, it is assumed that a length of the long side portions (that is, the long side portions of the L-shaped portions 6 and 7, and the long side portions of the opposite side portions 11 and 12) of the first element 3 and the second element 4 is L. FIG. 5 illustrates the results of simulation of changes in resonant frequencies Fa0 and Fb0 in the resonance modes A and B when L is changed. In FIG. 5, the horizontal axis represents L (element length) and the vertical axis represents a resonant frequency.

In FIG. 5, a curve P1 shows a change in the resonant frequency Fa0 in the resonance mode A of the deformed folded dipole antenna 17 (refer to FIGS. 3A to 3C), and a curve P2 shows a change in the resonant frequency Fb0 in the resonance mode B of the deformed folded dipole antenna 12. A curve P3 shows a change in the resonant frequency Fa0 in the resonance mode A of the deformed folded dipole antenna 1 (refer to FIGS. 4A to 4C), and a curve P4 shows a change in the resonant frequency Fb0 in the resonance mode B of the deformed folded dipole antenna 1.

It can be seen from the graph of FIG. 5 that parts of the lines of the first element 3 and the second element 4 are changed to the inductance shapes 8, 9, 14, and 15, as a result of which the following two changes occur. A first change resides in that the resonant frequencies Fa0 and Fb0 of the two resonance modes A and B are low. A second change resides in that the resonant frequencies Fa0 and Fb0 of the two resonance modes A and B come closer to each other, and may coincide with each other.

The deformed folded dipole antenna 1 disclosed in Patent Literature 2 has been made focusing on the effects of the first change. On the other hand, when the second change occurs, it has been found that the two resonant frequencies Fa0 and Fb0 almost coincide with each other, as a result of which the two resonance modes interact with each other, and the return loss is increased. In view of the above circumstance, the present inventors have tried to improve the return loss by disclosing the configuration in which the two resonant frequencies Fa0 and Fb0 are separated from each other with a configuration in which parts of the lines of the first element 3 and the second element 4 are changed to the inductance shapes 8, 9, 14, and 15.

Specifically, first, as illustrated in FIG. 4A, according to the disclosure by the present inventors, it is assumed that a length of a short side portion of the L-shaped portion 6 of the first element 3 (and the second element 4) is S, and a length of a portion of the long side portion of the L-shaped portion 6 other than the inductance 8 is Lm. With a change in a length (Lm+S), two wavelengths λa and λb of the two resonance modes A and B are separated from each other, as a result of which the two resonant frequencies Fa0 and Fb0 in the resonance modes A and B are separated from each other. Hereinafter, this disclosure will be described in detail.

Figure 6:
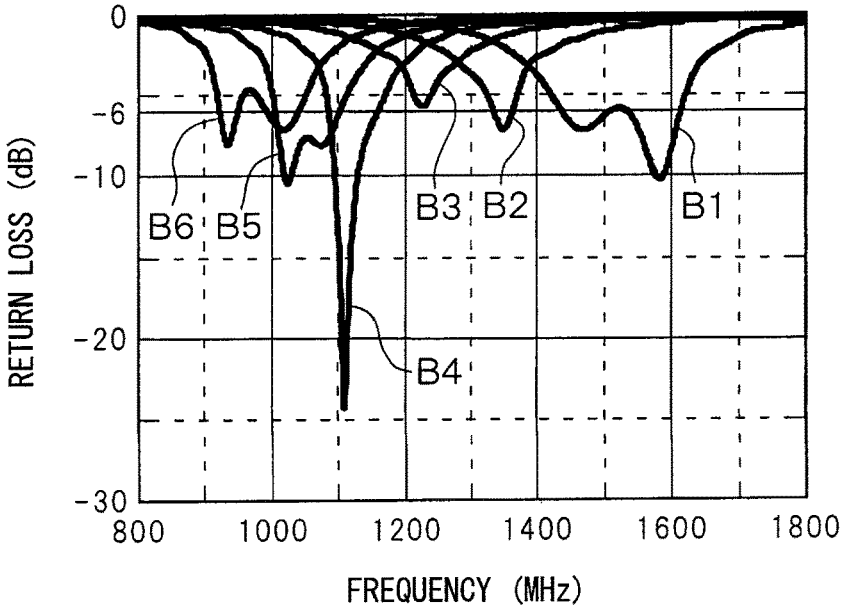
FIG. 6 is a characteristic diagram illustrating a relationship between a return loss and a frequency.

FIG. 6 illustrates the results obtained by simulating a change in the return loss when the length Lm of the long side portions of the L-shaped portions 6, 7, 11, and 12 is varied to, for example, 5 mm, 10 mm, 15 mm, 20 mm, 24 mm, and 29 mm. In FIG. 6, the horizontal axis represents the frequency and the vertical axis represents the return loss. In FIG. 6, a curve B1 shows a change in return loss when the length Lm is 5 mm. A curve B2 shows a change in return loss when the length Lm is 10 mm. A curve B3 shows a change in return loss when the length Lm is 15 mm. A curve B4 shows a change in return loss when the length Lm is 20 mm. A curve B5 shows a change in return loss when the length Lm is 24 mm. A curve B6 shows a change in return loss when the length Lm is 29 mm.

It can be found from FIG. 6 that as a first phenomenon, as the length Lm is more increased, the resonant frequency (that is, the frequency at which the return loss falls) becomes lower. In addition, as a second phenomenon, it is understood that when the length Lm is increased, there are cases where the return loss is improved and the return loss is lowered.

Firstly, as a result of exploring the first phenomenon, it has been found that the resonant frequencies Fa0 and Fb0 of the two resonance modes A and B can be obtained from the length Lm of the long side portions of the L-shaped portions 6, 7, 11, and 12 through calculation formulas, and the resonant frequency Fb0 in the resonance mode B changes with the presence or absence of the short-circuit element 5 that connects the first element 3 and the second element 4. Hereinafter, this fact will be described in detail.

Figure 7:
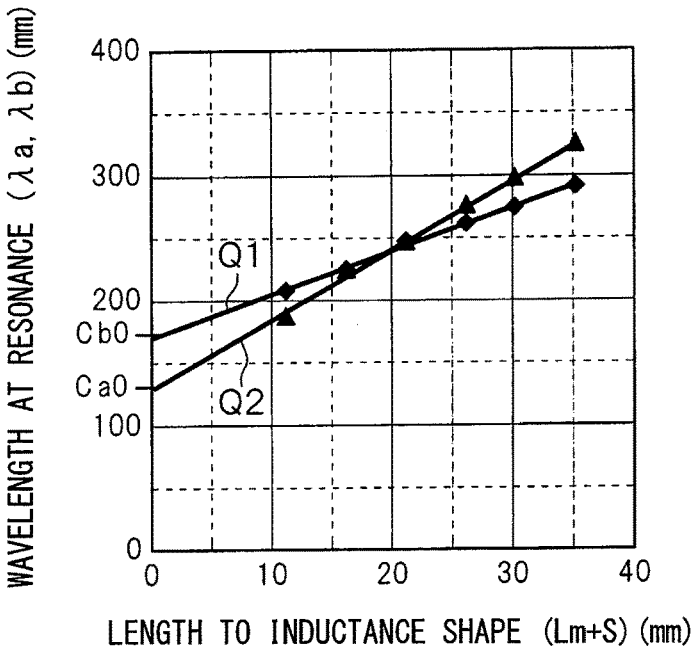
FIG. 7 is a characteristic diagram illustrating a relationship between a resonant wavelength and a length (Lm+S)

FIG. 7 is a diagram illustrating the results obtained by simulating changes in the wavelengths λa and λb in the resonance modes A and B when the length (Lm+S) of the first element 3 and the second element 4 is changed. In FIG. 7, the horizontal axis represents the length (Lm+S), and the vertical axis represents the wavelength at the resonance. In FIG. 7, a straight line Q1 indicates a change in the wavelength λa in the resonance mode A, and a straight line Q2 indicates a change in the wavelength λb in the resonance mode B. In addition, the following relational expression is established between the two resonant frequencies Fa0, Fb0 and the two wavelengths λa, λb at the resonance.

$$\lambda a = C/Fa0 \quad (1)$$

$$\lambda b = C/Fb0 \quad (2)$$

where C is the speed of light.

Further, when expressing the two straight lines Q1 and Q2 illustrated in FIG. 7 by the equation, the following two expressions are obtained.

$$\lambda a = Ca1*(Lm+S)+Ca0 \quad (3)$$

$$\lambda b = Cb1*(Lm+S)+Cb0 \quad (4)$$

$$Fa0 = C/\lambda a \quad (5)$$

$$Fb0 = C/\lambda b \quad (6)$$

where Ca1 is a slope (proportionality constant of λa) of the straight line Q1, Ca0 is an intercept (constant of λa) of the straight line Q1, Cb1 is a slope (proportionality constant of λb) of the straight line Q2, and Cb0 is an intercept (constant of λb) of the straight line Q2.

It is found that the resonant frequencies Fa0 and Fb0 of the two resonance modes A and B can be obtained based on the length (Lm+S) of the first element 3 and the second element 4 through Expressions (1), (2), (3) and (4) by calculation formulas.

In addition, the present inventors have disclosed a configuration (configuration without short-circuit elements) so as to provide no short-circuit elements 5 that connect the first element 3 and the second element 4, or to adjust positions of the short-circuit elements 5 although the short-circuit elements 5 are provided, to thereby change the resonant frequency Fb0, as a result of which the resonant frequency Fa0 is separated from the resonant frequency Fb0 (Fa0≠Fb0).

First, a change in the resonant frequency Fb0 in the resonance mode B depending on the presence or absence of the short-circuit elements 5 will be described with reference to FIGS. 8 and 9. In the configuration in which the length Lm of the long side portions of the L-shaped portions 6, 7, 11, and 12 is, for example, 15 mm, the fact that the resonant frequency Fb0 in the resonance mode B changes depending on the presence or absence of the short-circuit elements 5 is shown in a graph of the return loss of FIG. 8 and an impedance chart of FIG. 9.

Figure 8:
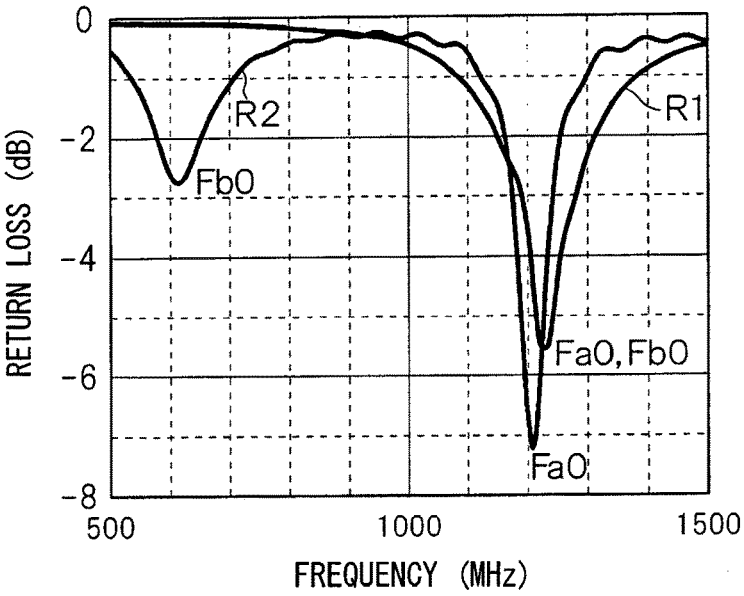
FIG. 8 is a characteristic diagram illustrating a relationship between the return loss and the frequency.

FIG. 8 is a graph illustrating a relationship between frequency and the return loss, in which the horizontal axis indicates the frequency and the vertical axis indicates the return loss. In FIG. 8, a curve R1 shows a change in the return loss of the configuration with the short-circuit elements 5, that is, the deformed folded dipole antenna 1 illustrated in FIGS. 4A to 4C. In FIG. 8, a curve R2 shows a change in the return loss in the configuration without the short-circuit elements 5, that is, the configuration in which the short-circuit elements 5 are eliminated from the deformed folded dipole antenna 1 illustrated in FIGS. 4A to 4C. It is understood from FIG. 8 that the resonant frequency Fa0 substantially coincides with the resonant frequency Fb0 in the case of the configuration having the short-circuit elements 5, and further the return loss is large. On the other hand, in the case of the configuration without the short-circuit elements 5, it is understood that the resonant frequency Fb0 changes, the resonant frequency Fa0 and the resonant frequency Fb0 are separated from each other (that is, Fa0≠Fb0), and the return loss of the resonant frequency Fa0 is small.

Figure 9:
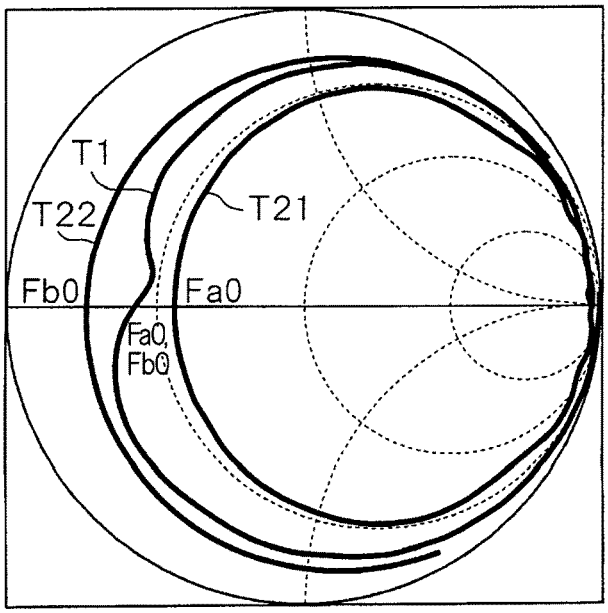
FIG. 9 is a diagram illustrating an impedance chart.
Figure 10A:
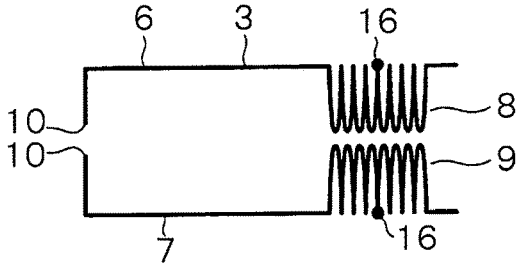
Figure 10B:
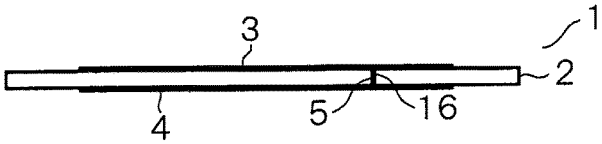
Figure 10C:
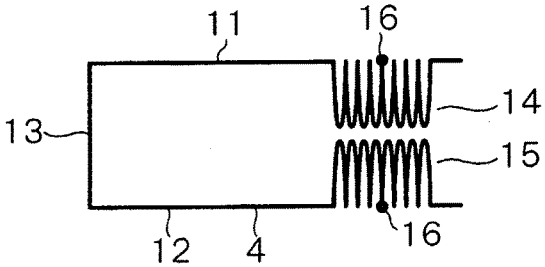

FIG. 9 is an impedance chart. In FIG. 9, a curve T1 shows an impedance chart of the configuration with the short-circuit elements 5, that is, the deformed folded dipole antenna 1 illustrated in FIGS. 4A to 4C. In FIG. 9, two curves T21 and T22 show impedance charts in the configuration without the short-circuit elements 5, that is, the configuration in which the short-circuit elements 5 are eliminated from the deformed folded dipole antenna 1 illustrated in FIGS. 4A to 4C. It is understood from FIG. 9 that the resonant frequency Fa0 substantially coincides with the resonant frequency Fb0 in the case of the configuration having the short-circuit elements 5. On the other hand, in the case of the configuration without the short-circuit elements 5, it is found that the resonant frequency Fa0 and the resonant frequency Fb0 are separated from each other (that is, Fa0≠Fb0).

The reason why the resonant frequency Fb0 changes as described above depending on the presence or absence of the short-circuit elements 5 is that Cb1 (proportionality constant of λb) and Cb0 (constant of λb) in Expression (4) change depending on the presence or absence of the short-circuit elements.

First, a change in the resonant frequency Fb0 in the resonance mode B by changing a position of each short-circuit element 5 will be described with reference to FIGS. 4A to 4C, 10A to 10C, and 11. In the deformed folded dipole antenna 1 illustrated in FIGS. 4A to 4C, the position of the short-circuit element 5 is located in the vicinity of an end of the inductance portion 8, in other words, a tip portion of the long side portion of the L-shaped portion 6. On the other hand, in the deformed folded dipole antenna 1 illustrated in FIGS. 10A to 10C, a position P2 of the short-circuit element 5 is located in the center (for example, fourth) of, for example, eight semielliptical portions 16 of the inductance portion 8. A graph of FIG. 11 is obtained from the simulation results for a configuration in which the length Lm of the long side portions of the L-shaped portions 6, 7, 11, and 12 is, for example, 15 mm.

Figure 11:
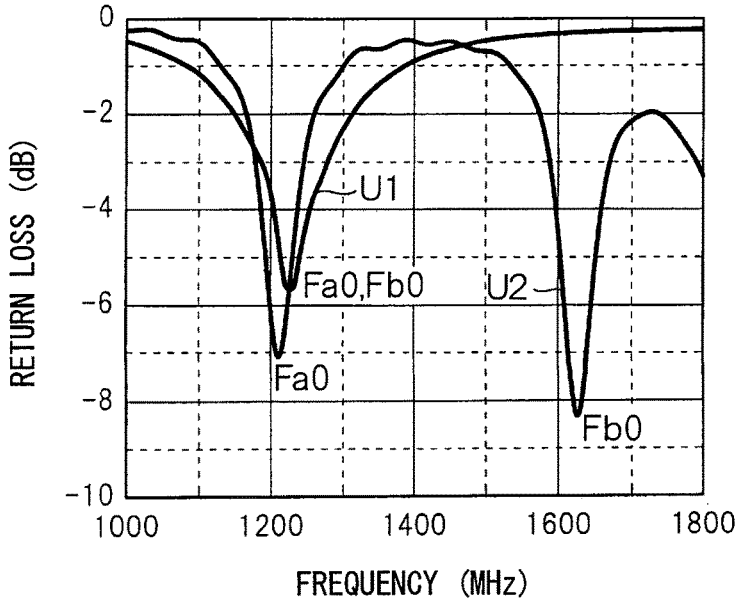
FIG. 11 is a characteristic diagram illustrating a relationship between the return loss and the frequency.

FIG. 11 is a graph illustrating a relationship between frequency and the return loss, in which the horizontal axis indicates the frequency and the vertical axis indicates the return loss. In FIG. 11, a curve U1 shows a change in the return loss of the configuration in which the position of the short-circuit element 5 is at an end, that is, the deformed folded dipole antenna 1 illustrated in FIGS. 4A to 4C. In addition, in FIG. 11, a curve U2 shows a change in the return loss of the configuration in which the position of the short-circuit element 5 is in the center, that is, the deformed folded dipole antenna 1 illustrated in FIGS. 10A to 10C. It is understood from FIG. 11 that the resonant frequency Fb0 changes with a change in the position of the short-circuit element 5 from the end to the center, the resonant frequencies Fa0 and Fb0 are separated from each other (that is, Fa0≠Fb0), and the return losses of the resonant frequencies Fa0 and Fb0 are sufficiently small. The reason why the resonant frequency Fb0 in the resonance mode B changes as described above with a change in the position of each short-circuit element 5 is that Cb1 (proportionality constant of λb) and Cb0 (constant of λb) in Expression (4) change depending on the position of the short-circuit element.

Next, the second phenomenon, that is, a phenomenon that when the length Lm is increased, the return loss may be improved and the return loss may be lowered has been confirmed focusing on a ratio (Fa0/Fb0) of the two resonant frequencies Fa0 and Fb0 and a normalized frequency at which the return loss is equal to or less than −6 dB.

Figure 12:
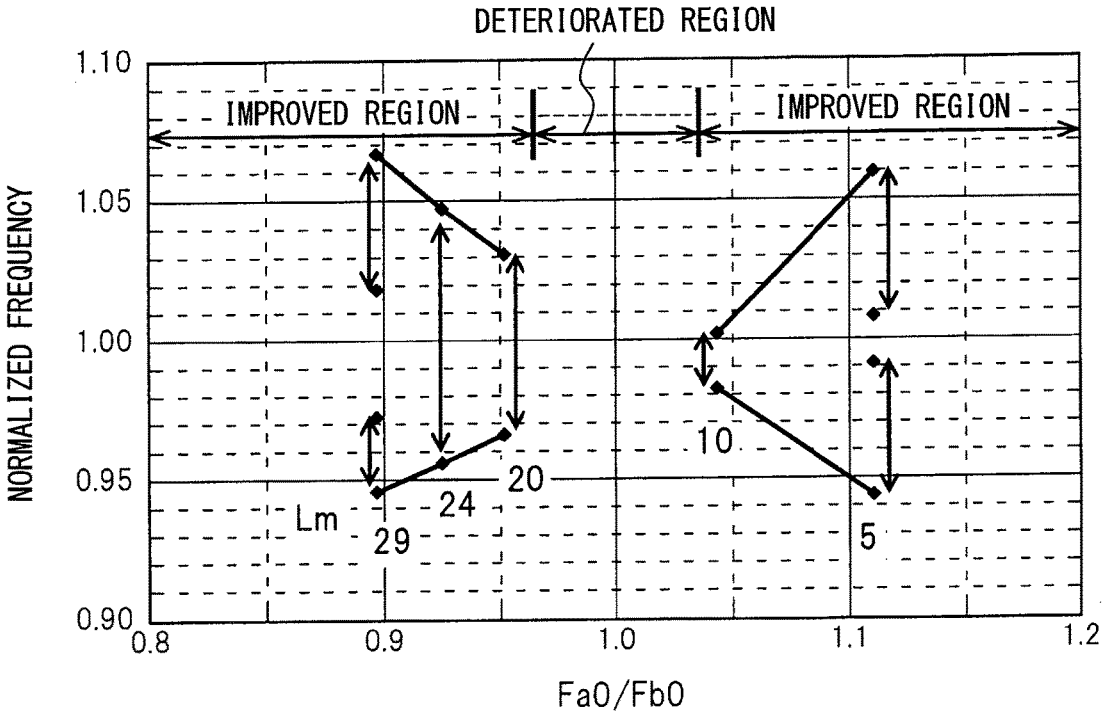
FIG. 12 is a characteristic diagram illustrating a relationship between a normalized frequency and Fa0/Fb0.

FIG. 12 is a graph showing a relationship between the ratio (Fa0/Fb0) of the two resonant frequencies Fa0 and Fb0 and the normalized frequency at which the return loss is −6 dB or less. In FIG. 12, the horizontal axis represents the ratio (Fa0/Fb0) of the two resonant frequencies Fa0 and Fb0 and the vertical axis represents the normalized frequency at which the return loss is −6 dB or less. In this case, as the two resonant frequencies Fa0 and Fb0, the values obtained from the expressions (1), (2), (3) and (4) are used, and as the normalized frequency at which the return loss is −6 dB or less, the value obtained from the return loss graph in FIG. 6 is used.

Incidentally, the normalized frequency is Fm/Fs obtained by normalizing a frequency Fm at which the return loss is −6 dB with a frequency Fs that is a minimum value in a section where the return loss is −6 dB or less. In the case where there are two frequencies Fs that are minimum values in the section where the return loss is −6 dB or less as with the curve B5 in FIG. 6, an average value (Fs1+Fs2)/2 of the two frequencies Fs1 and Fs2 which are two minimal values is set to a frequency Fs which is a minimal value.

It can be found from the graph of FIG. 12 that the normalized frequency changes according to the ratio (Fa0/Fb0) of the two resonant frequencies Fa0 and Fb0, and there are a region in which the return loss deteriorates (referred to as deteriorated region) and a region in which the return loss improves (referred to as an improved region). In the deteriorated region, a point (range) of the normalized frequency disappears and the ratio (Fa0/Fb0) becomes 1. In the improved region, the ratio (Fa0/Fb0) is in a range of 0.90 to 0.96 or in a range of 1.04 to 1.10. Since the return loss is deteriorated within the range of the deteriorated region, there is a need to set the ratio (Fa0/Fb0) of the two resonant frequencies Fa0 and Fb0 so as not to fall within the range of the deteriorated region.

Next, in order to set the range of the deteriorated region described above, a process of deriving a calculation formula for calculating the return loss and a process of setting the range of the deteriorated region based on the derived calculation formula will be described.

First, a procedure for deriving the return loss calculation formula will be described.

Figure 13:
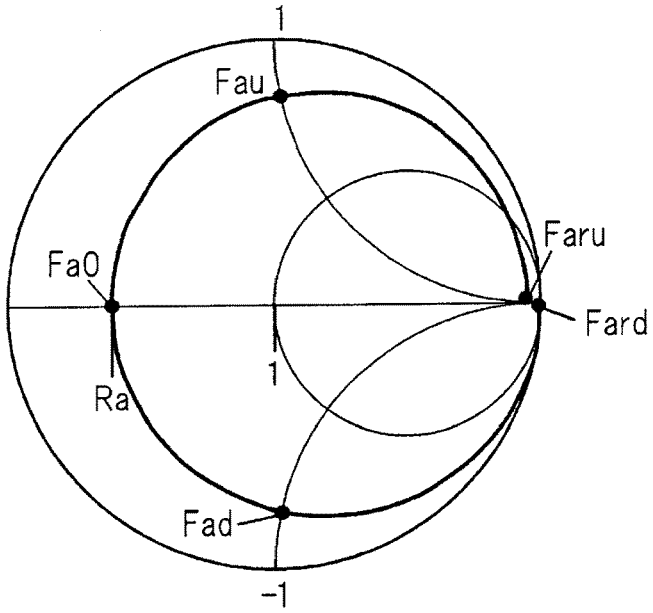
FIG. 13 is a Smith chart of an impedance Za.

FIG. 13 is an image diagram in which an impedance Za in the resonance mode A is plotted on the Smith chart. In FIG. 13, Fa0 is a resonant frequency in the resonance mode A, a reactance value is 0, and a resistance value is Ra. Fard is a low antiresonant frequency in the resonance mode A, and the reactance value is −∞. A frequency value of Fard is an infinitely small frequency value, but in the following calculation formula, a value sufficiently smaller than Fa0, for example, 1 MHz is used in the present embodiment in order to calculate 1/Fard.

$$Fard=1\ (\mathrm{MHz}) \tag{7a}$$

Faru is a high antiresonant frequency in the resonance mode A, and the reactance value is ∞. A frequency value of Faru is almost twice the frequency value of Fa0.

$$Faru=2Fa0 \tag{7b}$$

From FIG. 13, the impedance Za in the resonance mode A can be calculated by the following expression.

$$Za=Ra+jXa \tag{10}$$

Ra is a resonance resistance value (Ω) in the resonance mode A,

Xa is a reactance value (Ω) in the resonance mode A, j is an imaginary number

In Fard<F≤Fa0, the following three expressions are established.

$$\lambda a=Kad(1-(F/Fa0)^2)/(1-(F/Fard)^2) \tag{11}$$

$$Kad=((Fa0(1-\Delta ad)/Fard)^2-1)/(1-\Delta ad)^2) \tag{12}$$

$$\Delta ad=(Fa0-Fad)/Fa0 \tag{13}$$

F is a frequency for obtaining the impedance

Fard is a low antiresonant frequency in the resonance mode A, and the reactance is −∞, Fa0 is a resonant frequency (MHz) in the resonance mode A, and the reactance is 0, Fad is a frequency at which the reactance in the resonance mode A becomes −1, Kad is a low proportionality constant in the resonance mode A, Δad is a frequency ratio at which the reactance in the resonance mode A changes from −1 to 0, Further, in the case of Fa0≤F<Faru, the following three expressions are established.

$$\lambda a=Kau(1-(F/Fa0)^2)/(1-(F/Faru)^2) \tag{14}$$

$$Kau=((Fa0(1+\Delta au)/Faru)^2-1)/(1+\Delta au)^2) \tag{15}$$

$$\Delta au=(Fau-Fa0)/Fa0 \tag{16}$$

F is a frequency for obtaining the impedance

Figure 14:
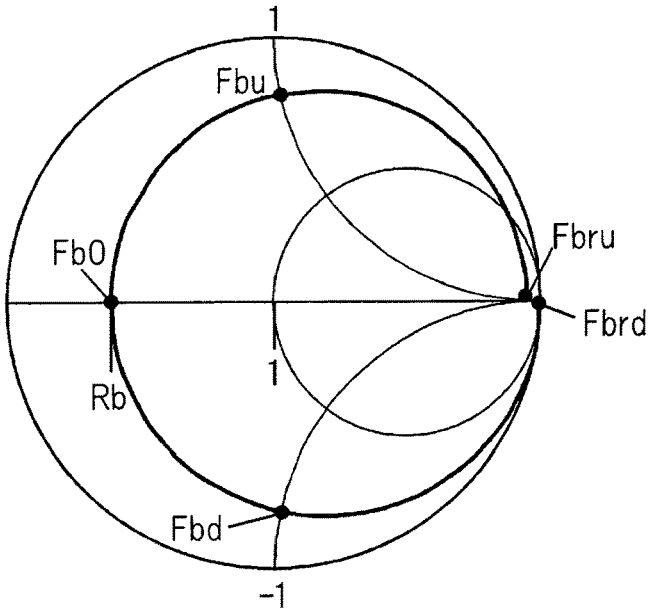
FIG. 14 is a Smith chart of an impedance Zb.

Faru is a high antiresonant frequency in the resonance mode A, and the reactance is ∞, Fau is a frequency at which the reactance in the resonance mode A becomes 1, Kau is a high proportionality constant in the resonance mode A, Δau is a frequency ratio at which the reactance in the resonance mode A changes from 0 to 1, In addition, FIG. 14 is an image diagram in which an impedance Zb in the resonance mode B is plotted on the Smith chart. In FIG. 14, Fb0 is a resonant frequency in the resonance mode B, a reactance value is 0, and a resistance value is Rb. Fbrd is a low antiresonant frequency in the resonance mode B, and the reactance value is −∞. The frequency value of Fbrd is approximately Fb0/2 in the case of the configuration having the short-circuit element 5 illustrated in FIGS. 4A to 4 C and an infinitely small frequency value in the case of the configuration without the short-circuit element 5. However, in the following calculation formula, in order to calculate 1/Fbrd, a value sufficiently smaller than Fb0, for example, 1 MHz is used in the present embodiment.

In the case of the configuration having the short-circuit element 5, $$Fbrd=Fb0/2 \tag{8a}$$

In the case of the configuration without the short-circuit element 5, $$Fbrd=1\ (\mathrm{MHz}) \tag{9a}$$

In the case where there is no short-circuit element 5 and Fb03 is the resonant frequency of the harmonic which is three times the resonance mode B, $$Fbrd=2Fb03/3 \tag{9c}$$

In addition, Fbru is a high antiresonant frequency in the resonance mode B, and the reactance value is ∞. The frequency value of Fbru is a frequency value of approximately 3Fb0/2 in the case of the configuration having the short-circuit element 5 illustrated in FIGS. 4A to 4 C, and the frequency value of approximately 2 Fb0 in the case of the configuration without the short-circuit element 5.

In the case of the configuration having the short-circuit element 5, $$Fbru=3Fb0/2 \tag{8b}$$

In the case of the configuration without the short-circuit element 5, $$Fbru=2Fb0 \tag{9b}$$

In the case where there is no short-circuit element 5 and Fb03 is the resonant frequency of the harmonic which is three times the resonance mode B, $$Fbru=4Fb03/3 \tag{9d}$$

Next, it is understood from FIG. 14, that the impedance Zb in the resonance mode B can be calculated by the following expression.

$$Zb=Rb+jXb \tag{17}$$

Rb is a resonance resistance value (Ω) in the resonance mode B,

Xb is a reactance value (Ω) in the resonance mode B, j is an imaginary number

In Fbrd<F≤Fb0, the following three expressions are established.

$$Xb=Kbd(1-(F/Fb0)^2)/(1-(F/Fbrd)^2) \tag{18}$$

$$Kbd=((Fb0(1-\Delta bd)/Fbrd)^2-1)/(1-(1-\Delta bd)^2) \tag{19}$$

$$\Delta bd=(Fb0-Fbd)/Fb0 \tag{20}$$

F is a frequency for obtaining the impedance

Fbrd is a low antiresonant frequency in the resonance mode B, and the reactance is −∞, Fb0 is a resonant frequency (MHz) in the resonance mode B, and the reactance is 0, Fbd is a frequency at which the reactance in the resonance mode B becomes −1, Kbd is a low proportionality constant in the resonance mode B, Δbd is a frequency ratio at which the reactance in the resonance mode B changes from −1 to 0, Further, in the case of Fb0≤F<Fbru, the following three expressions are established.

$$Xb=Kbu(1-(F/Fb0)^2)/(1-(F/Fbru)^2) \tag{21}$$

$$Kbu=(1-(Fb0(1+\Delta bu)/Fbru)^2)/(1-(1+\Delta bu)^2) \tag{22}$$

$$\Delta bu=(Fbu-Fb0)/Fb0 \tag{23}$$

F is a frequency for obtaining the impedance

Fbru is a high antiresonant frequency in the resonance mode B, and the reactance is ∞, Δbu is a frequency at which the reactance in the resonance mode B becomes 1, Kbu is a high proportionality constant in the resonance mode B, Δbu is a frequency ratio at which the reactance in the resonance mode B changes from 0 to 1, The admittances Ya and Yb in the resonance modes A and B can be calculated by the following expressions.

$$Ya=1/Za=1/(Ra+jXa) \tag{24}$$

$$Yb=1/Zb=1/(Rb+jXb) \tag{25}$$

Also, a combined admittance Yab in the resonance modes A and B, a reflection coefficient Γab, and a return loss RLab can be calculated by the following expressions.

$$\begin{aligned} Yab &= Ya+Yb \\ &= 1/(Ra+jXa)+1/(Rb+jXb) \\ &= (Ra-jXa)/(Ra^2+Xa^2)+(Rb-jXb)/(Rb^2+Xb^2) \\ &= Ra/(Ra^2+Xa^2)+Rb/(Rb^2+Xb^2)- \\ &\quad j(Xa/(Ra^2+Xa^2)+Xb/(Rb^2+Xb^2)) \\ &= Gab+jBab \end{aligned} \tag{26}$$

-continued $$\Gamma ab=(Y0-Yab)/(Y0+Yab) \tag{27}$$

$$RLab=20\mathrm{Log}(|\Gamma ab|) \tag{28}$$

Y0 is a normalized admittance (1/Ω), usually 1/50,

|Γab| is an absolute value of ab,

Gab is a composite conductance of resonance modes A and B,

Bab is a composite susceptance in the resonance modes A and B,

Next, a method of obtaining each constant necessary for calculating the above Expression (26) will be described.

Since Δad and Δau are almost the same in principle, an average value Δa is calculated and used as shown in the following expression.

$$\Delta a=(\Delta au+\Delta ad)/2 \tag{29}$$

Therefore, Kad and Kau are expressed as follows.

$$Kad=((Fa0(1-\Delta a)/Fard)^2-1)/(1-(1-\Delta a)^2) \tag{30}$$

$$Kau=(1-(Fa0(1+\Delta a)/Faru)^2)/(1-(1+\Delta a)^2) \tag{31}$$

In this example, since Δa<<1 is met, $$Kad=((Fa0/Fard)^2-1)/2/\Delta a \tag{32}$$

$$Kau=(1-(Fa0/Faru)^2)/2/(-\Delta a) \tag{33}$$

In the same manner, since Δbd and Δbu are almost the same in principle, an average value Δb is calculated and used as shown in the following expression.

$$\Delta b=(\Delta bu+\Delta bd)/2 \tag{34}$$

Therefore, Kbd and Kbu are expressed as follows.

$$Kbd=((Fb0(1-\Delta b)/Fbrd)^2-1)/(1-(1-\Delta b)^2) \tag{35}$$

$$Kbu=(1-(Fa0(1+\Delta b)/Fbru)^2)/(1-(1+\Delta b)^2) \tag{36}$$

In this example, since Δb<<1 is met, $$Kbd=((Fb0/Fbrd)^2-1)/2/\Delta b \tag{37}$$

$$Kbu=(1-(Fb0/Fbru)^2)/2/(-\Delta b) \tag{38}$$

Figures 15, 16:
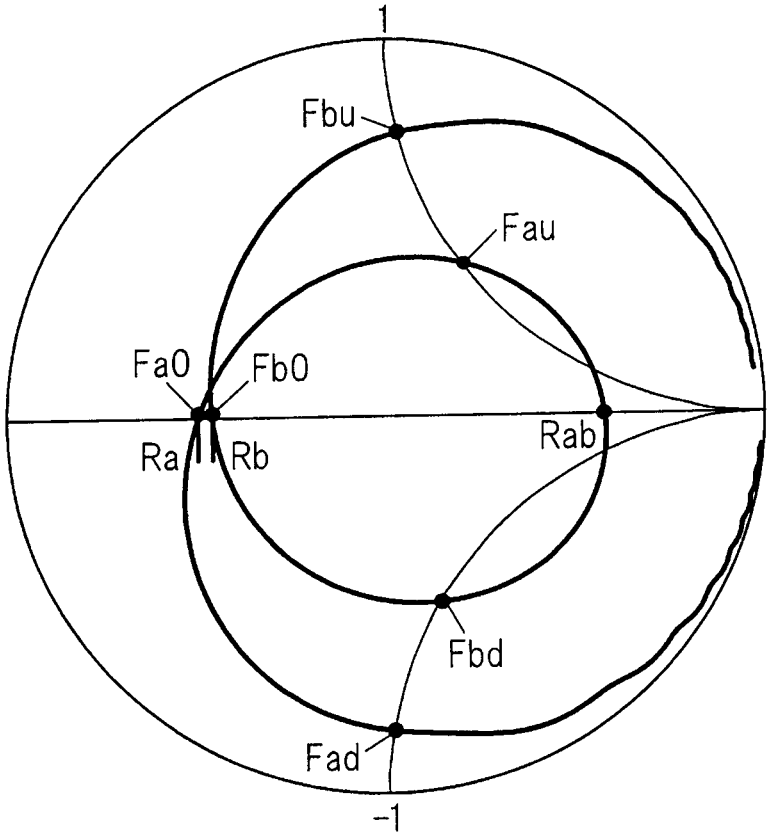
FIG. 15 is a Smith chart illustrating simulation results of an impedance.
FIG. 16 is a table illustrating each frequency and each constant.

FIG. 15 is a diagram in which the points of each frequency are additionally written in the impedance simulation result in the configuration in which the parameter S is set to 6.2 mm and Lm is set to 29 mm in the antenna illustrated in FIGS. 4A to 4C. In FIG. 15, Rab is the resonance resistance value (Ω) of the two resonance modes A and B. In addition, FIG. 16 shows a table of the values obtained from the simulation results and the values of the resonance resistance and the calculation results of the respective constants Δa and Δb calculated by the above calculation formulas.

Next, it is confirmed that the calculation results calculated by the expressions (27) and (28) substantially coincide with the simulation results with the use of the respective frequencies and the respective constants obtained as described above.

Figure 17:
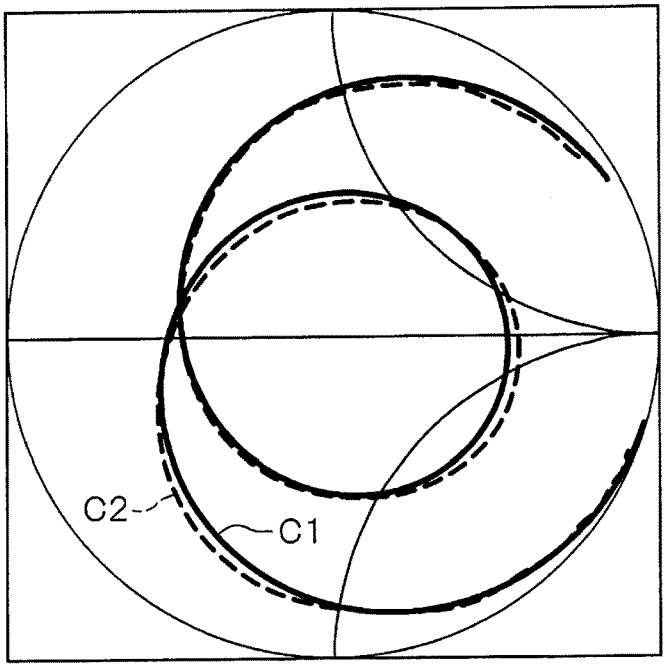
FIG. 17 is a Smith chart comparing the simulation results with calculation results.
Figure 18:
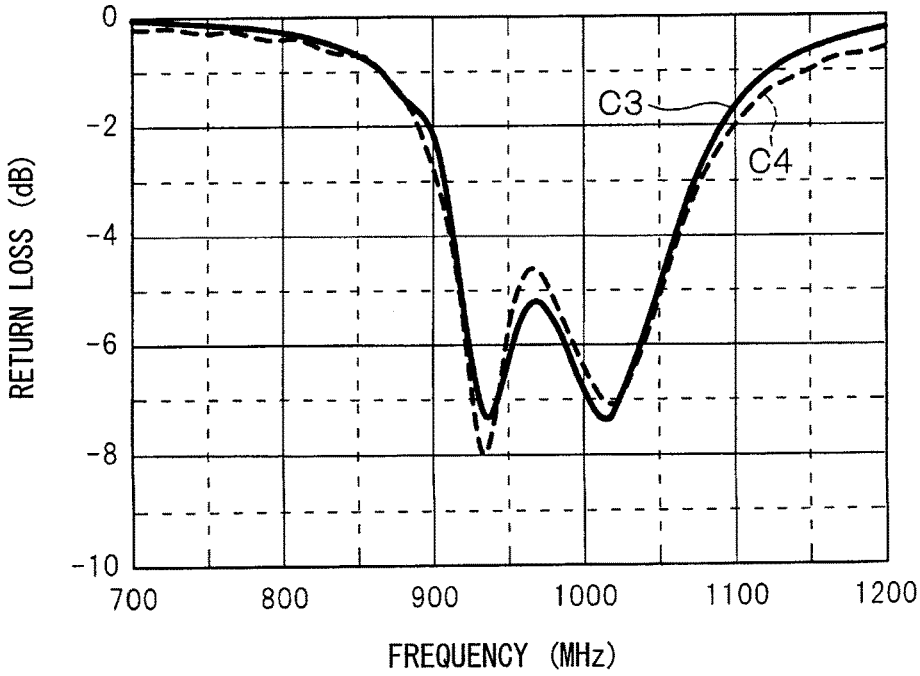
FIG. 18 is a characteristic diagram illustrating a relationship between the return loss and the frequency for comparing the simulation results with the calculation results.

FIGS. 17 and 18 are graphs showing comparison of the simulation results of the impedance and the return loss with the calculation results of calculating the impedance and the return loss through Expressions (27) and (28) in a configuration where the parameter S is set to 6.2 mm and the parameter Lm is set to 29 mm in the antenna illustrated in FIGS. 4A to 4C.

In the case of calculating through Expressions (27) and (28), calculation is performed with the use of the respective values of the resonance resistance (Ra, Rb) and the respective constants (Δa, Δb) described in a table of FIG. 16, as well as with the use of the respective values of the resonant frequencies (Fa0, Fb0) and the antiresonant frequencies (Fard, Faru, Fbrd, Fbru) of the two resonance modes A and B. The respective values of the resonant frequencies (Fa0, Fb0) are obtained with the use of Expressions (5) and (6). The values of antiresonant frequencies (Fard, Faru, Fbrd, Fbru) are obtained with the use of Expressions (7a), (7b), (8a) and (8b).

In the Smith chart of FIG. 17, a solid line C1 indicates the calculation results, and a broken line C2 indicates the simulation results. FIG. 18 is a characteristic diagram showing a relationship between the frequency and the return loss. In FIG. 18, a solid line C3 indicates the calculation results, and a broken line C4 indicates the simulation results. It can be seen from the Smith chart in FIG. 17 and the return loss characteristic diagram in FIG. 18 that the calculation results by Expressions (27) and (28) well coincide with the simulation results. In other words, it is proved that Expressions (27), (28), and so on are correct.

Figure 19:
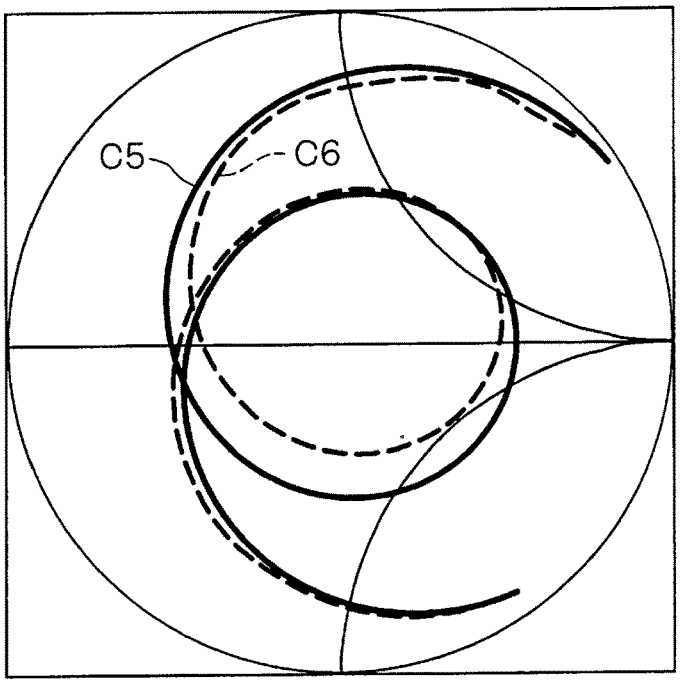
FIG. 19 is a Smith chart comparing the simulation results with the calculation results.
Figure 20:
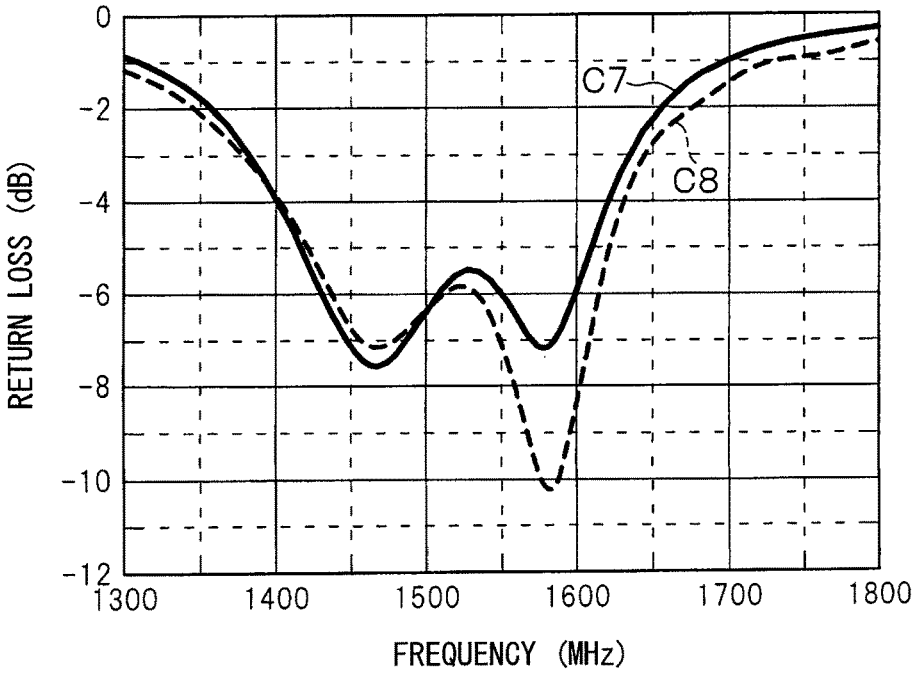
FIG. 20 is a characteristic diagram illustrating a relationship between the return loss and the frequency for comparing the simulation results with the calculation results.

FIGS. 19 and 20 are graphs showing comparison of the simulation results of the impedance and the return loss with the calculation results of calculating the impedance and the return loss through Expressions (27) and (28) in a configuration where the parameter Lm is changed from 29 mm to 5 mm. In this case, the calculation is performed in substantially the same manner as in the case of FIGS. 17 and 18 described above.

In other words, in the case of calculating through Expressions (27) and (28), calculation is performed with the use of the respective values of the resonance resistance (Ra, Rb) and the respective constants (Δa, Δb) described in a table of FIG. 16, as well as with the use of the respective values of the resonant frequencies (Fa0, Fb0) and the antiresonant frequencies (Fard, Faru, Fbrd, Fbru) of the two resonance modes A and B. The respective values of the resonant frequencies (Fa0, Fb0) are obtained with the use of Expressions (5) and (6). The values of antiresonant frequencies (Fard, Faru, Fbrd, Fbru) are obtained with the use of Expressions (7a), (7b), (8a) and (8b).

In the Smith chart of FIG. 19, a solid line C5 indicates the calculation results, and a broken line C6 indicates the simulation results. FIG. 20 is a characteristic diagram showing a relationship between the frequency and the return loss. In FIG. 20, a solid line C7 indicates the calculation results, and a broken line C8 indicates the simulation results. It can be seen from the Smith chart in FIG. 19 and the return loss characteristic diagram in FIG. 20 that the calculation results by Expressions (27) and (28) well coincide with the simulation results. In other words, it is proved that the calculations derived from Expressions (27) and (28) are correct.

Next, a method of determining the range of the deteriorated region described above will be described.

First, the following two relational expressions are established among the resonance resistance Ra in the resonance mode A, the resonance resistance Rb in the resonance mode B, and the resonance resistance Rab of the two resonance modes illustrated in FIG. 15.

$$Rab<Ra \tag{39}$$

$$Rab<Rb \tag{40}$$

In those expressions (39) and (40), if the resistance value is made inverse, the following expressions are established.

$$1/Rab>1/Ra \tag{41}$$

$$1/Rab>1/Rb \tag{42}$$

Then, 1/Rab is obtained as follows.

The following expression is obtained from Expression (26).

$$Ra/(Ra^2+Xa^2)+Rb/(Rb^2+Xb^2)=Gab=1/Rab$$

Therefore, the following expression is obtained.

$$1/Rab=Ra/(Ra^2+Xa^2)+Rb/(Rb^2+Xb^2) \tag{43}$$

Hence, the following expressions are established.

$$Ra/(Ra^2+Xa^2)+Rb/(Rb^2+Xb^2)>1/Ra \tag{44}$$

$$Ra/(Ra^2+Xa^2)+Rb/(Rb^2+Xb^2)>1/Rb \tag{45}$$

When both sides of Expression (44) are multiplied by $Ra(Ra^2+Xa^2)$, the following expressions are obtained.

$$RaRb(Ra^2+Xa^2)/(Rb^2+Xb^2)>Xa^2 \tag{46}$$

$$RaRb(Ra^2+Xa^2)/Xa^2>(Rb^2+Xb^2) \tag{47}$$

Similarly, when both sides of Expression (45) are multiplied by $Ra(Ra^2+Xa^2)$, the following expression is obtained.

$$RaRb(Rb^2+Xb^2)/Xb^2>(Ra^2+Xa^2) \tag{48}$$

When Expression (47) is multiplied by Expression (48), the following expressions are established.

$$Ra^2Rb^2/Xa^2/Xb^2>1 \tag{49}$$

$$Ra^2Rb^2>Xa^2Xb^2 \tag{50}$$

$$RaRb>XaXb \tag{51}$$

When substituting Expressions (14) and (18), the following expression is obtained.

$$RaRb>|Kau(1-(F/Fa0)^2)/(1-(F/Faru)^2)|\cdot|Kbd(1-(F/Fb0)^2)/(1-(F/Fbrd)^2)| \tag{52}$$

Next, a relationship between F and Fa0, Fb0 is defined as follows.

$$F=Fa0(1+\Delta f)=Fb0(1-\Delta f) \tag{53}$$

$$\Delta f=(Fb0-Fa0)/(Fa0+Fb0) \tag{54}$$

Expression (53) is substituted into Expression (52), and since $\Delta f<<1$ is met in the range of the deteriorated region, the following expression is established.

$$RaRb>|Kau\cdot 2(-\Delta f)/(1-(F/Faru)^2)|\cdot|Kbd\cdot 2\Delta f/(1-(Fb0/Fbrd)^2)| \tag{55}$$

When Expression (55) is substituted into Expressions (33) and (37), the following expressions are satisfied.

$$RaRb>\Delta f^2/\Delta a/\Delta b \tag{56}$$

$$\Delta f^2<RaRb\Delta a\Delta b \tag{57}$$

$$-\Delta fm<\Delta f<\Delta fm \tag{58}$$

In this example, Δfm is a frequency ratio of a degraded range boundary, and the following expressions are established.

$$\Delta fm=\sqrt{(RaRb\Delta a\Delta b)} \tag{59}$$

The following expressions are obtained from Expression (53).

$$Fa0/Fb0=(1-\Delta f)/(1+\Delta f) \tag{60}$$

The deteriorated region is defined by Expressions (58), (59), and (60).

$$(1-\Delta fm)/(1+\Delta fm)<Fa0/Fb0 \tag{61}$$

Alternatively, the following expression is established.

$$Fa0/Fb0<(1+\Delta fm)/(1-fm) \tag{62}$$

The calculation method for determining the range of the deteriorated region has been described above.

Next, a method for improving the return loss will be described. In order to improve the return loss, there is a need to set the frequency ratio to fall outside the range of the deteriorated region, that is, within the improved region. For that reason, there is a need to set the ratio (Fa0/Fb0) of the two resonant frequencies Fa0 and Fb0 within the range of the return loss improved region satisfying the following conditional expression obtained from Expressions (60) and (61).

$$(1-\Delta fm)/(1+\Delta fm)>Fa0/Fb0 \quad (63)$$

Alternatively, the following expression is established.

$$Fa0/Fb0>(1+\Delta fm)/(1-\Delta fm) \quad (64)$$

In this situation, when Fb0 in Expressions (63) and (64) is transposed, the following Expression is established.

$$((1-\Delta fm)/(1+\Delta fm))Fb0>Fa0 \quad (65)$$

Alternatively, the following expression is established.

$$Fa0>((1+\Delta fm)/(1-\Delta fm))Fb0 \quad (66)$$

In this situation, when transposing the term of Δfm in Expressions (65) and (66), the following expression is established.

$$((1+\Delta fm)/(1-\Delta fm))Fa0<Fb0 \quad (67)$$

Alternatively, the following expression is established.

$$Fb0<((1-\Delta fm)/(1+\Delta fm))Fa0 \quad (68)$$

Therefore, the length (Lm+S) to the inductance shape of the first element 3 or the second element 4 is adjusted with the use of Expressions (3), (4), (5), and (6) so that the relationship between the two resonant frequencies Fa0 and Fb0 satisfies Expressions (65) and (66), or Expressions (67) and (68). As a result, the return loss can be improved.

First Embodiment

Subsequently, a first embodiment of the present disclosure will be described with reference to FIGS. 1A to 1D and 2. A deformed folded dipole antenna 21 according to the present embodiment has a structure illustrated in FIGS. 1A to 1D. The deformed folded dipole antenna 21 includes a first element 23 formed of a conductor pattern (that is, a conductor formed of a line) on one surface of a plate-like substrate 22 (refer to FIG. 1B) made of dielectric, a second element 24 that is formed of a conductor pattern (that is, a conductor formed of a line) on the other side of the substrate 2, and a short-circuit element 70 for short-circuiting the first element 23 and the second element 24. The substrate 22 is a substrate made of a dielectric material, for example a glass epoxy. It is assumed that a thickness of the substrate 22 (dielectric) is t, a relative dielectric constant of the substrate 22 (dielectric) is ε, and a dielectric loss of the substrate 22 (dielectric) is tan δ.

Figure 1A:
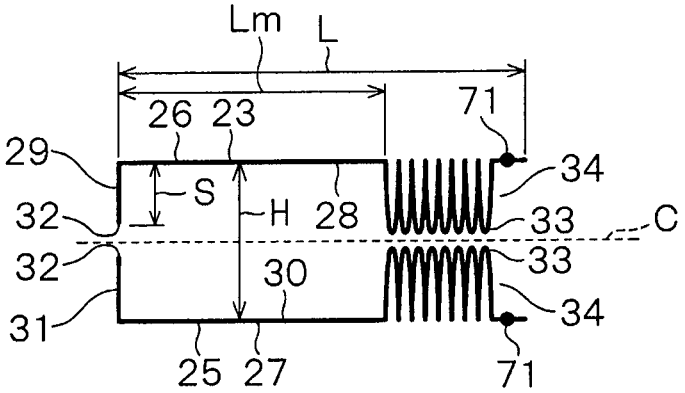
Figure 1B:
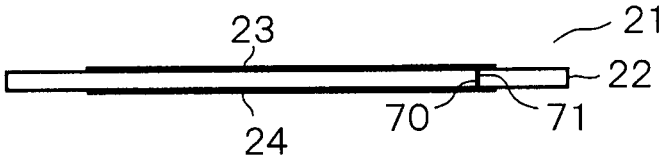

As illustrated in FIG. 1A, the first element 23 includes a power feeding side parallel portion 25 formed of a conductor pattern (for example, a copper foil pattern). The power feeding side parallel portion 25 has two L-shaped portions that are symmetrical with respect to a center plane in an antenna width direction (hereinafter referred to as width direction center plane) C, that is, a first L-shaped portion 26 and a second L-shaped portion 27. The first L-shaped portion 26 includes a long side portion 28 and a short side portion 29. The long side portion 28 is in parallel to the width direction center plane C. The short side portion 29 is shorter than the long side portion 28 and is coupled to one end (the left end in FIG. 1A to FIG. 1D) of the long side portion 28 and vertically protrudes from the long side portion 28 toward the width direction center plane C.

The second L-shaped portion 27 also has the same structure as that of the first L-shaped part 26, and has a long side portion 30 and a short side portion 31. The long side portion 30 has the same length and width as those of the long side portion 28 of the first L-shaped portion 26, and faces the long side portion 28 across the width direction center plane C. The short side portion 31 is shorter than the long side portion 30 and is coupled to one end (a left end in FIG. 1A to FIG. 1D) of the long side portion 30. Further, the short side portion 31 vertically protrudes from the long side portion 30 in the width direction center plane C direction. The width and the length of the short side portion 31 are the same as those of the short side portion 29 of the first L-shaped portion 26.

As described above, the first L-shaped portion 26 and the second L-shaped portion 27 have the same shape and are disposed so that their short side portions 29 and 31 face each other. Tip portions of the short side portions 29 and 31 serve as feeding points 32. The width direction center plane C described above is a plane perpendicular to a plane of the substrate 22 and parallel to the long side portion 28 of the first L-shaped portion 26 and the long side portion 30 of the second L-shaped portion 27.

In addition, the first L-shaped portion 26 and the second L-shaped portion 27 are formed with inner protruding portions 33 and 33 on parts of the first L-shaped portion 26 and the second L-shaped portion 27. The inner protruding portions 33 protrude inward so as to be surrounded by the first L-shaped portion 26 and the second L-shaped portion 27 in the plane of the substrate 22 from straight portions of the long side portions 28 and 30 of the first L-shaped portion 26 and the second L-shaped portion 27. The respective inner protruding portions 33 form inductance shapes 34.

Figure 1C:
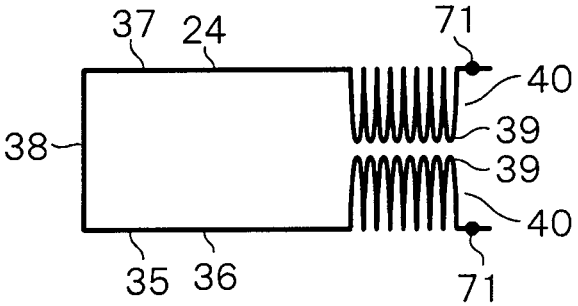
Figure 1D:
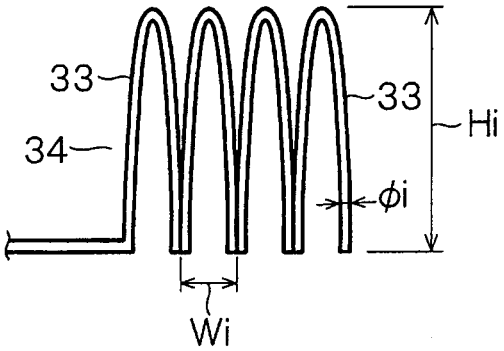

As illustrated in FIG. 1D, each of the inner protruding portions 33 in the present embodiment has a semielliptical shape one by one. Because of the semielliptical shape, a width of each tip portion is shorter than a length of a base portion, that is, a length between two end points, and the width becomes continuously narrower toward the tip. The number of the inner protruding portions 33 is, for example, eight, on each of the long side portion 28 of the first L-shaped portion 26 and the long side portion 30 of the second L-shaped portion 27, respectively. In this case, when it is assumed that the number of inner protruding portions 33 forming one inductance shape 34 is Ni, Ni=8 in the present embodiment. Eight inner protruding portions 33 are located continuously from the vicinity of the tip portion of the long side portion 28 of the first L-shaped portion 26 toward the short side portion 29. The same is applied to the second L-shaped portion 27 side, and eight inner protruding portions 33 are continuously formed in the direction of the short side portion 31 from the vicinity of the tip portion of the long side portion 30 of the second L-shaped portion 27.

The term "continuous" means that an end portion of one inner protruding portion 33 and an end portion of another inner protruding portion 33 adjacent to the one inner protruding portion 33 are the same as illustrated in FIG. 1D. Further, in the present embodiment, the positions of both end portions of each inner protruding portion 33 are at the same position as the lower end portion (or the upper end portion) of the long side portions 28 and 30. Each inner protruding portion 33 is bent from the linear portion (conductor pattern) of the long side portions 28 and 30 at one (left side) end, protruded inward, folded back at the tip portion, and again coupled to the straight portion (conductor pattern) of the long side portions 28 and 30 at the other (right side) end. As illustrated in FIG. 1D, it is assumed that a width of the base portion of each inner protruding portion 33 is Wi, a height is Hi, and a line width is ϕi. Further, it is assumed that the number of inner protruding portions 33 corresponding to one inductance shape 34 is Ni.

In the first element 23 configured as described above, as illustrated in FIG. 1A, it is assumed that a length (element length) in a longitudinal direction (element length) of the long side portions 28 and 30 is L, and a length of a portion excluding the inductance shape 34 in the length in the longitudinal direction of the long side portions 28 and 30 is Lm. It is assumed that an opposing distance (element height) between the long side portions 28 and 30 is H. It is assumed that a line width of the long side portions 28 and 30 is the same as a line width of the inner protruding portion 33, and is set to ϕi. It is assumed that a length of the short side portions 29 and 31 is S. A line width of the short side portions 29 and 31 is the same as the line width of the long side portions 28 and 30 (that is, the line width of the inner protruding portions 33), and is ϕi.

As illustrated in FIG. 1C, the second element 24 includes a non-power feeding side parallel portion 35 formed of a conductor pattern (for example, a copper foil pattern). The non-power feeding side parallel portion 35 includes a pair of opposite side portions 36 and 37 disposed to face each other and a coupling side portion 38 that couples one ends of the pair of opposite side portions 36 and 37 to each other.

The opposite side portions 36 and 37 are in parallel to each other and have the same length and width with each other. A length of the opposite side portion 36 is L (element length) described above, and faces the long side portion 28 of the first L-shaped portion 26 in the first element 23 through the substrate 22. Similarly, the other opposite side portion 37 has a length of L. The opposite side portion 37 faces the long side portion 30 of the second L-shaped portion 27 in the first element 23 through the substrate 22. A line width of these opposite side portions 36 and 37 is the same as the line width of the long side portions 28 and 30 in the first element 23, and is ϕi.

The coupling side portion 38 is perpendicular to the two opposite side portions 36 and 37, a length (element height) of the coupling side portion 38 is H, a line width of the coupling side portion 38 is the same as the line width of the opposite side portions 36 and 37, and is ϕi. The coupling side portion 38 faces the short side portion 29 of the first L-shaped portion 26 and the short side portion 31 of the second L-shaped portion 26 in the first element 23 through the substrate 22.

The opposite side portions 36 and 37 are formed with inner protruding portions 39 and 39 protruding inwardly and surrounded by the opposite side portions 36, 37 and the coupling side portion 38. Each of the inner protruding portions 39 forms an inductance shape 40. In the present embodiment, the inner protruding portion 39 has the same shape as the inner protruding portion 33 formed in the first element 23, and the inner protruding portion 39 also has a semielliptical shape. Also, the inner protruding portion 39 has the same size as the inner protruding portion 33. Further, the number of inner protruding portions 39 is the same as that of the inner protruding portion 33, and in the present embodiment, 8×2 pieces are formed, and the inner protruding portions 39 are formed at positions facing the respective inner protruding portions 33.

In addition, the short-circuit element 70 includes through holes 71 (refer to FIG. 1B) which connect the respective tip portions of the L-shaped portions 26 and 27 of the first element 23 to the tip portions of the respective other end portions of the opposite side portions 36 and 37 of the second element 24.

In the present embodiment, the length S of the short side portions 29 and 31 is set to, for example, 6.2 mm, and the length Lm of the portion except for the inductance shapes 34 and 40 in the longitudinal length of the long side portions 28, 30, 36, and 37 is set to 5, 10, 15, 20, 24, or 29 mm, for example. As a result, the length (Lm+S) is set to 11.2, 16.2, 21.2, 26.2, 30.2, or 35.2 mm. At this time, when Lm is 5 mm, the short side portions 29 and 31 are longer than the long side portions 28 and 30. All of the line widths ϕi are set to, for example, 0.2 mm, the height Hi of the inner protruding portions 33 and 39 is set to, for example, 6 mm, the width Wi of the base portion is set to, for example, 0.6 mm, and the thickness t of the dielectric substrate 22 is set to 0.8 mm. Further, a relative dielectric constant ε of the substrate 22 is set to 4.9, and a dielectric loss tan δ of the dielectric is set to 0.025. As a result of simulation under such setting conditions, as illustrated in FIG. 6 or 12, the antenna whose return loss is improved has the length (Lm+S) of 11.2, 16.2, 26.2, 30.2, and 35.2 mm. On the contrary, as illustrated in FIG. 6 or 12, the antenna whose return loss is deteriorated has the length (Lm+S) of 21.1 mm.

Figure 2:
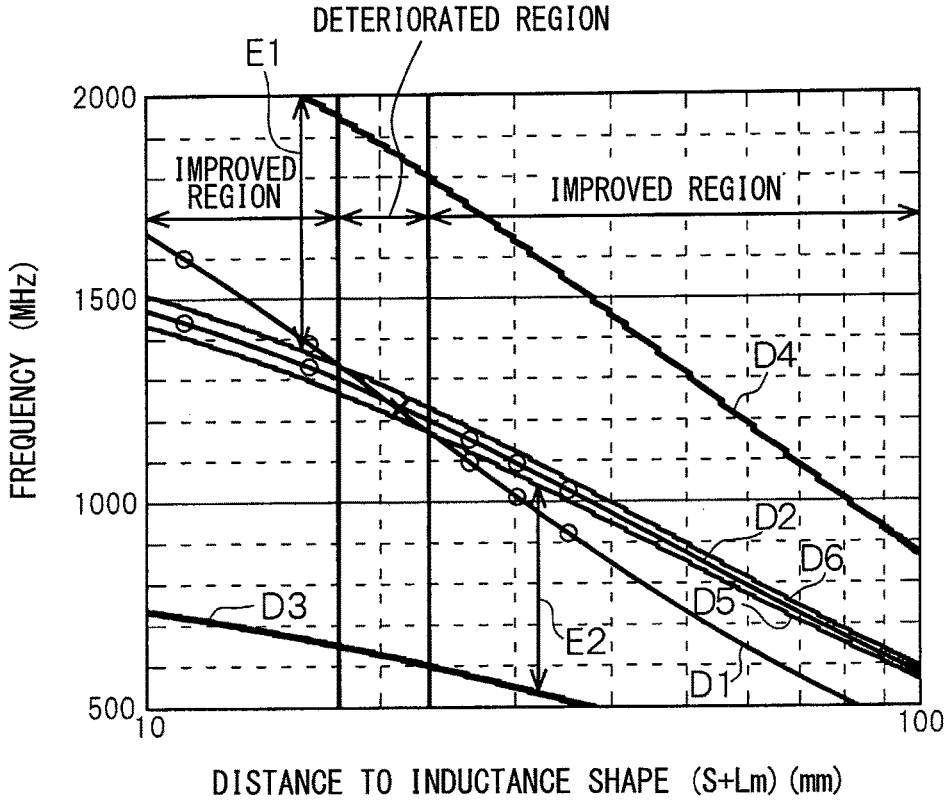
FIG. 2 is a characteristic diagram illustrating a relationship between a frequency and a length (Lm+S)

FIG. 2 is a graph showing a relationship between the length (Lm+S) and the frequency. Referring to FIG. 2, an improved region and a deteriorated region of the return loss will be described. In FIG. 2, the horizontal axis represents the length (Lm+S) and the vertical axis represents the frequency. In FIG. 2, a curve D1 shows a resonant frequency Fa0 in a resonance mode A and a curve D2 shows a resonant frequency Fb0 in a resonance mode B. Those Fa0 and Fb0 are obtained according to Expressions (3), (4), (5), (6) and the length (Lm+S). The values obtained in FIG. 7 are used as a proportionality constant Ca1 of λa, a constant Ca0 of λa, a proportionality constant Cb1 of kb, and a constant Cb0 of λb. In addition, a resonance mode in which current directions flowing through the first element 23 and the second element 24 are the same direction is the resonance mode A, and a resonance mode in which the current directions are reverse is the resonance mode B.

Further, when a placement position of the short-circuit element 70 connecting the first element 23 and the second element 24 is changed, the values of the proportionality constant Cb1 of λb and the constant Cb0 of λb change.

In FIG. 2, a curve D3 shows a low antiresonant frequency Fbrd in the resonance mode B, and a curve D4 shows a high anti-resonant frequency Fbru in the resonance mode B. Those Fbrd and Fbru are derived from Expressions (8a) and (8b).

In FIG. 2, a curve D5 shows Fb0 ((1−Δm)/(1+Δfm)) and a curve D6 shows Fb0((1+Δfm)/(1−Δfm)). The Fb0 ((1−Δfm)/(1+Δfm)) and Fb0((1+Δfm)/(1−Δfm)) are derived from Expressions (65) and (66), which are a boundary to separate the deteriorated region and the improved region from each other. The curves D5 and D6 are located slightly below and above the curve D2 of Fb0. Incidentally, Δfm is obtained through Expression (59) with the use of the constant obtained in FIG. 16.

The improved region of the return loss is an area that satisfies Expressions (65) and (66), and is expressed by the following expression.

$$Fbru > Fa0 > ((1+\Delta fm)/(1-\Delta fm))Fb0 \quad (69)$$

Alternatively, the following expression is established.

$$Fbrd<Fa0<((1-\Delta fm)/(1+\Delta fm))Fb0 \quad (70)$$

When viewed on the vertical axis (that is, the frequency axis) of FIG. 2, the improved region is regions indicated by both of arrows E1 and E2, and when viewed on the horizontal axis in FIG. 2 (that is, the length (Lm+S) axis), the improved region is a region marked as improved regions. The regions indicated by both of the arrows E1 and E2 on the vertical axis are a range slightly above the resonant frequency Fb0 in the resonance mode B, that is, a range from ((1+Δfm)/(1−Δfm))Fb0 to the high anti-resonant frequency Fbru in the resonance mode B, and a range slightly below the resonant frequency Fb0 in the resonance mode B, that is, a range from ((1−Δfm)/(1+Δfm))Fb0 to the low antiresonant frequency Fbrd in the resonance mode B.

The improved region on the horizontal axis includes a region in which the resonant frequency Fa0 (that is, the curve D1) in the resonance mode A is slightly above the resonant frequency Fb0 in the resonance mode B, that is, a region below a cross point with ((1+Δfm)/(1−Δfm))Fb0 (that is, curve D6), and a region in which the resonant frequency Fa0 in the resonance mode A (that is, the curve D1) is slightly below the resonant frequency Fb0 in the resonance mode B, that is, a region above a cross point with ((1−Δfm)/1+Δfm))Fb0 (that is, curve D5).

The length (Lm+S) is determined with the use of Expressions (3), (4), (5), and (6) so that the resonant frequency Fa0 in the resonance mode A falls within the improved region, thereby being capable of improving the return loss.

In other words, the length (Lm+S) is determined with the use of Expressions (3), (4), (5), and (6) so that the resonant frequency Fa0 in the resonance mode A falls within the range slightly above the resonant frequency Fb0 in the resonance mode B, in other words, a range from the ((1+Δfm)/(1−Δfm))Fb0 to the high antiresonant frequency Fbru in the resonance mode B, or a range slightly below the resonant frequency Fb0 in the resonance mode B, in other words, a range from ((1−Δfm)/(1+Δfm))Fb0 to the low resonant frequency Fbrd in the resonance mode B, thereby being capable of improving the return loss.

In FIG. 2, symbols ○ indicate the resonant frequency Fa0 in the resonance mode A and the resonant frequency Fb0 in the resonance mode B of the antennas whose return loss is improved as a result of the simulation, that is, the respective antennas whose length (Lm+S) is 11.2, 16.2, 26.2, 30.2, 35.2 mm.

In FIG. 2, the symbol x indicates that the resonant frequency Fa0 in the resonance mode A and the resonant frequency Fb0 in the resonance mode B of the antennas whose return loss is deteriorated as a result of the simulation, in other words, the antennas whose length (Lm+S) is 21.2 mm.

It can be found from FIG. 2 that Fa0 and Fb0 (that is, the positions of the symbol ○) of the improved region determined by the calculation formula and the improved region determined from the simulation result well coincide with each other. In addition, it can be found from FIG. 2 that Fa0 and Fb0 (that is, the position of the symbol x) of the deteriorated region determined by the calculation formula and the deteriorated region determined from the simulation result well coincide with each other. That is, it is proved that the calculation result by the above calculation formula is correct.

Further, in the present embodiment, since the bent portions are provided in the line portions other than the inductance shapes 34 and 40 of the first element 23 and the second element 24, an element height H of the deformed folded dipole antenna 21 can be lowered.

Second Embodiment

Figure 21:
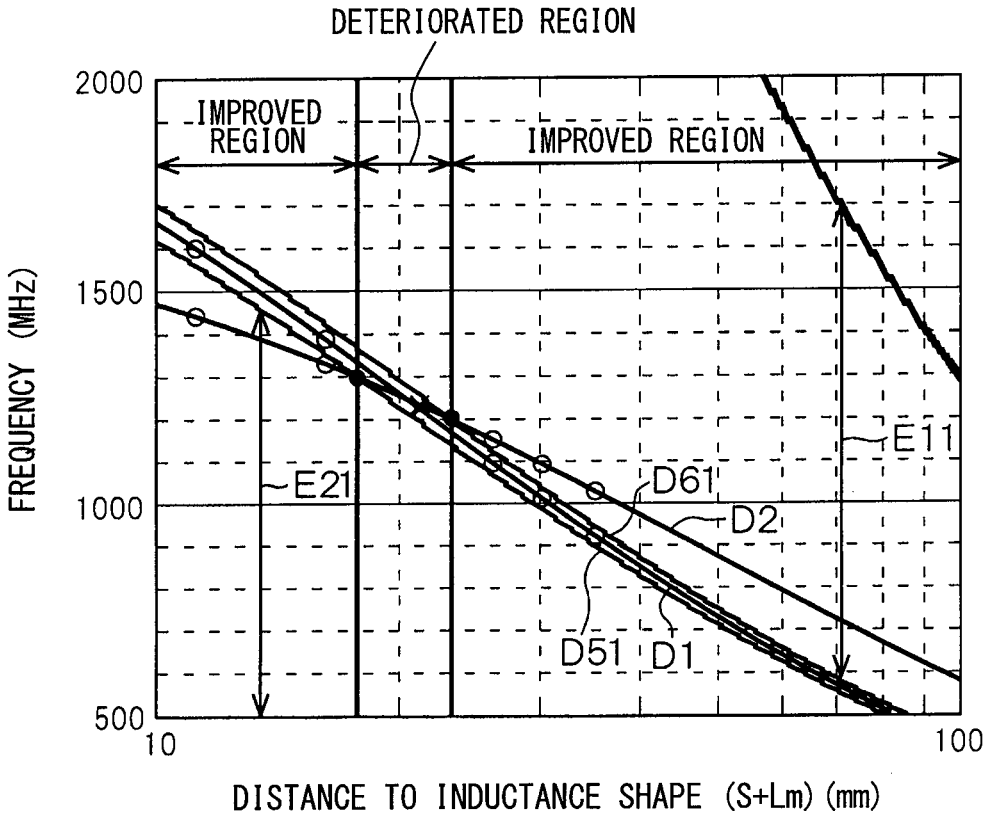
FIG. 21 is a characteristic diagram illustrating a relationship between a frequency and a length (Lm+S) according to a second embodiment of the present disclosure.
Figure 22A:
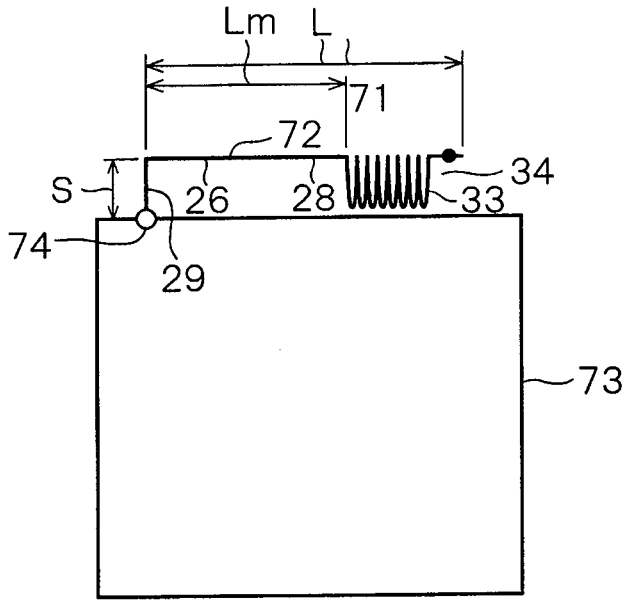
Figure 22B:
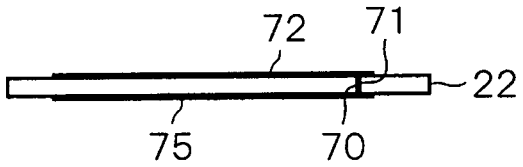
Figure 22C:
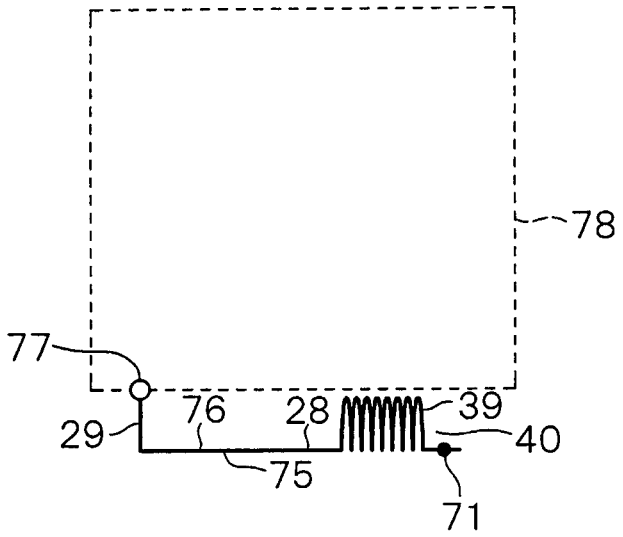

FIG. 21 illustrates a second embodiment of the present disclosure. It should be noted that the same reference numerals are given to the same configurations as those in the first embodiment. The specific configuration of the deformed folded dipole antenna 21 according to the second embodiment is the same as that of the first embodiment. In the first embodiment, in the determination of the improved region and the deteriorated region of the return loss, the calculation is made based on the low antiresonant frequency Fbrd and the high antiresonant frequency Fbru in the resonance mode B. On the other hand, in the second embodiment, the calculation is made based on the low antiresonant frequency Fard and the high antiresonant frequency Faru in the resonance mode A. Hereinafter, the second embodiment will be described in more detail.

FIG. 21 is a graph showing a relationship between the length (Lm+S) and the frequency. Referring to FIG. 21, a calculation method for determining the improved region and the deteriorated region of the return loss will be described. In FIG. 21, a curve D1 shows a resonant frequency Fa0 in a resonance mode A and a curve D2 shows a resonant frequency Fb0 in a resonance mode B. Those Fa0 and Fb0 are obtained according to Expressions (3), (4), (5), (6) and the length (Lm+S). The values obtained in FIG. 7 are used as a proportionality constant Ca1 of λa, a constant Ca0 of λa, a proportionality constant Cb1 of λb, and a constant Cb0 of λb. Further, when a placement position of the short-circuit element 70 connecting the first element 23 and the second element 24 is changed, the values of the proportionality constant Cb1 of λb and the constant Cb0 of λb change.

In FIG. 21, a curve D41 shows the high antiresonant frequency Faru in the resonance mode A. The low antiresonant frequency Fard in the resonance mode A is not shown in FIG. 21 but falls outside a region shown in FIG. 21. Those Fard and Faru are derived from Expressions (7a) and (7b).

In FIG. 2, a curve D51 shows Fa0 ((1−Δm)/(1+Δfm)) and a curve D61 shows Fa0((1+Δfm)/(1−Δfm)). The Fa0 ((1−Δfm)/(1+Δfm)) and Fa0((1+Δfm)/(1−Δfm)) are derived from Expressions (67) and (68), which are a boundary to separate the deteriorated region and the improved region from each other. The curves D51 and D61 are located slightly below and above the curve D1 of Fa0. Incidentally, Δfm is obtained through Expression (59) with the use of the constant obtained in FIG. 16.

The improved region of the return loss is an area that satisfies Expressions (67) and (68), and is expressed by the following expression.

$$Faru>Fb0>((1+\Delta fm)/(1-\Delta fm))Fa0 \quad (71)$$

Alternatively, the following expression is established.

$$Fard<Fb0<((1-\Delta fm)/(1+\Delta fm))Fa0 \quad (72)$$

When viewed on the vertical axis (that is, the frequency axis) of FIG. 21, the improved region is regions indicated by both of arrows E11 and E21, and when viewed on the horizontal axis in FIG. 21 (that is, the length (Lm+S) axis), the improved region is a region marked as improved regions. The regions indicated by both of the arrows E11 and E21 on the vertical axis are a range slightly above the resonant frequency Fa0 in the resonance mode A, that is, a range from ((1+Δfm)/(1−Δfm))Fa0 to the high anti-resonant frequency Faru in the resonance mode A, and a range slightly below the resonant frequency Fa0 in the resonance mode A, that is, a range from ((1−Δfm)/(1+Δfm))Fa0 to the low antiresonant frequency Fbrd in the resonance mode A.

The improved region on the horizontal axis includes a region in which the resonant frequency Fb0 (that is, the curve D2) in the resonance mode B is slightly above the resonant frequency Fa0 in the resonance mode A, that is, a region below a cross point with ((1+Δfm)/(1−Δfm))Fa0 (that is, curve D61), and a region in which the resonant frequency Fb0 in the resonance mode B (that is, the curve D2) is slightly below the resonant frequency Fa0 in the resonance mode A, that is, a region above a cross point with ((1−Δfm)/1+Δfm))Fa0 (that is, curve D51).

The length (Lm+S) is determined with the use of Expressions (3), (4), (5), and (6) so that the resonant frequency Fb0 in the resonance mode B falls within the improved region, thereby being capable of improving the return loss.

In other words, the length (Lm+S) is determined with the use of Expressions (3), (4), (5), and (6) so that the resonant frequency Fb0 in the resonance mode B falls within the range slightly above the resonant frequency Fa0 in the resonance mode A, in other words, a range from the ((1+Δfm)/(1−Δfm))Fa0 to the high antiresonant frequency Faru in the resonance mode A, or a range slightly below the resonant frequency Fa0 in the resonance mode A, in other words, a range from ((1−Δfm)/(1+Δfm))Fa0 to the low resonant frequency Fard in the resonance mode A, thereby being capable of improving the return loss.

In FIG. 21, symbols ○ indicate the resonant frequency Fa0 in the resonance mode A and the resonant frequency Fb0 in the resonance mode B of the antennas whose return loss is improved as a result of the simulation, that is, the respective antennas whose length (Lm+S) is 11.2, 16.2, 26.2, 30.2, 35.2 mm.

In FIG. 21, the symbol x indicates that the resonant frequency Fa0 in the resonance mode A and the resonant frequency Fb0 in the resonance mode B of the antennas whose return loss is deteriorated as a result of the simulation, in other words, the antennas whose length (Lm+S) is 21.2 mm.

It can be found from FIG. 21 that Fa0 and Fb0 (that is, the positions of the symbol ○) of the improved region determined by the calculation formula and the improved region determined from the simulation result well coincide with each other. In addition, it can be found from FIG. 21 that Fa0 and Fb0 (that is, the position of the symbol x) of the deteriorated region determined by the calculation formula and the deteriorated region determined from the simulation result well coincide with each other. That is, it is proved that the calculation result by the calculation formula is correct.

The configurations of the second embodiment other than those described above are the same as those in the first embodiment. Accordingly, the same advantages as those in the first embodiment can be obtained even in the second embodiment.

Third Embodiment

FIGS. 22A to 22C, and 23 illustrate a third embodiment of the present disclosure. It should be noted that the same reference numerals are given to the same configurations as those in the first embodiment. In the third embodiment, a first element 72 includes a first L-shaped portion 26 and a wide conductor 73. The wide conductor 73 is configured by, for example, a ground of a high frequency circuit. A connection point between a tip portion of a short side portion 29 of the first L-shaped portion 26 and the wide conductor 73 serves as an input terminal 74.

The second element 75 is disposed so as to face the first L-shaped portion 26 of the first element 72 and has an L-shaped portion 76 having substantially the same shape as that of the first L-shaped portion 26. The L-shaped portion 76 has a long side portion 28 and a short side portion 29, and inner protruding portions 39, that is, an inductance shape 40 is disposed in the long side portion 28. A tip portion of the short side portion 29 of the L-shaped portion 76 serves as an input terminal 77. In this configuration, the input terminal 74 and the input terminal 77 are feeding points. The small antenna according to the present embodiment is configured as a small monopole antenna.

The substrate 22 is configured by, for example, a printed wiring board made of a dielectric material. A high frequency circuit 78 is provided on a surface of the substrate 22 on which the second element 75 is disposed. In addition, a short-circuit element 70 that short-circuits the first element 72 and the second element 75 includes a through hole 71 (refer to FIG. 22B) which connects the tip portion of the L-shaped portion 26 of the first element 72 to the tip portion of the long side portion 28 of the L-shaped portion 76 in the second element 75.

Figure 24:
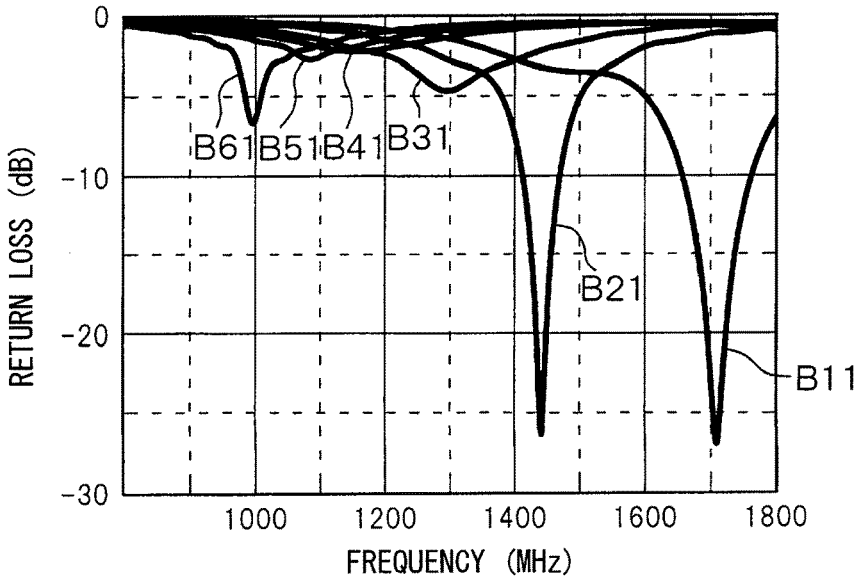
FIG. 24 is a characteristic diagram illustrating a relationship between a return loss and the frequency.

In the present embodiment, a length S of the short side portion 29 in the first element 72 is set to, for example, 6.2 mm, and a length Lm of the portion except for the inductance shape 34 in the longitudinal length of the long side portion 28 is set to, for example, 5, 10, 15, 20, 24, or 29 mm. As a result, the length (Lm+S) is set to 11.2, 16.2, 21.2, 26.2, 30.2, or 35.2 mm. All of the line widths $\phi i$ are set to, for example, 0.2 mm, the height Hi of the inner protruding portion 33 is set to, for example, 6 mm, the width Wi of the base portion is set to, for example, 0.6 mm, the thickness t of the dielectric substrate 22 is set to 0.8 mm. Further, a relative dielectric constant $\varepsilon$ of the substrate 22 is set to 4.9, and a dielectric loss tan $\delta$ of the dielectric is set to 0.025. As a result of simulation under such setting conditions, as illustrated in FIG. 24, the antenna whose return loss is improved has the length (Lm+S) of 11.2 and 16.2 mm. On the contrary, as illustrated in FIG. 24, the antenna whose return loss is deteriorated has the length (Lm+S) of 21.1, 26.2, 30.2, and 35.2 mm.

FIG. 24 illustrates the results obtained by simulating a change in the return loss when the length Lm is varied to, for example, 5, 10, 15, 20, 24, and 29 mm. In FIG. 24, the horizontal axis represents the frequency and the vertical axis represents the return loss. In FIG. 24, a curve B11 shows a change in return loss when the length Lm is 5 mm. A curve B21 shows a change in return loss when the length Lm is 10 mm. A curve B31 shows a change in return loss when the length Lm is 15 mm. A curve B41 shows a change in return loss when the length Lm is 20 mm. A curve B51 shows a change in return loss when the length Lm is 24 mm. A curve B61 shows a change in return loss when the length Lm is 29 mm.

Figure 25:
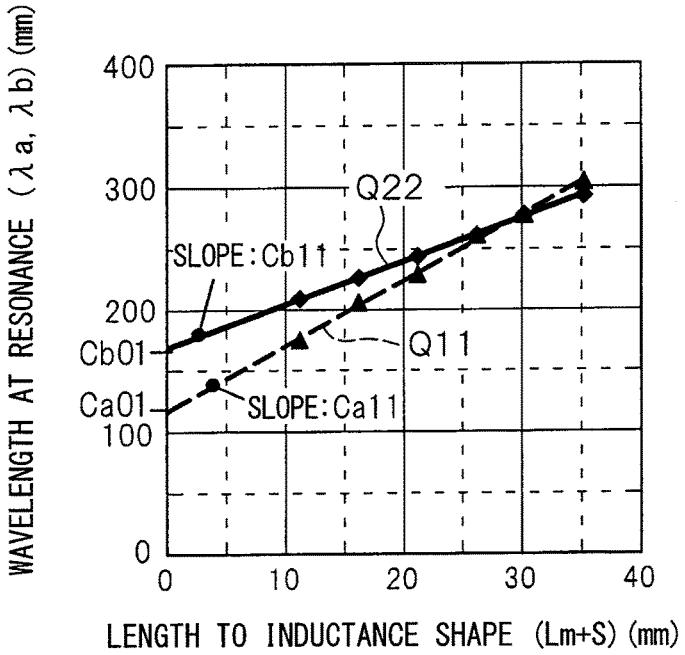
FIG. 25 is a characteristic diagram illustrating a relationship between a resonant wavelength and a length (Lm+S)

FIG. 25 is a diagram illustrating the results obtained by simulating changes in the wavelengths $\lambda a$ and $\lambda b$ in the resonance modes A and B when the length (Lm+S) of the first element 3 and the second element 4 is changed. In FIG. 25, the horizontal axis represents the length (Lm+S), and the vertical axis represents the wavelength at the resonance. In FIG. 25, a straight line Q11 indicates a change in the wavelength $\lambda a$ in the resonance mode A, and a straight line Q21 indicates a change in the wavelength $\lambda b$ in the resonance mode B. In addition, the following relational expression is established between the two resonant frequencies Fa0, Fb0 and the two wavelengths λa, λb at the resonance.

$$\lambda a = C/Fa0 \quad (1)$$

$$\lambda b = C/Fb0 \quad (2)$$

where C is the speed of light.

Further, when expressing the two straight lines Q11 and Q21 illustrated in FIG. 25 by the equation, the following two expressions are obtained.

$$\lambda a = Ca11*(Lm+S)+Ca01 \quad (3\text{-}1)$$

$$\lambda b = Cb11*(Lm+S)+Cb01 \quad (4\text{-}1)$$

$$Fa0 = C/\lambda a \quad (5)$$

$$Fb0 = C/\lambda b \quad (6)$$

where Ca11 is a slope (proportionality constant of λa) of the straight line Q11, Ca0 is an intercept (constant of λa) of the straight line Q11, Cb11 is a slope (proportionality constant of λb) of the straight line Q21, and Cb01 is an intercept (constant of λb) of the straight line Q21.

It is found that the resonant frequencies Fa0 and Fb0 of the two resonance modes A and B can be obtained based on the length (Lm+S) of the first element 73 and the second element 75 through Expressions (1), (2), (3-1) and (4-1) by calculation formulas.

Figure 23:
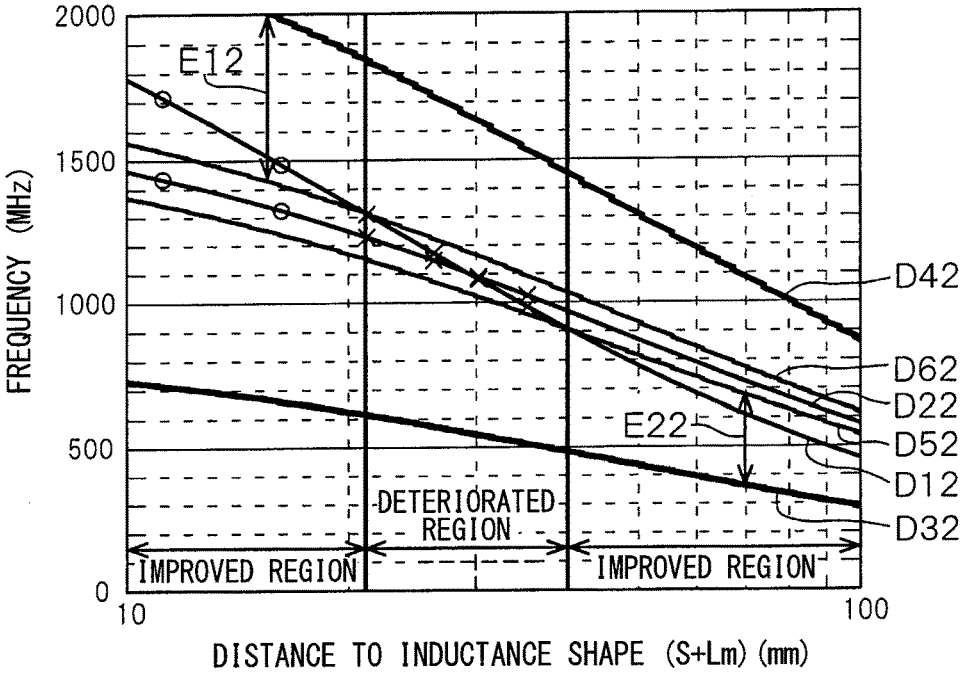
FIG. 23 is a characteristic diagram illustrating a relationship between a frequency and a length (Lm+S)

Now, FIG. 23 is a graph showing a relationship between the length (Lm+S) and the frequency. Referring to FIG. 23, an improved region and a deteriorated region of the return loss will be described. In FIG. 23, a curve D12 shows a resonant frequency Fa0 in a resonance mode A and a curve D22 shows a resonant frequency Fb0 in a resonance mode B. Those Fa0 and Fb0 are obtained according to Expressions (3-1), (4-1), (5), (6) and the length (Lm+S). The values obtained in FIG. 25 are used as a proportionality constant Ca11 of λa, a constant Ca01 of λa, a proportionality constant Cb11 of λb, and a constant Cb01 of λb. In addition, a resonance mode in which current directions flowing through the first element 72 and the second element 75 are the same direction is the resonance mode A, and a resonance mode in which the current directions are reverse is the resonance mode B.

Further, when a placement position of the short-circuit element 70 connecting the first element 72 and the second element 75 is changed, the values of the proportionality constant Cb11 of λb and the constant Cb01 of λb change.

In FIG. 23, a curve D32 shows a low antiresonant frequency Fbrd in the resonance mode B, and a curve D42 shows a high anti-resonant frequency Fbru in the resonance mode B. Those Fbrd and Fbru are derived from Expressions (8a) and (8b).

In FIG. 23, a curve D52 shows Fb0 ((1−Δm)/(1+Δfm)) and a curve D62 shows Fb0((1+Δfm)/(1−Δfm)). The Fb0 ((1−Δfm)/(1+Δfm)) and Fb0((1+Δfm)/(1−Δfm)) are derived from Expressions (65) and (66), which are a boundary to separate the deteriorated region and the improved region from each other. The curves D52 and D62 are located slightly below and above the curve D22 of Fb0. Incidentally, Δfm is obtained through Expression (59) with the use of the constant obtained in FIG. 16.

The improved region of the return loss is an area that satisfies Expressions (65) and (66), and is expressed by the following expression.

$$Fbru > Fa0 > ((1+\Delta fm)/(1-\Delta fm))Fb0 \quad (69)$$

Alternatively, the following expression is established.

$$Fbrd < Fa0 < ((1-\Delta fm)/(1+\Delta fm))Fb0 \quad (70)$$

When viewed on the vertical axis (that is, the frequency axis) of FIG. 23, the improved region is regions indicated by both of arrows E12 and E22, and when viewed on the horizontal axis in FIG. 23 (that is, the length (Lm+S) axis), the improved region is a region marked as improved regions. The regions indicated by both of the arrows E12 and E22 on the vertical axis are a range slightly above the resonant frequency Fb0 in the resonance mode B, that is, a range from ((1+Δfm)/(1−Δfm))Fb0 to the high anti-resonant frequency Fbru in the resonance mode B, and a range slightly below the resonant frequency Fb0 in the resonance mode B, that is, a range from ((1−Δfm)/(1+Δfm))Fb0 to the low antiresonant frequency Fbrd in the resonance mode B.

The improved region on the horizontal axis includes a region in which the resonant frequency Fa0 (that is, the curve D12) in the resonance mode A is slightly above the resonant frequency Fb0 in the resonance mode B, that is, a region below a cross point with ((1+Δfm)/(1−Δfm))Fb0 (that is, curve D62), and a region in which the resonant frequency Fa0 in the resonance mode A (that is, the curve D12) is slightly below the resonant frequency Fb0 in the resonance mode B, that is, a region above a cross point with ((1−Δfm)/1+Δfm))Fb0 (that is, curve D52).

The length (Lm+S) is determined with the use of Expressions (3-1), (4-1), (5), and (6) so that the resonant frequency Fa0 in the resonance mode A falls within the improved region, thereby being capable of improving the return loss.

In other words, the length (Lm+S) is determined with the use of Expressions (3-1), (4-1), (5), and (6) so that the resonant frequency Fa0 in the resonance mode A falls within the range slightly above the resonant frequency Fb0 in the resonance mode B, in other words, a range from the ((1+Δfm)/(1−Δfm))Fb0 to the high antiresonant frequency Fbru in the resonance mode B, or a range slightly below the resonant frequency Fb0 in the resonance mode B, in other words, a range from ((1−Δfm)/(1+Δfm))Fb0 to the low resonant frequency Fbrd in the resonance mode B, thereby being capable of improving the return loss.

In FIG. 23, symbols ○ indicate the resonant frequency Fa0 in the resonance mode A and the resonant frequency Fb0 in the resonance mode B of the antennas whose return loss is improved as a result of the simulation, that is, the respective antennas whose length (Lm+S) is 11.2 and 16.2 mm.

In FIG. 23, the symbol x indicates that the resonant frequency Fa0 in the resonance mode A and the resonant frequency Fb0 in the resonance mode B of the antennas whose return loss is deteriorated as a result of the simulation, in other words, the antennas whose length (Lm+S) is 21.2, 26.2, 30.2, and 35.2 mm.

It can be found from FIG. 23 that Fa0 and Fb0 (that is, the positions of the symbol ○) of the improved region determined by the calculation formula and the improved region determined from the simulation result well coincide with each other. In addition, it can be found from FIG. 23 that Fa0 and Fb0 (that is, the position of the symbol x) of the deteriorated region determined by the calculation formula and the deteriorated region determined from the simulation result well coincide with each other. That is, it is proved that the calculation result by the calculation formula is correct.

The configurations of the third embodiment other than those described above are the same as those in the first embodiment. Accordingly, the same advantages as those in the first embodiment can be obtained even in the third embodiment.

Fourth Embodiment

Figure 26:
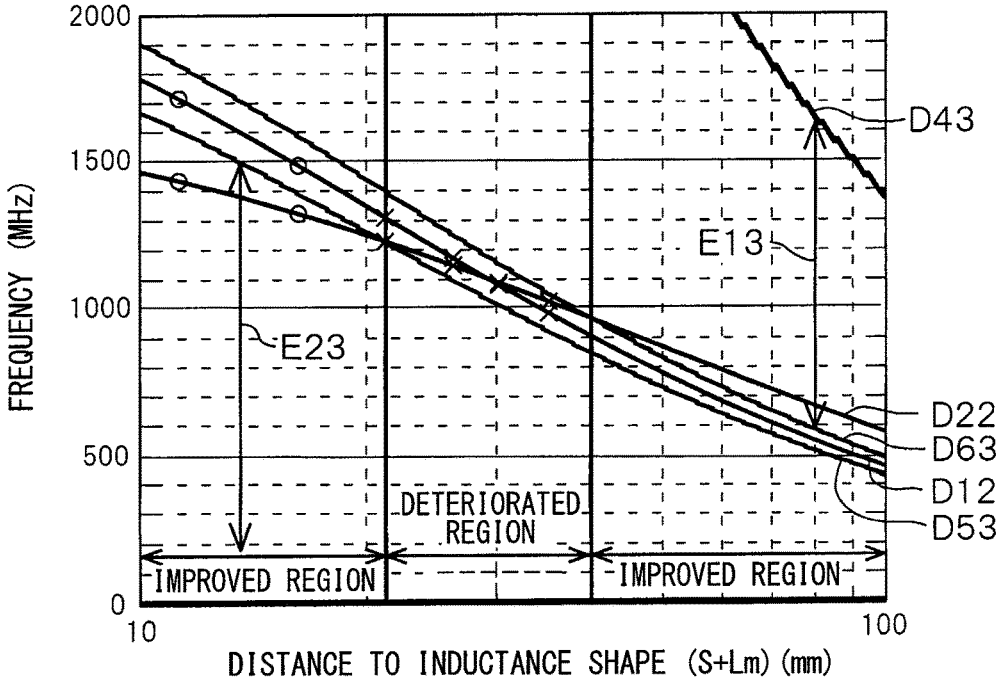
FIG. 26 is a characteristic diagram illustrating a relationship between a frequency and a length (Lm+S) according to a fourth embodiment of the present disclosure.
Figure 27A:
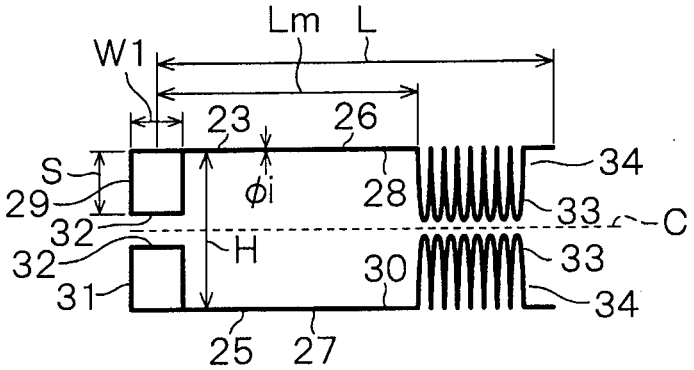
Figure 27B:
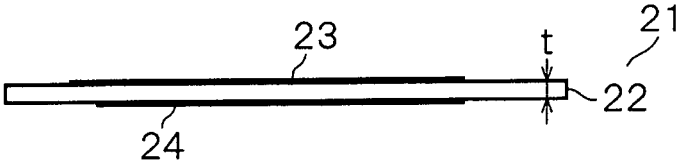
Figure 27C:
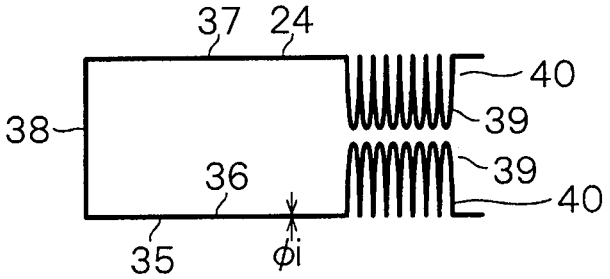
Figure 27D:
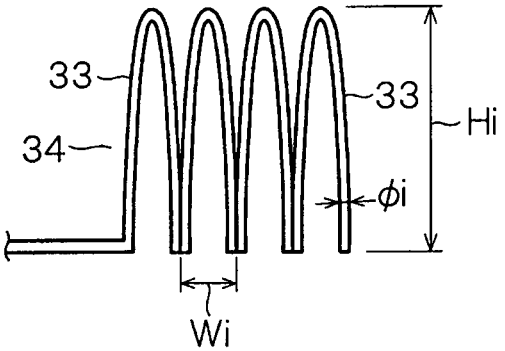

FIG. 26 illustrates a fourth embodiment of the present disclosure. It should be noted that the same reference numerals are given to the same configurations as those in the third embodiment. The specific configuration of a small monopole antenna according to the fourth embodiment is the same as that of the third embodiment. In the third embodiment, in the determination of the improved region and the deteriorated region of the return loss, the calculation is made based on the low antiresonant frequency Fbrd and the high antiresonant frequency Fbru in the resonance mode B. On the other hand, in the fourth embodiment, the calculation is made based on the low antiresonant frequency Fard and the high antiresonant frequency Faru in the resonance mode A. Hereinafter, the fourth embodiment will be described in more detail.

FIG. 26 is a graph showing a relationship between the length (Lm+S) and the frequency. Referring to FIG. 26, a calculation method for determining the improved region and the deteriorated region of the return loss will be described. In FIG. 26, a curve D12 shows a resonant frequency Fa0 in a resonance mode A and a curve D22 shows a resonant frequency Fb0 in a resonance mode B. Those Fa0 and Fb0 are obtained according to Expressions (3-1), (4-1), (5), (6) and the length (Lm+S). The values obtained in FIG. 25 are used as a proportionality constant Ca11 of λa, a constant Ca01 of λa, a proportionality constant Cb11 of λb, and a constant Cb01 of λb. Further, when a placement position of the short-circuit element 25 connecting the first element 72 and the second element 75 is changed, the values of the proportionality constant Cb11 of λb and the constant Cb01 of λb change.

In FIG. 26, a curve D43 shows the high antiresonant frequency Faru in the resonance mode A. The low antiresonant frequency Fard in the resonance mode A is not shown in FIG. 26 but falls outside a region shown in FIG. 26. Those Fard and Faru are derived from Expressions (8a) and (8b).

In FIG. 26, a curve D53 shows Fa0 ((1−Δm)/(1+Δfm)) and a curve D63 shows Fa0((1+Δfm)/(1−Δfm)). The Fa0 ((1−Δfm)/(1+Δfm)) and Fa0((1+Δfm)/(1−Δfm)) are derived from Expressions (67) and (68), which are a boundary to separate the deteriorated region and the improved region from each other. The curves D53 and D63 are located slightly below and above the curve D12 of Fa0. Incidentally, Δfm is obtained through Expression (59) with the use of the constant obtained in FIG. 16.

The improved region of the return loss is an area that satisfies Expressions (67) and (68), and is expressed by the following expression.

$$Faru > Fb0 > ((1+\Delta fm)/(1-\Delta fm))Fa0 \quad (71)$$

Alternatively, the following expression is established.

$$Fard < Fb0 < ((1-\Delta fm)/(1+\Delta fm))Fa0 \quad (72)$$

When viewed on the vertical axis (that is, the frequency axis) of FIG. 26, the improved region is regions indicated by both of arrows E13 and E23, and when viewed on the horizontal axis in FIG. 26 (that is, the length (Lm+S) axis), the improved region is a region marked as improved regions. The regions indicated by both of the arrows E13 and E23 on the vertical axis are a range slightly above the resonant frequency Fa0 in the resonance mode A, that is, a range from ((1+Δfm)/(1−Δfm))Fa0 to the high anti-resonant frequency Faru in the resonance mode A, and a range slightly below the resonant frequency Fa0 in the resonance mode A, that is, a range from ((1−Δfm)/(1+Δfm))Fa0 to the low antiresonant frequency Fbrd in the resonance mode A.

The improved region on the horizontal axis includes a region in which the resonant frequency Fb0 (that is, the curve D22) in the resonance mode B is slightly above the resonant frequency Fa0 in the resonance mode A, that is, a region below a cross point with ((1+Δfm)/(1−Δfm))Fa0 (that is, curve D63), and a region in which the resonant frequency Fb0 in the resonance mode B (that is, the curve D22) is slightly below the resonant frequency Fa0 in the resonance mode A, that is, a region above a cross point with ((1−Δfm)/1+Δfm))Fa0 (that is, curve D53).

The length (Lm+S) is determined with the use of Expressions (3-1), (4-1), (5), and (6) so that the resonant frequency Fb0 in the resonance mode B falls within the improved region, thereby being capable of improving the return loss.

In other words, the length (Lm+S) is determined with the use of Expressions (3-1), (4-1), (5), and (6) so that the resonant frequency Fb0 in the resonance mode B falls within the range slightly above the resonant frequency Fa0 in the resonance mode A, in other words, a range from the ((1+Δfm)/(1−Δfm))Fa0 to the high antiresonant frequency Faru in the resonance mode A, or a range slightly below the resonant frequency Fa0 in the resonance mode A, in other words, a range from ((1−Δfm)/(1+Δfm))Fa0 to the low resonant frequency Fard in the resonance mode A, thereby being capable of improving the return loss.

In FIG. 26, symbols ○ indicate the resonant frequency Fa0 in the resonance mode A and the resonant frequency Fb0 in the resonance mode B of the antennas whose return loss is improved as a result of the simulation, that is, the respective antennas whose length (Lm+S) is 11.2 and 16.2 mm.

In FIG. 26, the symbol x indicates that the resonant frequency Fa0 in the resonance mode A and the resonant frequency Fb0 in the resonance mode B of the antennas whose return loss is deteriorated as a result of the simulation, in other words, the antennas whose length (Lm+S) is 21.2, 26.2, 30.2, and 35.2 mm.

It can be found from FIG. 26 that Fa0 and Fb0 (that is, the positions of the symbol ○) of the improved region determined by the calculation formula and the improved region determined from the simulation result well coincide with each other. In addition, it can be found from FIG. 26 that Fa0 and Fb0 (that is, the position of the symbol x) of the deteriorated region determined by the calculation formula and the deteriorated region determined from the simulation result well coincide with each other. That is, it is proved that the calculation result by the calculation formula is correct.

The configurations of the fourth embodiment other than those described above are the same as those in the third embodiment. Accordingly, the same advantages as those in the third embodiment can be obtained even in the fourth embodiment.

Fifth Embodiment

FIGS. 27A to 30 illustrate a fifth embodiment of the present disclosure. It should be noted that the same reference numerals are given to the same configurations as those in the first embodiment. In the fifth embodiment, the short-circuit element 70 is not provided (that is, the first element 23 and the second element 24 are configured to be insulated from each other). Furthermore, a part of a line of the first element 23, for example, a line width W1 of short side portions 29 and 31 of the L-shaped portions 26 and 27 is configured to be larger than the line widths of the other portions.

In the antenna having the configuration illustrated in FIG. 27A to FIG. 27D, with the configuration so as not to provide the short-circuit element 70, Cb1 (proportionality constant of λb) and Cb0 (constant of λb) change, and a relationship between the resonant frequency Fa0 in the resonance mode A and the resonant frequency Fb0 in the resonance mode B reaches the improved region of the return loss that satisfies Expressions (69) and (72) under the condition in which a length (Lm+S) up to each inductance shape 34 is, for example, 21.2 mm.

In the antenna having the configuration shown in FIGS. 27A to 27D, the line width W1 of the short side portions 29 and 31 is set to 20 mm, for example. Since the inductance component increases more as the line width of the inductance shape 34 decreases more, the line width of the portion where the inductance shapes 34 and 40 are formed is set to an allowable minimum line width (that is, a lower limit value of the line width is, for example, 0.2 mm), which is desirable from the viewpoint of downsizing.

In the antenna configured as illustrated in FIGS. 27A to 27D, the length L in the longitudinal direction of the long side portions 28 and 30 is set to, for example, 20.8 mm, the length Lm of the portion excluding the inductance shape 34 in the long side portions 28 and 30 is set to, for example, 15.1 mm, and the length (Lm+S) is set to, for example, 21.2 mm. The element height H is set to, for example, 12.4 mm. The line width ϕi of the line other than the short side portions 29 and 31 is set to 0.2 mm, the height Hi of the inner protruding portion 33 is set to, for example, 6 mm, the width Wi of the base portion is set to, for example, 0.6 mm, and the thickness t of the dielectric substrate 22 is set to 0.8 mm.

Further, from FIG. 13, the constants Ra, Δa, Rb, and Δb in the case where the number of semiellipes Ni of the inductance shapes 34 and 40 is eight, and the short-circuit element is present are obtained as follows.

$$Ra=0.33$$

$$\Delta a=0.029$$

$$Rb=0.38$$

$$\Delta b=0.045$$

When substituting those constants into equation (59), the following expression is obtained.

$$\Delta fm=0.013 \tag{73}$$

In the fifth embodiment, although there is no short-circuit element, the frequency ratio Δfm at the deterioration range boundary does not change with one digit larger, a value obtained by multiplying a value of the above Expression (73) by 10 is set as Δfm with a margin, and it is checked whether the set value is correct, or not.

$$\Delta fm=0.013*10=0.13 \tag{74}$$

Figure 28:
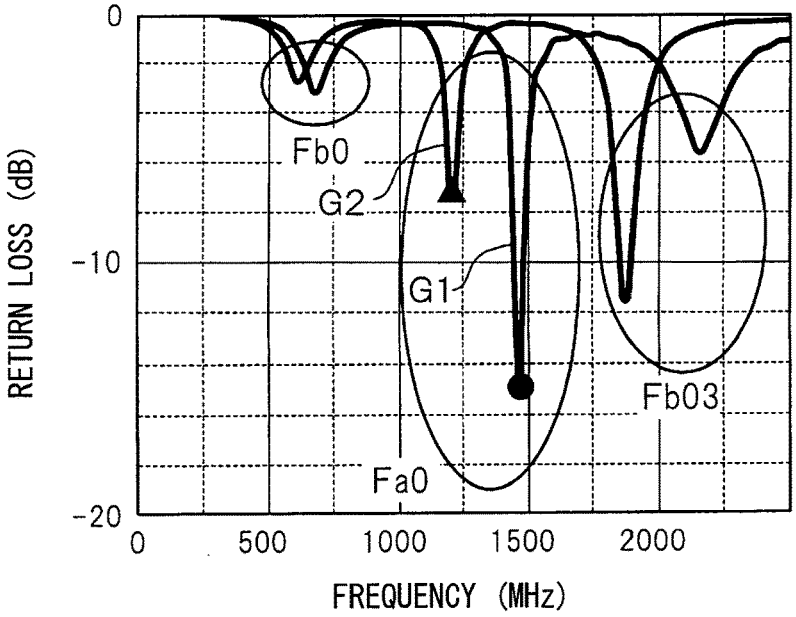
FIG. 28 is a characteristic diagram illustrating a relationship between a return loss and the frequency.

FIG. 28 illustrates the return loss obtained as a result of simulation under the condition that the relative dielectric constant ε of the dielectric is set to 4.9 and the dielectric loss tan δ of the dielectric is set to 0.025 in the antenna configured as illustrated in FIGS. 27A to 27D. In FIG. 28, the horizontal axis represents the frequency and the vertical axis represents the return loss. In FIG. 28, a line G1 shows the return loss when the line width W1 is set to 20 mm. A broken line G2 shows a return loss when the line width W1 is set to 0.2 mm. Fb03 is the resonant frequency of the harmonic which is three times the resonance mode B.

It is found from FIG. 28 that the resonant frequency Fa0 in the resonance mode A and the resonant frequency Fb0 in the resonance mode B are separated from each other, and furthermore, those resonant frequencies Fa0 and Fb0 have the relationship of the improved region of the return loss that satisfies Expressions (69) and (72). Whether the resonance mode is A or B can be determined based on the analysis result of a current distribution by simulation.

It is understood from FIG. 28 that the return loss of the resonant frequency Fa0 in the resonance mode A can be improved to −15 dB. The reason for the above improvement is that the two resonant frequencies Fa0 and Fb03 are separated from each other, and the resonant frequencies Fa0 and Fb03 obtain the relationship of the improved region of the return loss satisfying Expressions (70) and (71), and then the line width W1 of parts (for example, short side portions 29 and 31) of the first element 23 is set to be larger than the line width ϕi (for example, 0.2 mm) of the inductance shape or the like by, for example, 20 mm.

Next, it is confirmed that Fa0 and Fb03 satisfy Expressions (70) and (71).

The respective values of the resonant frequency Fa0 in the resonance mode A and the resonant frequency Fb03 of the harmonic which is three times the resonance mode B are obtained from a graph G1 of FIG. 28 (that is, W1=20 mm), and those values are substituted into Expressions (7b) and (9c) to obtain the following expressions.

$$Fa0=1470 \text{ MHz}$$

$$Fb03=2157 \text{ MHz}$$

$$Faru=2Fa0=2940 \text{ MHz}$$

$$Fbrd=2Fb03/3=1438 \text{ MHz}$$

Expressions (70) and (71) are confirmed with the use of the value of Expression (74), and it is understood that Expressions (70) and (71) are satisfied as follows.

$$Fbrd=1438<1470=Fa0<1661=((1-\Delta fm)/(1+\Delta fm))\,Fb03 \tag{70}$$

$$Faru=2940>2157=Fb03>1909=((1+\Delta fm)/(1-\Delta fm))\,Fa0 \tag{71}$$

Figure 29:
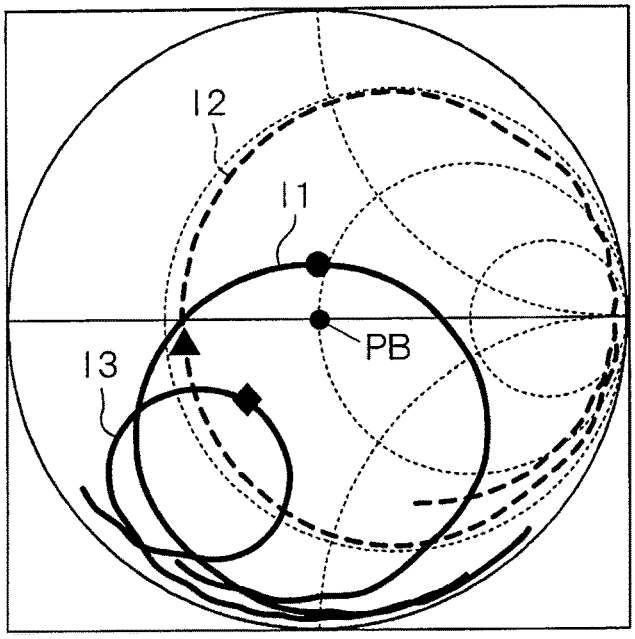
FIG. 29 is a diagram illustrating an impedance chart.
Figure 30:
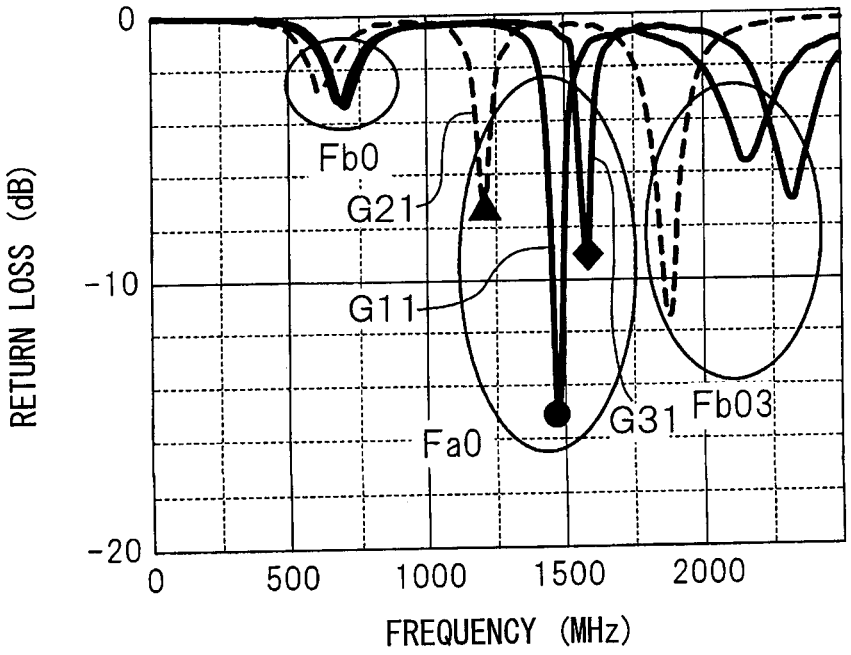
FIG. 30 is a characteristic diagram illustrating a relationship between the return loss and the frequency.

Next, FIGS. 29 and 30 illustrate changes in the impedance chart and the return loss for the antenna having the configuration in which the line width W1 is further widened to, for example, 29 mm, as a simulation result.

In FIG. 29, a solid line I1 shows an impedance chart with a configuration of W1=20 mm. A broken line 12 shows an impedance chart with a configuration of W1=0.2 mm. A solid line 13 shows an impedance chart with a configuration of W1=29 mm. From FIG. 29, when W1 is widened from 0.2 mm to 20 mm, a circle of the impedance of the resonant frequency Fa0 becomes small, and the impedance of the resonant frequency Fa0 approaches a point PB of a standard impedance (for example, 50 SI). However, if W1 is further widened to 29 mm, the circle of the impedance of the resonant frequency Fa0 is further reduced and the impedance of the resonant frequency Fa0 moves away from the point PB of the standard impedance.

In FIG. 30, the horizontal axis represents the frequency and the vertical axis represents the return loss. In FIG. 30, a solid line G11 shows the return loss when the line width W1 is set to 20 mm. A broken line G21 shows a return loss when the line width W1 is set to 0.2 mm. A solid line G31 shows the return loss when the line width W1 is set to 29 mm. It can be seen from FIG. 30 that if the line width W1 is increased from 0.2 mm to 20 mm, the return loss can be improved. However, if the line width W 1 is set to be too wide, for example, 29 mm, it is understood that the return loss is deteriorated.

In other words, the line width W1 of at least a part of the line other than the inductive shape 34 in the first element 23 is increased to be equal to or larger than the line width of the inductance shape 34, thereby being capable of improving the return loss of the resonant frequency Fa0. However, it can be also found that a spreading width of the line width W1 has an optimum value (for example 20 mm). Incidentally, if the line width W1 is further widened, for example, widened over 29 mm, the lines of the line width W1 (that is, the short side portions 29 and 31) and the semielliptical line of the inductance shape 34 overlap with each other, which does not function as the antenna. Therefore, as the line width W1 of a part of the first element 23, there is an optimum value from the viewpoint of improving the return loss performance, and there is also a physical upper limit value that the line of the first element 23 overlaps another line.

The configurations of the fifth embodiment other than those described above are the same as those in the first embodiment. Accordingly, the same advantages as those in the first embodiment can be obtained even in the fifth embodiment.

Sixth Embodiment

FIGS. 31A to 33D illustrate a sixth embodiment of the present disclosure. It should be noted that the same reference numerals are given to the same configurations as those in the first embodiment. In the sixth embodiment, the inductance shapes 34 and 40 are replaced with an inductance shape having a rectangular spiral structure for a part of the line. In the sixth embodiment, the short-circuit element 70 is not provided (that is, the first element 23 and the second element 24 are configured to be insulated from each other). Hereinafter, the sixth embodiment will be described in more detail.

Figure 31A:
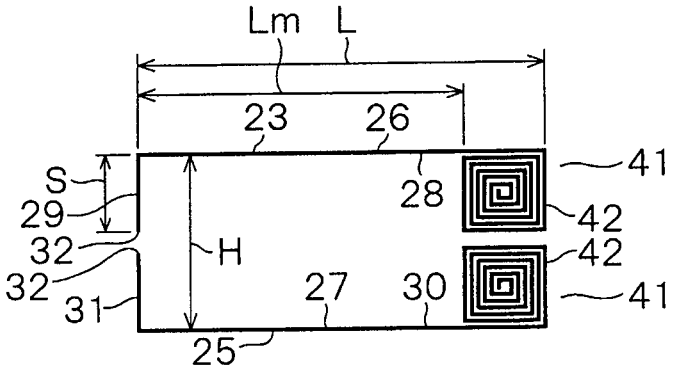
Figure 31B:
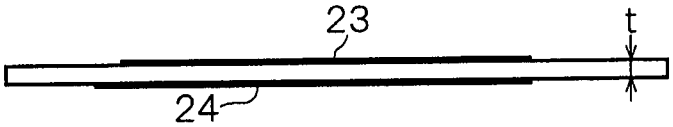

As illustrated in FIG. 31A, the first element 23 includes a power feeding side parallel portion 25 formed of a conductor pattern, and the power feeding side parallel portion 25 includes a first L-shaped portion 26 and a second L-shaped portion 27. The first L-shaped portion 26 includes a long side portion 28 and a short side portion 29. The second L-shaped portion 27 also has the same structure as that of the first L-shaped part 26, and has a long side portion 30 and a short side portion 31. Tip portions of the short side portions 29 and 31 serve as feeding points 32.

In the first L-shaped portion 26 and the second L-shaped portion 27, inductance shapes 41 and 41 are formed at the tip portions of the long side portions 28 and 30 which are parts of the first L-shaped portion 26 and the second L-shaped portion 27. Each of the inductance shapes 41 protrudes inward so as to be surrounded by the first L-shaped portion 26 and the second L-shaped portion 27 in a plane of the substrate 22. As illustrated in FIG. 31D, each inductance shape 41 extends the linear conductor pattern of the long side portions 28 and 30 inwardly and forms a rectangular spiral structure 42 with an extended portion.

In the sixth embodiment, as illustrated in FIG. 31D, a line width ϕi of the conductor pattern of the rectangular helical structure 42 is set to, for example, 0.2 mm, the number of turns Nr of the rectangular spiral structure 42 is set to, for example, six times, a gap Gr of the rectangular spiral structure 42 is set to, for example, 0.2 mm, a width Wr of the rectangular spiral structure 42 is, for example, 4.9 mm, and a height Hr of the rectangular spiral structure 42 is, for example, 4.9 mm.

Further, as illustrated in FIG. 31A, it is assumed that a longitudinal length (that is, element length) of the long side portions 28 and 30 of the first L-shaped portion 26 and the second L-shaped portion 27 is L (for example, 20 mm), a length of portions excluding the inductance shape 41 in the longitudinal length of the long side portions 28 and 30 is Lm (for example, 15 mm), and an opposed distance (element height) of the long side portions 28 and 30 is H (for example, 12.4 mm). It is assumed that the line width of the long side portions 28 and 30 is the same as the line width of the inductance shape 41, and set as ϕi (for example, 0.2 mm). It is assumed that the length of the short side portions 29 and 31 is S, the line width of the short side portions 29 and 31 is the same as the line width of the inductance shape 41, and set as ϕi (for example, 0.2 mm).

Figure 31C:
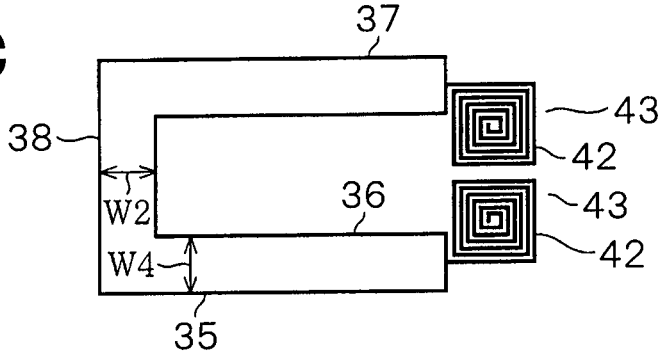
Figure 31D:
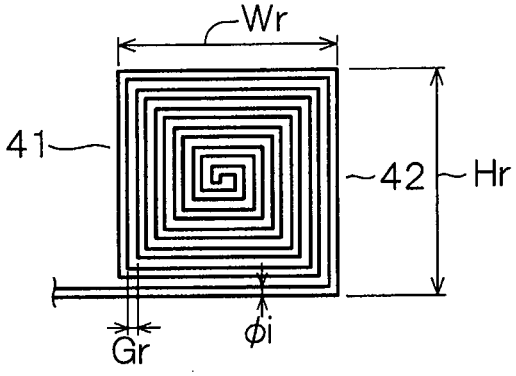

As illustrated in FIG. 31C, the second element 24 includes a non-power feeding side parallel portion 35 formed of a conductor pattern, and the non-power feeding side parallel portion 35 includes a pair of opposite side portions 36, 37, and a coupling side portion 38. The opposite side portions 36 and 37 are in parallel to each other and have the same length and width with each other. The length of the opposite side portions 36 and 37 is set as L (that is, element length) described above. The line width of the opposite side portions 36 and 37 is set as W4 (for example, 5 mm), and is wider than the line width ϕi (for example, 0.2 mm) of the first L-shaped portion 26 and the second L-shaped portion 27. The length (that is, element height) of the coupling side portion 38 is set as H, and the line width is set as W2 (for example, 5 mm), and set to be wider than the line width ϕi of the first L-shaped portion 26 and the second L-shaped portion 27.

Inductance shapes 43 and 43 are formed at the tip portions of the opposite side portions 36 and 37. The inductance shapes 43 protrude inward so as to be surrounded by the opposite side portions 36, 37 and the coupling side portion 38 in the plane of the substrate 22. As illustrated in FIGS. 31C and 31D, each of the inductance shapes 43 extends the conductor pattern of the line width ϕi from a center in the width direction of the opposite side portions 36 and 37 along the opposite side portions 36 and 37. The rectangular spiral structure 42 is formed by the extended portion. The shape of the rectangular spiral structure 42 of the inductance shape 43 and the size of each portion are the same as the shape of the rectangular spiral structure 42 of the inductance shape 41 and the size of each portion.

In the sixth embodiment, the length (Lm+S) up to the inductance shape is determined such that the relationship between the two resonant frequencies Fa0 and Fb0 fall within the return loss improved region that satisfies the expressions (69) and (72). The lines of the first element 23 and the second element 24 are bent so that element height H can be lowered.

Since the inductance component increases more as the line width of the inductance shape 43 decreases more, it is desirable from the viewpoint of downsizing that the line width of the inductance shape 43 is set to the allowable minimum line width (that is, the lower limit value of the line width).

In the sixth embodiment, although there is no short-circuit element, and the inductance shapes 41 and 43 are of the rectangular spiral structures 42, the frequency ratio Δfm at the deterioration range boundary does not change with one digit larger, a value of Expression (74) obtained by multiplying a value of Expression (73) by 10 is used as Δfm with a margin.

Figure 32:
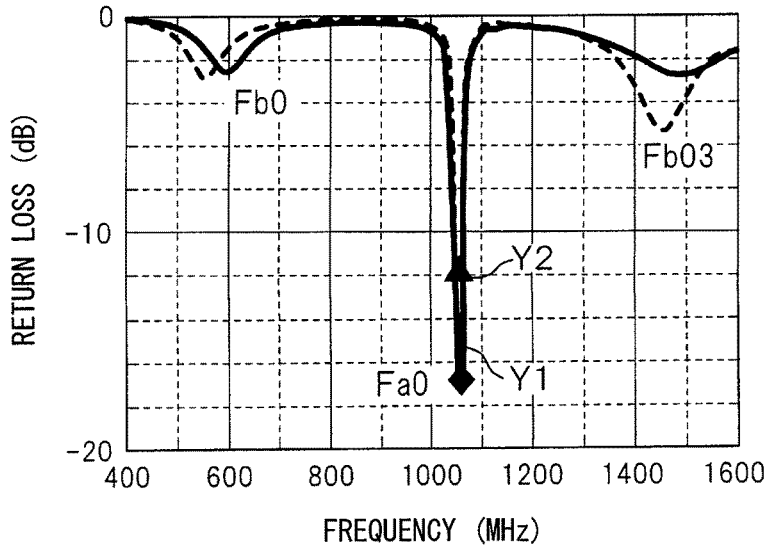
FIG. 32 is a characteristic diagram illustrating a relationship between the return loss and the frequency.

In FIG. 32, a solid line Y1 represents the return loss obtained by simulation under the conditions where the relative dielectric constant ε of the dielectric is set to, for example, 4.9, the dielectric loss tan δ of the dielectric is set to, for example, 0.025, and the conductivity of copper (Cu) is used as the conductivity of the conductor pattern (line). In FIG. 32, the horizontal axis represents the frequency and the vertical axis represents the return loss. A broken line Y2 shown in FIG. 32 represents the return loss obtained as a result of simulation under the same condition in the configuration where W2=W4=0.2 mm is set.

It is found from FIG. 32 that the resonant frequency Fa0 in the resonance mode A and the resonant frequency Fb0 in the resonance mode B are separated from each other, and furthermore, those resonant frequencies Fa0 and Fb0 have the relationship of the improved region of the return loss that satisfies Expressions (69) and (72). Whether the resonance mode is A or B can be determined based on the analysis result of a current distribution by simulation.

It can be seen from FIG. 32 that the return loss of the resonant frequency Fa0 in the resonance mode A can be improved from −13 dB to −17 dB by extending the line widths W2 and W 4 from 0.2 mm to 5 mm.

The reason for the above improvement is that the two resonant frequencies Fa0 and Fb0 are separated from each other, and the resonant frequencies Fa0 and Fb0 obtain the relationship of the improved region of the return loss satisfying Expressions (70) and (71), and then the line widths W2 and W4 of parts (for example, coupling side portion 38 and opposite side portions 36, 37) of the second element 24 are set to be larger than the line width ϕi (for example, 0.2 mm) of the inductance shape.

Next, it is confirmed that Fa0 and Fb0 satisfy Expressions (70) and (71).

The respective values of the resonant frequency Fa0 in the resonance mode A and the resonant frequency Fb03 of the harmonic which is three times the resonance mode B are obtained from a graph of the solid line Y1 (that is, W2=W4=5 mm) in FIG. 32, and those values are substituted into Expressions (7b) and (9c) to obtain the following expressions.

$$Fa0=1053 \text{ MHz}$$

$$Fb03=1479 \text{ MHz}$$

$$Faru=2Fa0=2106 \text{ MHz}$$

$$Fbrd=2Fb03/3=986 \text{ MHz}$$

Expressions (70) and (71) are confirmed with the use of the value of Expression (74), and it is understood that Expressions (70) and (71) are satisfied as follows.

$$Fbrd=986<1053=Fa0<1139=((1-\Delta fm)/(1+\Delta fm))Fb03 \quad (70)$$

$$Faru=2106>1479=Fb03>1368=((1+\Delta fm)/(1-\Delta fm))Fa0 \quad (71)$$

Incidentally, as parts of the second element 24, for example, as the line width W2 of the coupling side portion 38 and the line width W4 of the opposite side portions 36 and 37, as described above, there is an optimum value of the line width from the viewpoint of improving the return loss performance, and there is also a physical upper limit value that the line overlaps another line.

In addition, the configurations of the sixth embodiment other than those described above are the same as those in the first embodiment. Accordingly, the same advantages as those in the first embodiment can be obtained even in the sixth embodiment.

Seventh Embodiment

Figures 33A, 33B, 33C, 33D:
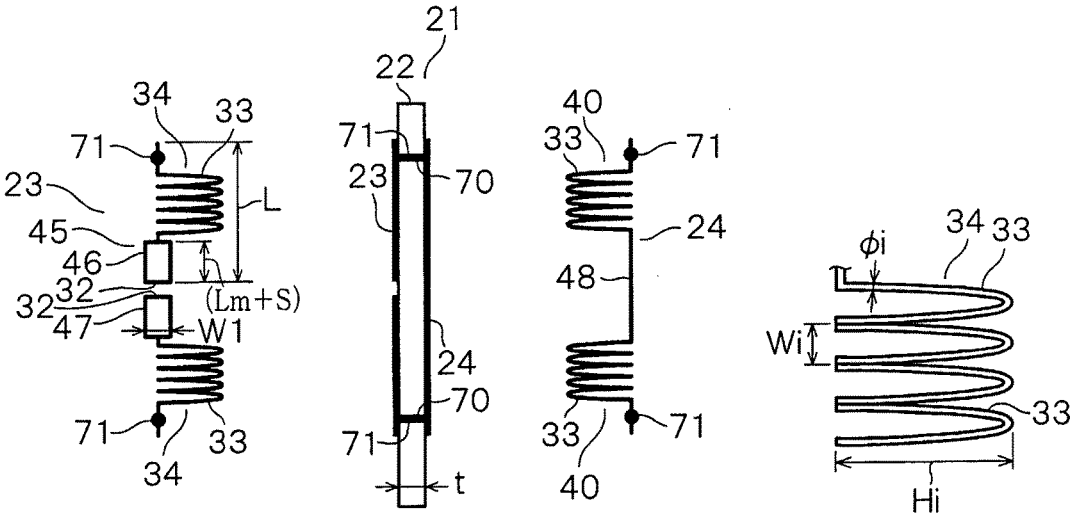
Figure 34:
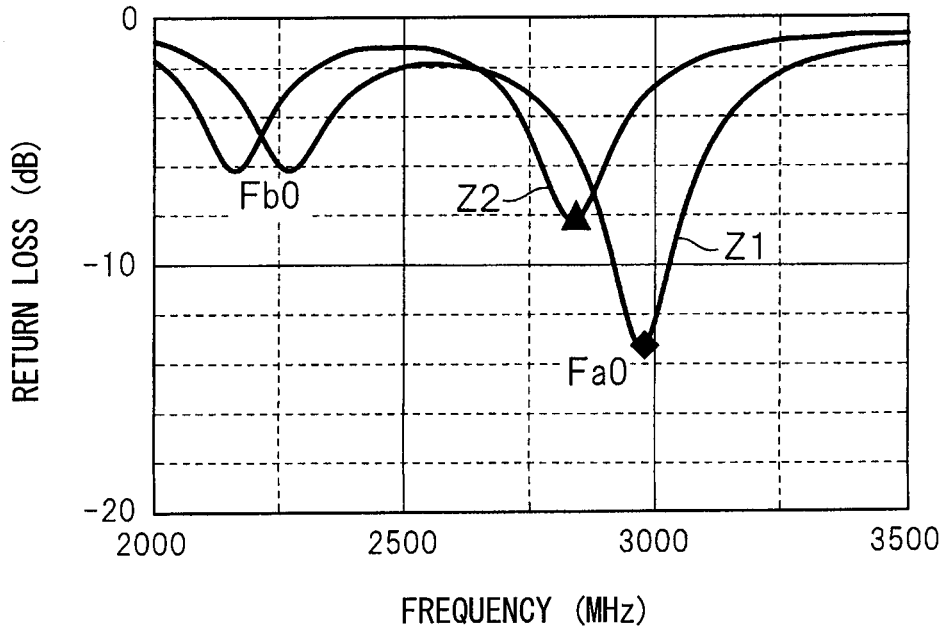
FIG. 34 is a characteristic diagram illustrating a relationship between the return loss and the frequency.

FIGS. 33A to 34 illustrate a seventh embodiment of the present disclosure. It should be noted that the same reference numerals are given to the same configurations as those in the first embodiment. In the seventh embodiment, the short-circuit element 70 for short-circuiting the first element 23 and the second element 24 is provided, and no bent portion is provided in the line portion other than the inductance shapes 34 and 40 in the first element 23 and the second element 24. Hereinafter, the seventh embodiment will be described in more detail.

As shown in FIG. 33A, the first element 23 includes a power feeding side linear portion 45 formed of a conductor pattern, and the power feeding side linear portion 45 includes a first linear portion 46 and a second linear portion 47 which are disposed so as to face each other. Opposing tip portions of the first linear portion 46 and the second linear portion 47 serve as feeding points 32.

The inductance shape 34 is formed in an upper half portion in FIG. 33A which is a part of the first linear portion 46, and the inductance shape 34 is formed in a lower half portion in FIG. 33A which is a part of the second linear portion 47. The inductance shapes 34 protrude rightward in FIG. 33A in the plane of the substrate 22. As illustrated in FIG. 33D, each of the inductance shapes 34 extends the conductor pattern of the line width ϕi from the center in the width direction of the first linear portion 46 and the second linear portion 47 along the first linear portion 46 and the second linear portion 47. The extended portion continuously forms Ni inner protruding portions 33 in a semielliptical shape.

As illustrated in FIG. 33D, it is assumed that a width of the base portion of each inner protruding portion 33 is Wi, a height is Hi, and a line width is ϕi. Further, it is assumed that the number of inner protruding portions 33 corresponding to one inductance shape 34 is Ni. In the inductance shape 34 according to the seventh embodiment, one semielliptical shape (that is, the inner protruding portion 33) has three bending structures. In the seventh embodiment, since the number Ni of the semielliptical shape (that is, the inner protruding portion 33) is, for example, five, the inductance shape 34 has eleven bending structures.

Further, as illustrated in FIG. 33A, it is assumed that the length (element length) of the first linear portion 46 and the second linear portion 47 is L, and the length of the portion excluding the inductance shape 34 in each length of the first linear portion 46 and the second linear portion 47 is (Lm+S). The line width W1 of the portion excluding the inductance shape 34 in the first linear portion 46 and the second linear portion 47 is wider than the line width ϕi (for example, 0.2 mm) of the inductance shape 34. In the case of the present embodiment, the element length L is set to, for example, 11.2 mm, the length (Lm+S) to the inductance shape is set to, for example, 7.2 mm, ϕi is set to, for example, 0.2 mm, the line width W1 of the first linear portion 46 and the second linear portion 47 of the first element 3 is set to, for example, 2 mm, the height Hi of the semielliptical shape is set to 6 mm, the width Wi of the semielliptical shape is set to 0.6 mm, and the thickness t of the dielectric (substrate 22) is set to, for example, 0.8 mm.

As illustrated in FIG. 33C, the second element 24 includes a non-power feeding side linear portion 48 formed of a conductor pattern. The line width of the non-power feeding side linear portion 48 is the same as the line width ϕi (for example, 0.2 mm) of the conductor pattern of the portion where the inductance shape 34 of the first element 23 is formed. Inductance shapes 40 and 40 are formed on both end portions of the non-power feeding side linear portion 48. The inductance shapes 40 protrude leftward in FIG. 33C in the plane of the substrate 22. As illustrated in FIG. 33C, each inductance shape 40 is configured by extending the conductor pattern of the line width ϕi of the non-power feeding side linear portion 48, and continuously forming Ni inner protruding portions 33 in a semi-elliptical shape with the extended portion. The shape of the inner protruding portions 33 of the inductance shape 40 and the size of each portion are the same as the shape of the inner protruding portion 33 of the inductance shape 34 in the first element 23, and the size of each portion.

In the seventh embodiment, as illustrated in FIG. 18B, the first element 23 and the second element 24 are connected (short-circuited) to each other by short-circuit elements 70. Each of the short-circuit elements 70 has a through hole 71 that connects an upper end portion of the first linear portion 46 in the first element 23 to an upper end portion of the non-power feeding side linear portion 48 in the second element 4. The short-circuit element 70 also has a through-hole 71 that connects a lower end portion of the second linear portion 47 in the first element 23 to a lower end portion of the non-power feeding side linear portion 48 in the second element 4.

In the seventh embodiment, the short-circuit element 70 is provided, and the length (Lm+S) up to the inductance shape is determined such that the relationship between the two resonant frequencies Fa0 and Fb0 fall within the return loss improved region that satisfies the expressions (69) and (72).

Since the inductance component increases more as the line width of the inductance shapes 34 and 40 decreases more, it is desirable from the viewpoint of downsizing that the line width of the inductance shapes 34 and 40 is set to the allowable minimum line width (that is, the lower limit value of the line width).

In the seventh embodiment, although there is no bending of the line portion other than the inductance shape, and the number of semiellipes Ni is five. However, since the frequency ratio Δfm at the deterioration range boundary does not change with one digit larger, a value of Expression (74) obtained by multiplying a value of Expression (73) by 10 is used as Δfm with a margin.

In FIG. 34, a curve Z1 represents the return loss obtained by simulation under the conditions where the relative dielectric constant ε of the dielectric is set to, for example, 4.9, the dielectric loss tan δ of the dielectric is set to, for example, 0.025, and the conductivity of copper (Cu) is used as the conductivity of the conductor pattern (line). In FIG. 34, the horizontal axis represents the frequency and the vertical axis represents the return loss. A curve Z2 illustrated in FIG. 34 represents the return loss obtained as a result of simulation under the same condition in the configuration where the line width W1 is set to 0.2 mm.

It is found from FIG. 34 that the resonant frequency Fa0 in the resonance mode A and the resonant frequency Fb0 in the resonance mode B are separated from each other, and furthermore, those resonant frequencies Fa0 and Fb0 have the relationship of the improved region of the return loss that satisfies Expressions (69) and (72). Whether the resonance mode is A or B can be determined based on the analysis result of a current distribution by simulation.

It can be seen from FIG. 34 that the return loss of the resonant frequency Fa0 in the resonance mode A can be improved from −8 dB to −13 dB by extending the line width W1 from 0.2 mm to 2 mm. The reason for the above improvement is that the two resonant frequencies Fa0 and Fb0 are separated from each other, and the resonant frequencies Fa0 and Fb0 obtain the relationship of the improved region of the return loss satisfying Expressions (69) and (72), and then the line width W1 of parts (for example, first linear portion 46 and second linear portion 47) of the first element 23 is set to be larger than the line width ϕi (for example, 0.2 mm) of the inductance shape by, for example, 2 mm. As the line width W1 of a part of the first element 23, as described above, there is an optimum value for the line width from the viewpoint of improvement in return loss performance.

Next, it is confirmed that Fa0 and Fb0 satisfy Expressions (69) and (72).

The resonant frequency Fa0 in the resonance mode A and the resonant frequency Fb0 in the resonance mode B are obtained from a graph of a curve Z1 in FIG. 34 (that is, W1=2 mm), and those values are substituted into Expressions (7a) and (8b) to obtain the following expressions.

$$Fa0=2970 \text{ MHz}$$

$$Fb0=2266 \text{ MHz}$$

$$Fard=1 \text{ MHz}$$

$$Fbru=3Fb0/2=3399 \text{ MHz}$$

Expressions (69) and (72) are confirmed with the use of the value of Expression (74), and it is understood that Expressions (69) and (72) are satisfied as follows.

$$Fbru=3399>2970=Fa0>1745=((1-\Delta fm)/(1+\Delta fm))Fb0 \quad (69)$$

$$Fard=1<2266=Fb0<3858=((1+\Delta fm)/(1-\Delta fm))Fa0 \quad (72)$$

The configurations of the seventh embodiment other than those described above are the same as those in the first embodiment. Accordingly, the same advantages as those in the first embodiment can be obtained even in the seventh embodiment.

Eighth Embodiment

Figure 35A:
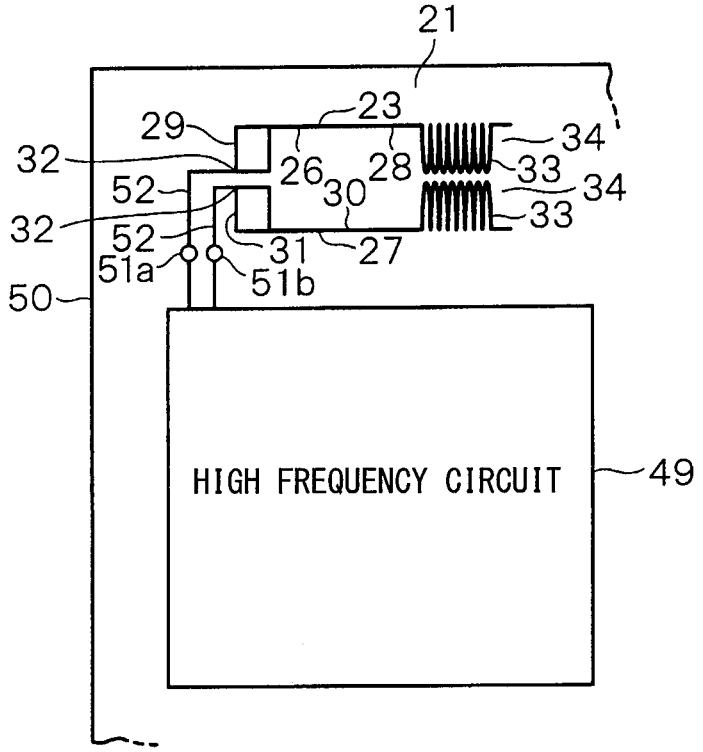
Figure 35B:
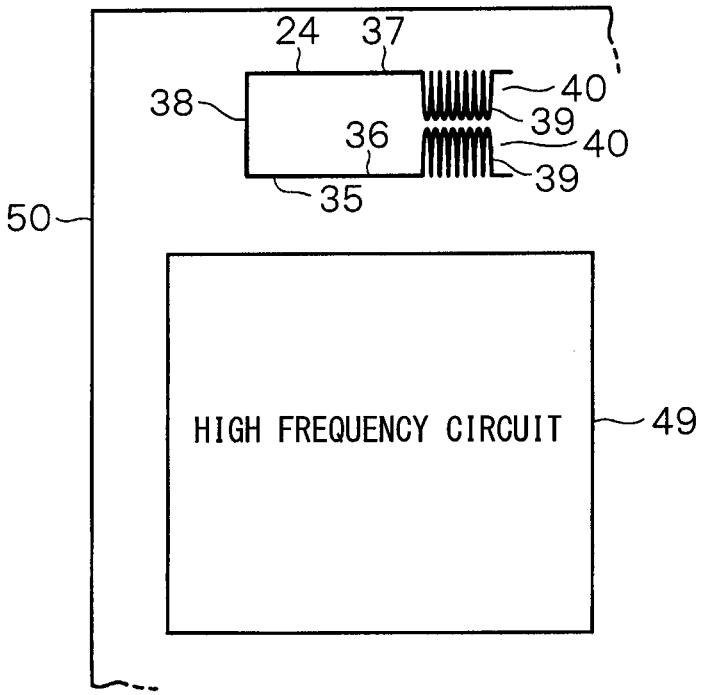

FIGS. 35A to 35D illustrate an eighth embodiment of the present disclosure. It should be noted that the same reference numerals are given to the same configurations as those in the fifth embodiment. In the eighth embodiment, the deformed folded dipole antenna 21 according to the fifth embodiment is provided on a printed wiring board 50 on which a high frequency circuit 49 is mounted. More specifically, as illustrated in FIG. 35A, the first element 23 according to the first embodiment is formed on one surface of the printed wiring board 50, and as illustrated in FIG. 35B, the second element 24 according to the first embodiment is formed on the other surface of the printed wiring board 50. The printed wiring board 50 is configured to have the function of a dielectric.

Further, as illustrated in FIG. 35A, on one surface of the printed wiring board 50, connection lines 52 and 52 that connect tip portions (feeding points 32) of the short side portions 29 and 31 of the first L-shaped portion 26 and the second L-shaped portion 27 in the first element 23 to input/output terminals 51*a* and 51*b* of a high frequency circuit 49 are disposed on one surface of the printed wiring substrate 50. The connection lines 52 are each formed of a conductor pattern (for example, a copper foil pattern), and a line width of the connection lines 52 is set, for example, as ϕi.

The configurations of the eighth embodiment other than those described above are the same as those in the fifth embodiment. Accordingly, the same advantages as those in the fifth embodiment can be obtained even in the eighth embodiment. In particular, according to the eighth embodiment, since the deformed folded dipole antenna 21 is provided on the printed wiring board 50 on which the high frequency circuit 49 is mounted, the number of components can be reduced. In addition, a connection cable that connects the input/output terminal of the high frequency circuit and the deformed folded dipole antenna 21 can be made unnecessary. As a result, the manufacturing cost can be reduced.

Ninth Embodiment

Figure 36:
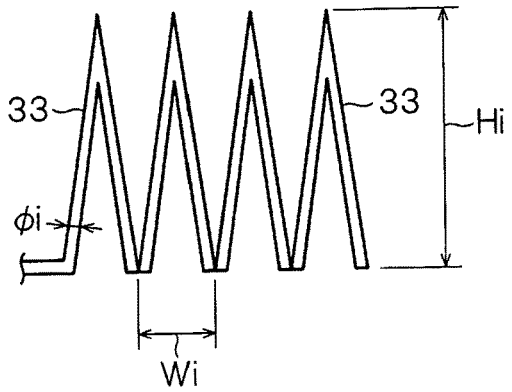
FIG. 36 is an enlarged view of an inductance shape according to a ninth embodiment of the present disclosure.

FIG. 36 illustrates a ninth embodiment of the present disclosure. It should be noted that the same reference numerals are given to the same configurations as those in the first embodiment. In the ninth embodiment, each of inner protruding portions 33 is formed in an isosceles triangle shape. In the ninth embodiment, the shape of the inner protruding portion 33 is different from that of the first embodiment, and the number, position and size of the inner protruding portion 33 are the same as those of the inner protruding portion 33 in the first embodiment. Also, a line width ϕi is the same as that of the inner protruding portion 33 in the first embodiment. Also in the case where the inner protruding portion 33 has an isosceles triangular shape, since a tip of the inner protruding portion 33 is a point, a width of the tip portion is shorter than a length Wi of a base portion, and the width becomes continuously narrower toward the tip. For that reason, as illustrated in FIG. 36, even if each inner protruding portion 33 has an isosceles triangular shape, the inner protruding portions 33 can be continuously formed. Therefore, since a large number of inner protruding portions 33 can be formed in a narrow area, the size of the antenna can be particularly reduced.

Tenth Embodiment

Figure 37:
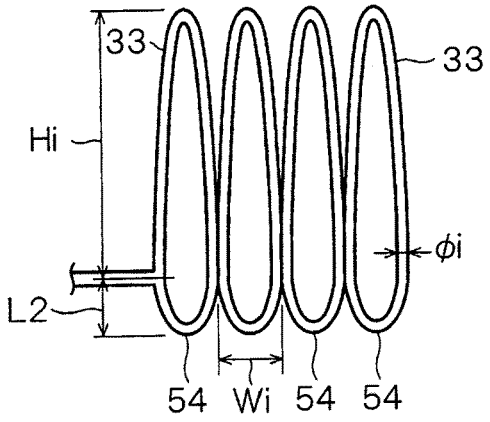
FIG. 37 is an enlarged view of an inductance shape according to a tenth embodiment of the present disclosure.

FIG. 37 illustrates a tenth embodiment of the present disclosure. It should be noted that the same reference numerals are given to the same configurations as those in the first embodiment. In the tenth embodiment, as illustrated in FIG. 37, both-end connection portions 54 that connect both ends of inner protruding portions 33 are further provided. Each of the both-end connection portions 54 connects one end and the other end of the semielliptical inner protruding portion 33. The both-end connection portion 54 according to the tenth embodiment has a semielliptical shape, and unlike the inner protruding portion 33, protrudes outward. The height of the both-end connection portion 54 is L2 as illustrated in FIG. 37. In the tenth embodiment, the inductance shapes 34 and 40 have a shape in which one or more elliptical shapes (inner protruding portions 33+both-end connection portions 54) are aligned.

The configurations of the tenth embodiment other than those described above are the same as those in the first embodiment. Accordingly, the same advantages as those in the first embodiment can be obtained even in the tenth embodiment. In particular, according to the tenth embodiment, since the both-end connection portions 54 each connecting both ends of each inner protruding portion 33 are provided, the effect of being able to prevent the return loss from being varied can be obtained.

Eleventh Embodiment

Figure 38:
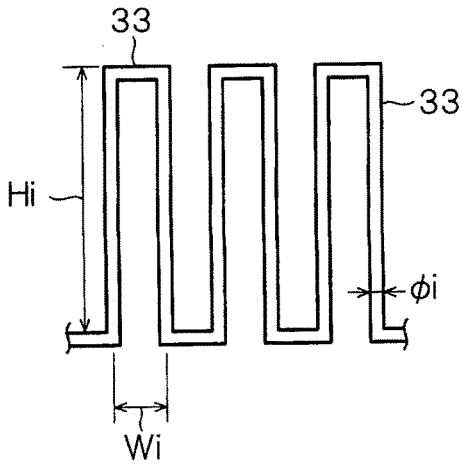
FIG. 38 is an enlarged view of an inductance shape according to an eleventh embodiment of the present disclosure.

FIG. 38 illustrates an eleventh embodiment of the present disclosure. It should be noted that the same reference numerals are given to the same configurations as those in the first embodiment. In the eleventh embodiment, each of inner protruding portions 33 has a right-angled bent shape having two right-angled bending points. A height Hi and a line width ϕi of the inner protruding portion 33 are the same as those of the inner protruding portion 33 of the first embodiment described above. In addition, a width of a repeating unit is the same as the width Wi of the inner protruding portion 33 of the first embodiment. The number and positions of inner protruding portions 33 are also the same as those in the first embodiment. In the eleventh embodiment, the inductance shape has a shape in which one or more rectangular shapes are aligned.

Twelfth Embodiment

Figure 39:
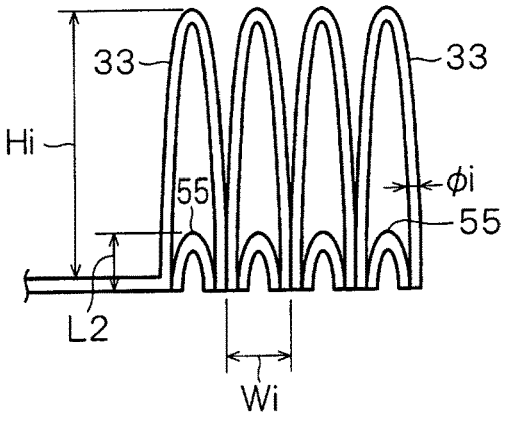
FIG. 39 is an enlarged view of an inductance shape according to a twelfth embodiment of the present disclosure.

FIG. 39 illustrates a twelfth embodiment of the present disclosure. It should be noted that the same reference numerals are given to the same configurations as those in the tenth embodiment. In the twelfth embodiment, as illustrated in FIG. 39, the both-end connection portion 55 connects one end and the other end of the inner protruding portion 13, and the shape of the inner protruding portion 13 is semielliptical. Unlike the tenth embodiment (refer to FIG. 37), the both-end connection portions 55 according to the twelfth embodiment protrude inward as with the inner protruding portions 33. Although a protruding direction is different from that of the both-end connection portion 54 in the fifth embodiment, the height of the both-end connection portion 55 is L2 like the both-end connection portion 54 in the tenth embodiment, as illustrated in FIG. 39.

The configurations of the twelfth embodiment other than those described above are the same as those in the tenth embodiment. Accordingly, the same advantages as those in the tenth embodiment can be obtained even in the twelfth embodiment.

Thirteenth Embodiment

Figure 40:
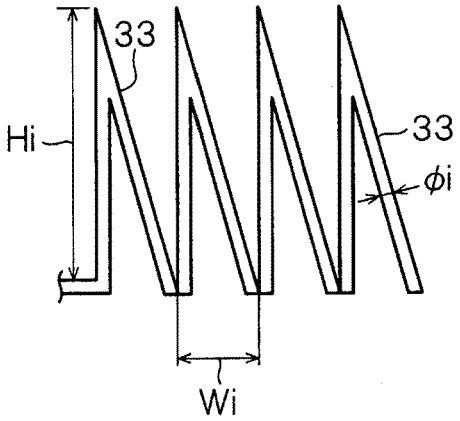
FIG. 40 is an enlarged view of an inductance shape according to a thirteenth embodiment of the present disclosure.

FIG. 40 illustrates a thirteenth embodiment of the present disclosure. It should be noted that the same reference numerals are given to the same configurations as those in the first embodiment. As illustrated in FIG. 40, in the thirteenth embodiment, each of inner protruding portions 33 has a right triangle shape. The shape of the inner protruding portion 33 is different from that of the first embodiment, and the number, position and size of the inner protruding portion 33 are the same as those in the first embodiment. Also in the case where the inner protruding portion 33 has a right triangle shape, since a tip of the inner protruding portion 33 is a point, a width of the tip portion is shorter than a length Wi of a base portion, and the width becomes continuously narrower toward the tip. For that reason, even if each inner protruding portion 33 has the right triangle shape, the inner protruding portions 33 can be continuously formed. Therefore, since a large number of inner protruding portions 33 can be formed in a narrow area, the size of the antenna can be particularly reduced.

Fourteenth Embodiment

Figure 41:
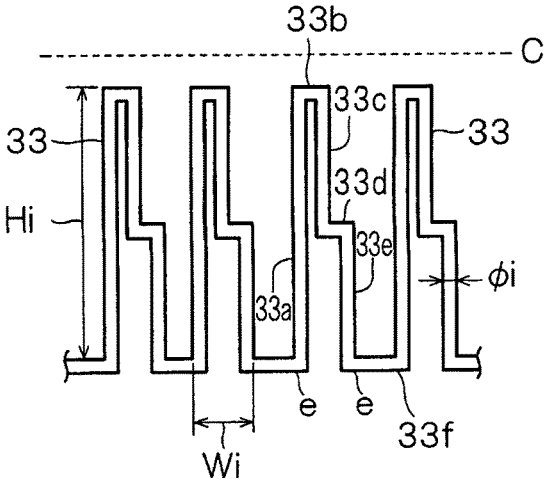
FIG. 41 is an enlarged view of an inductance shape according to a fourteenth embodiment of the present disclosure.

FIG. 41 illustrates a fourteenth embodiment of the present disclosure. It should be noted that the same reference numerals are given to the same configurations as those in the first embodiment. As illustrated in FIG. 41, in the fourteenth embodiment, each of inner protruding portions 33 has a step shape. A height Hi, a line width ϕi, and a width Wi of a repetitive unit of the inner protruding portions 33 are the same as those of the inner protruding portion 33 of the first embodiment. The number and positions of inner protruding portions 33 are also the same as those in the first embodiment.

As illustrated in FIG. 41, the shape of one inner protruding portion 33 specifically includes a first long perpendicular line portion 33*a*, a tip line portion 33*b*, a first short perpendicular line portion 33*c*, an intermediate line portion 33*d*, and a second short perpendicular line portion 33*e*. The first long perpendicular line portion 33*a* extends vertically from one end point e of the inner protruding portion 33 to a tip of the inner protruding portion 33 toward an antenna width direction center plane C. One end portion of the tip line portion 33*b* is connected to an end portion of the first long perpendicular line portion 33*a* on the tip side, and the tip line portion 33*b* is in parallel to the antenna width direction center plane C.

One end of the first short perpendicular line portion 33*c* is connected to the tip line portion 33*b* and extends from the tip line portion 33*b* in a direction perpendicular to the antenna width direction center plane C and away from the antenna width direction center plane C. Also, the first short perpendicular line portion 33*c* is shorter than the first long perpendicular line portion 33*a*. One end portion of the intermediate line portion 33*d* is connected to the first short perpendicular line portion 33*c* and extends from the first short perpendicular line portion 33*c* in parallel to the antenna width direction center plane C and on the side opposite to the first long perpendicular line portion 33*a*.

One end of the second short perpendicular line portion 33*e* is connected to the intermediate line portion 33*d* and the other end portion serves as an end point e of the inner protruding portion 33 on the opposite side to the side connected to the first long perpendicular line portion 33*a*, and is perpendicular to the center plane C in the antenna width direction. Also, the second short perpendicular line portion 33*e* is shorter than the first long perpendicular line portion 33*a*. The inner protruding portion 33 having the configuration described above is connected to an adjacent inner protruding portion 33 through a short connection line 33*f*. Even when the inner protruding portion 33 has a step shape, the line length becomes longer than that in the case where the inner protruding portion 33 is not provided by the length of the inner protruding portion 33, and therefore the antenna can be downsized.

Fifteenth Embodiment

Figure 42:
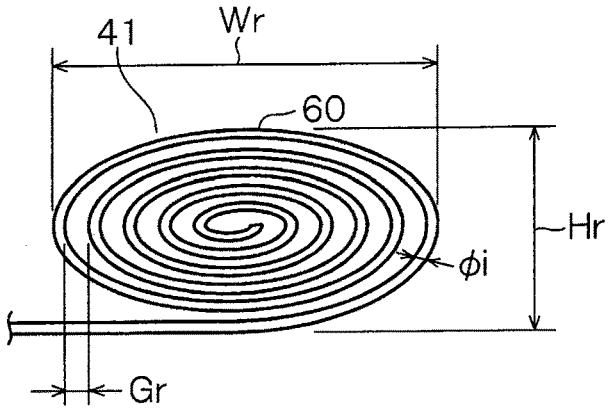
FIG. 42 is an enlarged view of an inductance shape according to a fifteenth embodiment of the present disclosure.

FIG. 42 illustrates a fifteenth embodiment of the present disclosure. It should be noted that the same reference numerals are given to the same configurations as those in the sixth embodiment. In the fifteenth embodiment, as illustrated in FIG. 42, an elliptical spiral structure 60 is formed by a conductor pattern having a line width ϕi, and an inductance shape 41 is configured by the elliptical spiral structure 60 formed. In this configuration, it is assumed that a line width of the conductor pattern of the elliptical spiral structure 60 is ϕi, the number of turns of the elliptical spiral structure 60 is Nr, a gap of the elliptical spiral structure 60 is Gr, a width of the elliptical spiral structure 60 is Wr, and a height of the elliptical spiral structure 60 is Hr.

The configurations of the fifteenth embodiment other than those described above are the same as those in the sixth embodiment. Accordingly, the same advantages as those in the sixth embodiment can be obtained even in the fifteenth embodiment.

Sixteenth Embodiment

Figure 43:
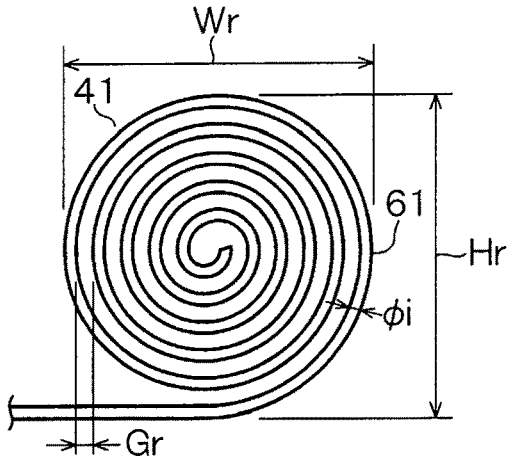
FIG. 43 is an enlarged view of an inductance shape according to a sixteenth embodiment of the present disclosure.

FIG. 43 illustrates a sixteenth embodiment of the present disclosure. It should be noted that the same reference numerals are given to the same configurations as those in the fifteenth embodiment. In the sixteenth embodiment, as illustrated in FIG. 43, a circular spiral structure 61 is formed by a conductor pattern having a line width ϕi, and an inductance shape 41 is configured by the circular spiral structure 61 formed. In this configuration, it is assumed that a line width of the conductor pattern of the circular spiral structure 61 is ϕi, the number of turns of the circular spiral structure 61 is Nr, a gap of the circular spiral structure 61 is Gr, a width of the circular spiral structure 61 is Wr, and a height of the circular spiral structure 61 is Hr.

The configurations of the sixteenth embodiment other than those described above are the same as those in the fifteenth embodiment. Accordingly, the same advantages as those in the fifteenth embodiment can be obtained even in the sixteenth embodiment.

Seventeenth Embodiment

Figure 44:
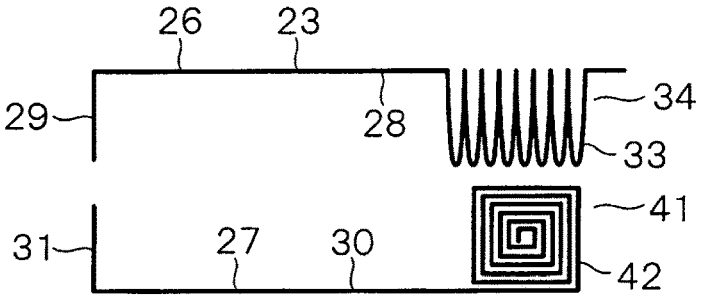
FIG. 44 is a diagram illustrating a configuration of a first element side of a deformed folded dipole antenna according to a seventeenth embodiment of the present disclosure.

FIG. 44 illustrates a seventeenth embodiment of the present disclosure. It should be noted that the same reference numerals are given to the same configurations as those in the first embodiment or the sixth embodiment. In the first embodiment, the inductance shapes 34 and 34 having the same shape are provided in the long side portions 28 and 30 of the first L-shaped portion 26 and the second L-shaped portion 27 of the first element 23. However, the present disclosure is not limited to this configuration, and inductance shapes of different shapes may be provided. For example, in the seventeenth embodiment, as illustrated in FIG. 44, an inductance shape 34 formed by the inner protruding portion 33 is provided in the long side portion 28 of the first L-shaped portion 26 of the first element 23. An inductance shape 41 formed by a rectangular spiral structure 42 is provided in the long side portion 30 of the second L-shaped portion 27 of the first element 23. Although not shown, similarly, in the second element 24, as with the first element 23, an inductance shape 34 formed by the inner protruding portion 33 is provided in the opposite side portion 36 corresponding to the first L-shaped portion 26. An inductance shape 41 formed by a rectangular spiral structure 42 is provided on the opposite side portion 37 corresponding to the second L-shaped portion 27.

The configurations of the seventeenth embodiment other than those described above are the same as those in the first embodiment or the sixth embodiment. Accordingly, the same advantages as those in the first embodiment or the sixth embodiment can be obtained even in the seventeenth embodiment.

In addition, in providing inductance shapes of different shapes in the long side portions 28 and 30 of the first L-shaped portion 26 and the second L-shaped portion 27 in the first element 23, the inductance shapes 34 formed by the inner protruding portions 33 of different shapes may be combined together. Alternatively, the inductance shapes formed by the spiral structures 42, 60, and 61 having different shapes may be combined together.

Alternatively, one of plural types of inner protruding portions and one of plural types of spiral structures may be appropriately combined together.

Eighteenth Embodiment

Figure 45:
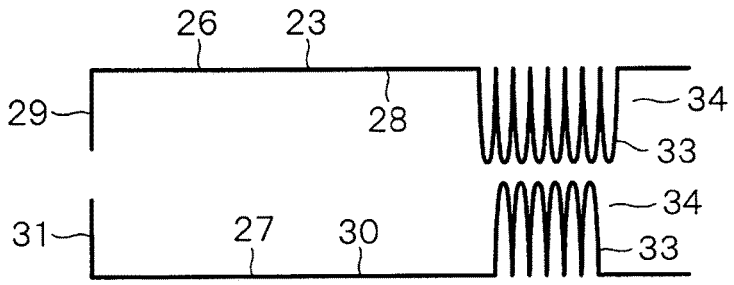
FIG. 45 is a diagram illustrating a configuration of a first element side of a deformed folded dipole antenna according to an eighteenth embodiment of the present disclosure.

FIG. 45 illustrates an eighteenth embodiment of the present disclosure. It should be noted that the same reference numerals are given to the same configurations as those in the first embodiment. In the first embodiment, the inductance shapes 34 and 34 each formed by the inner protruding portions 33 with the same shape and the same number are provided in the long side portions 28 and 30 of the first L-shaped portion 26 and the second L-shaped portion 27 in the first element 23. However, the present disclosure is not limited to this configuration, and inductance shapes different in the number of inner protruding portions 33 may be provided. For example, in the eighteenth embodiment, as illustrated in FIG. 45, for example, eight inner protruding portions 33 are formed on a long side portion 28 of a first L-shaped portion 26 in a first element 23, and, for example, six inner protruding portions 33 are formed on a long side portion 30 of a second L-shaped portion 27 in the first element 23. Although not shown, in a second element 24, as with the first element 23, for example, eight inner protruding portions 33 are formed in an opposite side portion 36 corresponding to the first L-shaped 26, and, for example, six inner protruding portions 33 are formed on an opposite side portion 37 corresponding to the second L-shaped portion 27.

The configurations of the eighteenth embodiment other than those described above are the same as those in the first embodiment. Accordingly, the same advantages as those in the first embodiment can be obtained even in the eighteenth embodiment.

In the eighteenth embodiment, the number of formed semielliptical inner protruding portions 33 is different from each other. However, the present disclosure is not limited to this example, but the number of formed inner protruding portions 33 of other shapes may be different from each other.

The deformed folded dipole antenna 21 of each of the embodiments described above can be used as a small antenna of an in-vehicle wireless device or a mobile terminal (such as a smartphone or a cellular phone). Examples of wireless communication systems for in-vehicle wireless devices and mobile terminals include cellular phones (700 MHz band, 800 MHz band, 900 MHz band, 1.5 GHz band, 1.7 GHz band, 2 GHz band), wireless LAN (2.4 GHz band, 5 GHz band), GPS (1.5 GHz band), inter-vehicle communication (700 MHz band), road-to-vehicle communication (5.8 GHz band), and the like.

Further, according to the respective embodiments described above, even in the case where there is the short-circuit element (the first embodiment, the second embodiment, the third embodiment, the fourth embodiment, the seventh embodiment), and even in the case where there is no short-circuit element (fifth embodiment, sixth embodiment), the return loss can be improved. Further, even in the case where the lines other than the inductance shapes of the first element and the second element are bent (first to sixth embodiments), or in the case where the lines are not bent (seventh embodiment), the return loss can be improved.

Nineteenth Embodiment

FIGS. 46 to 49 illustrate a nineteenth embodiment of the present disclosure. It should be noted that the same reference numerals are given to the same configurations as those in the first embodiment. The nineteenth embodiment shows an example of an antenna design calculation apparatus and a calculation program which receive resonant frequencies Fa0 and Fb0 of resonance modes A and B, and calculate an admittance value Yab (that is, Expression (26)), a reflection coefficient Γab (that is, Expression (27)), a return loss RLab (that is, Expression (28)), and an impedance value Zab=1/Yab in the deformed folded dipole antenna at each frequency F.

Figure 46:
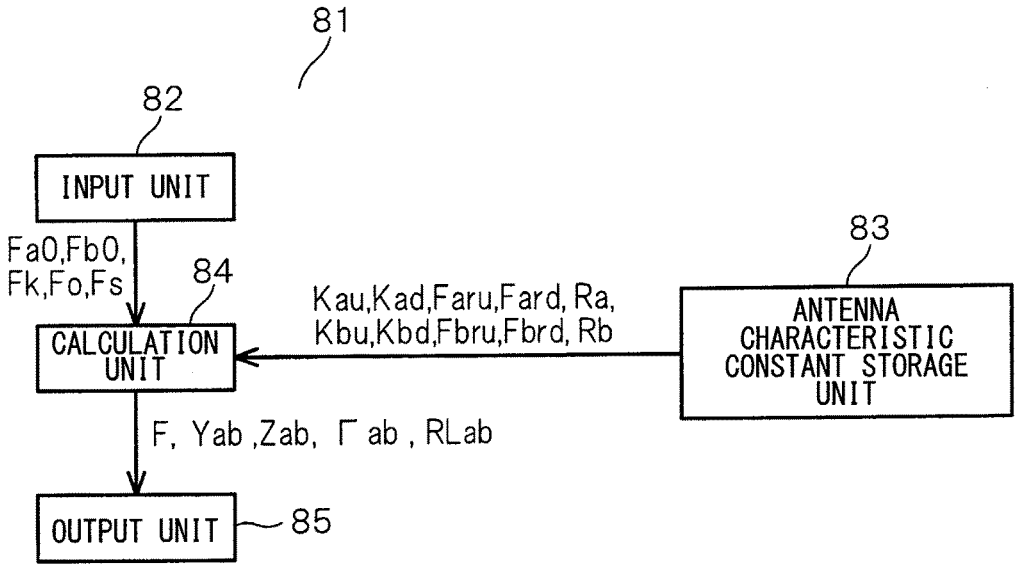
FIG. 46 is a block diagram of a calculation apparatus according to a nineteenth embodiment of the present disclosure.

As illustrated in FIG. 46, a calculation apparatus 81 for antenna design includes an input unit 82, an antenna characteristic constant storage unit 83, a calculation unit 84, and an output unit 85. The input unit 82 includes a keyboard, a mouse, and the like, and inputs data such as the resonant frequencies Fa0, Fb0 and calculation conditions (for example, Fk, Fo, Fs). The antenna characteristic constant storage unit 83 is configured by a storage unit such as a memory and a hard disk and stores data such as various antenna characteristic constants (for example, Kau, Kad, Faru, Fard, Ra, Kbu, Kbd, Fbru, Fbrd, Rb) and the like, which are required for calculation.

The calculation unit 84 includes a CPU and a microcomputer, and has a function of receiving the resonant frequencies Fa0, Fb0, and the calculation conditions from the input unit 82, receiving the antenna characteristic constant from the antenna characteristic constant storage unit 83, calculates the admittance value Yab, the reflection coefficient Γab, the return loss RLab, and the impedance value Zab=1/Yab, and transmitting the calculation result to the output unit 85. It is also preferable that the calculation unit 84 is configured to transmit the calculation result to the antenna characteristic constant storage unit 83 for storage.

The output unit 85 includes a display device, a printer, a communication device for transmission to an external device, and the like, and displays the calculation result received from the calculation unit 84 on a display device, prints the calculation result with a printer, or transmits the calculation result to the external device.

Figure 47:
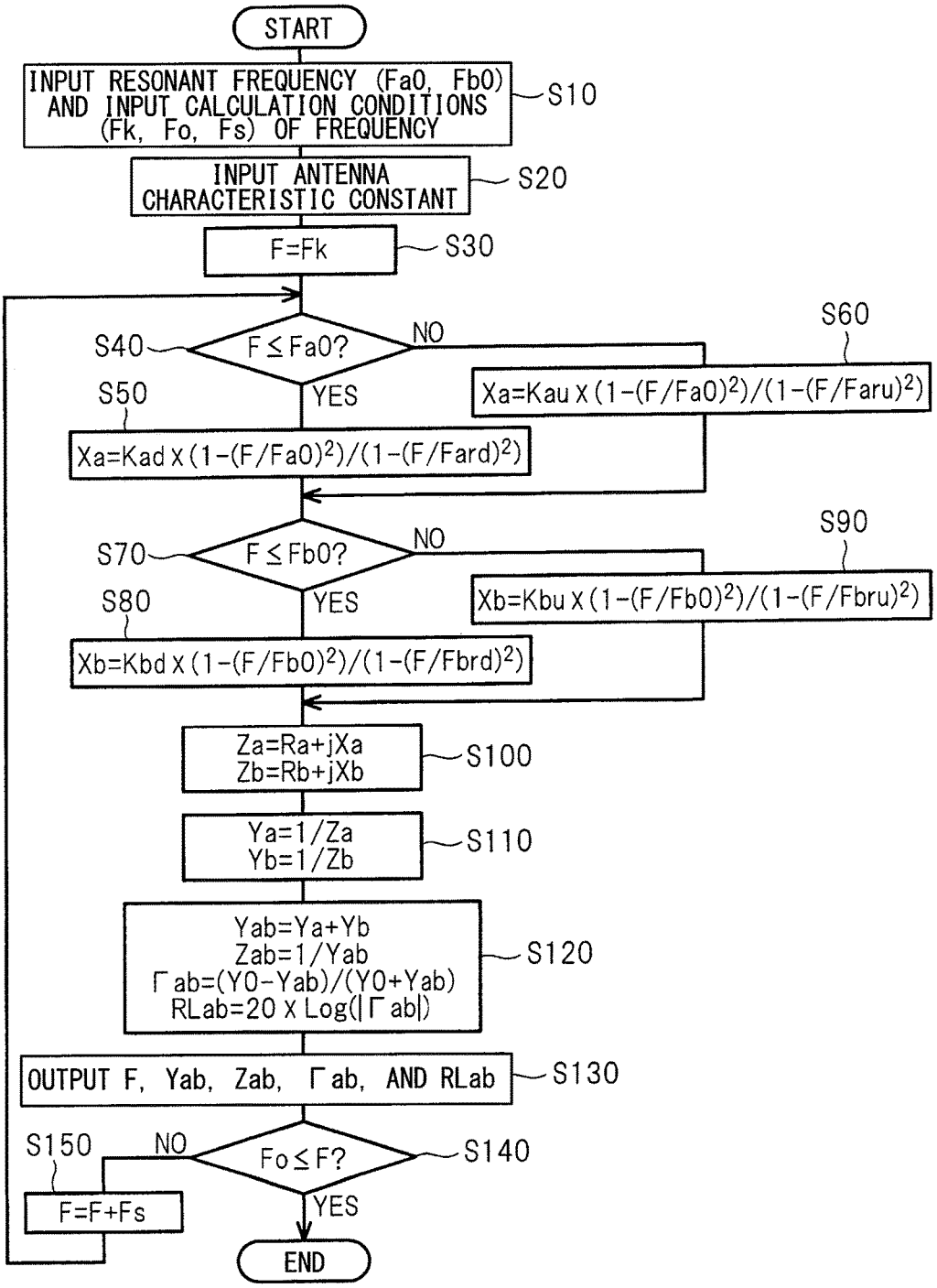
FIG. 47 is a flowchart of calculation control.

Next, calculation processing by the calculation apparatus 81 configured as described above will be described with reference to FIG. 47. The flowchart of FIG. 47 shows control contents of a calculation program of the calculation unit 84. First, in Step S10 of FIG. 47, the calculation unit 84 receives the resonant frequencies Fa0 and Fb0, and the calculation conditions (for example, Fk, Fo, Fs) of the frequency, which are input by the input unit 82. In this case, Fk is a calculation start frequency, Fo is a calculation end frequency, Fs is a calculation step frequency (that is, an interval of the frequency to be calculated), and a range of the frequency to be calculated is determined according to those calculation conditions.

Subsequently, the process proceeds to Step S20, where the calculation unit 84 reads and receives the antenna characteristic constants (for example, Kau, Kad, Faru, Fard, Ra, Kbu, Kbd, Fbru, Fbrd, Rb) stored in the antenna characteristic constant storage unit 83. In this case, Kau and Kad are upper and lower proportionality constants of the resonance mode A (that is, Expression (31) or (33), Expression (30) or (32)), respectively. Faru and Fard are a high antiresonant frequency (that is, Expression (7b)) in the resonance mode A and a low antiresonant frequency (that is, Expression (7a)), respectively. Ra is a resonance resistance in the resonance mode A (refer to FIG. 13 or 15). Kbu and Kbd are upper and lower proportionality constants in the resonance mode B (that is, Expression (36) or (38), Expression (35) or (37)), respectively. Fbru and Fbrd are a high antiresonant frequency (that is, Expression (8b) or (9b)) in the resonance mode B and a low antiresonant frequency (that is, Expression (8a) or (9a)), respectively. Rb is a resonance resistance in the resonance mode B (refer to FIG. 14 or 15).

The process proceeds to Step S30, and the frequency F to be calculated is set as the calculation start frequency Fk. Thereafter, the process proceeds to Step S40, and it is determined whether F is equal to or less than Fa0, or not. In this example, if F is equal to or less than Fa0, the process proceeds to Step S50, and the reactance Xa in the resonance mode A is calculated by Expression (11). If F is larger than Fa0 in Step S40, the process proceeds to Step S60, and the reactance Xa in the resonance mode A is calculated by Expression (14).

Subsequently, the process proceeds to Step S70, and it is determined whether F is equal to or smaller than Fb0, or not. In this example, if F is equal to or smaller than Fb0, the process proceeds to Step S80, and the reactance Xb in the resonance mode B is calculated by Expression (18). If F is larger than Fb0 in Step S70, the process proceeds to Step S90, and the reactance Xb of the resonance mode B is calculated by Expression (21).

Thereafter, the process proceeds to Step S100, and the impedances Za and Zb of the resonance modes A and B are calculated by Expressions (10) and (17), respectively. Next, the process proceeds to Step S110, and the admittances Ya and Yb in the resonance modes A and B are calculated by Expressions (24) and (25), respectively. The process proceeds to Step S120, where the combined admittance Yab, the combined reflection coefficient Γab, and the combined return loss RLab in the resonance modes A and B are calculated by Expressions (26), (27) and (28). Also, the combined impedance Zab in the resonance modes A and B is calculated by Zab=1/Yab.

Subsequently, the process proceeds to Step S130, and the calculation unit 84 outputs the calculation results (F, Yab, Zab, Γab, RLab) to the output unit 85. The calculation unit 84 may be configured to transmit the calculation results to the antenna characteristic constant storage unit 83 for storage.

The process proceeds to Step S140, and it is determined whether the frequency F is equal to or more than the end frequency Fo, or not. In this example, if the frequency F is less than the end frequency Fo, the process proceeds to Step S150, and after the calculated step frequency Fs is added to the frequency F, the process returns to Step S40. The process described above is repeatedly executed. If it is determined in Step S140 that the frequency F is equal to or larger than the end frequency Fo, the process proceeds to "YES", and the calculation control is completed.

Figure 48:
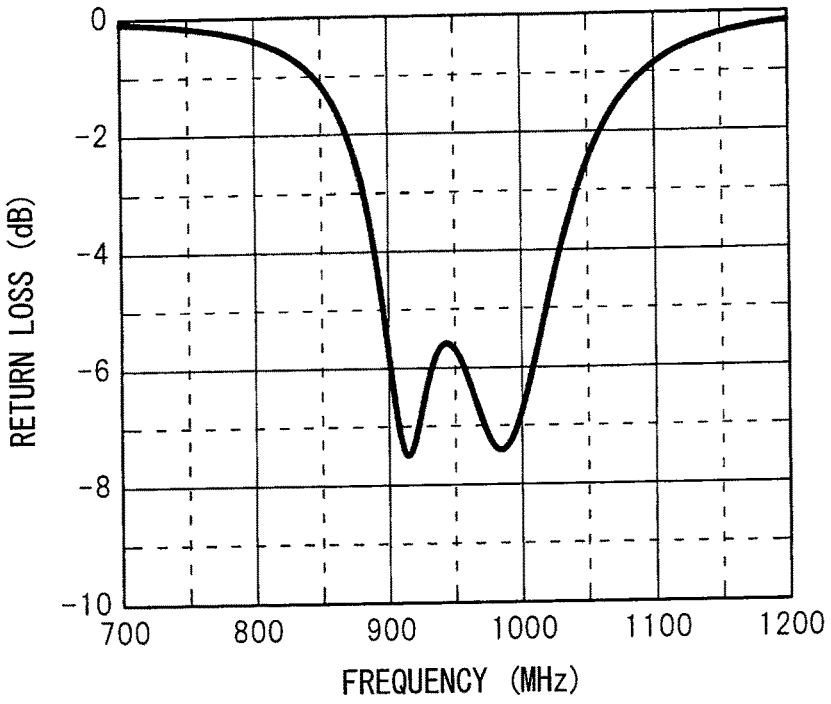
FIG. 48 is a characteristic diagram illustrating a relationship between a return loss and a frequency.
Figure 49:
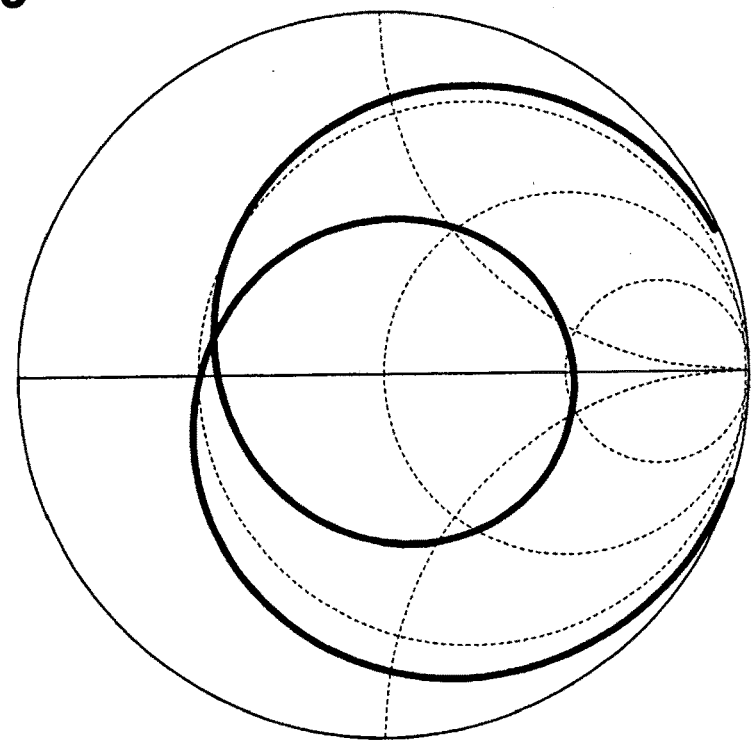
FIG. 49 is a Smith chart.
Figure 50:
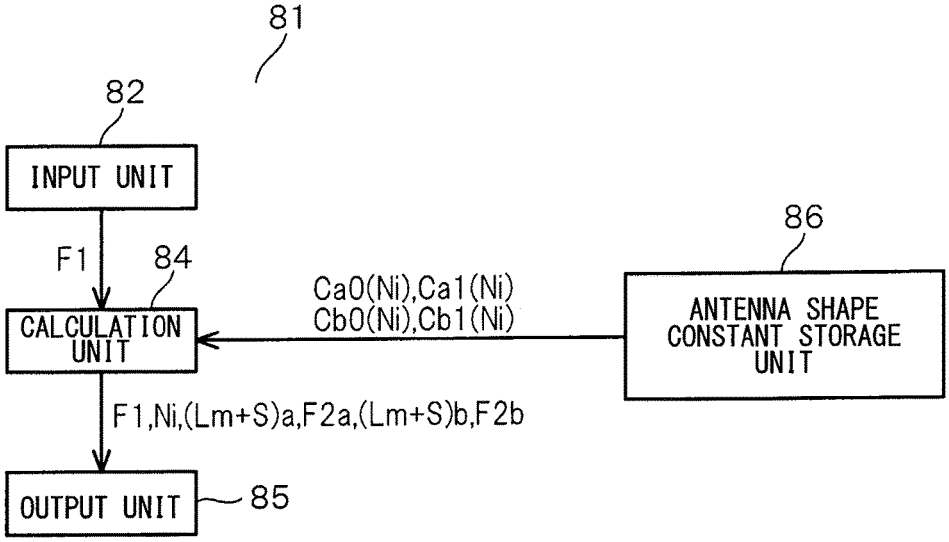
FIG. 50 is a block diagram of a calculation apparatus according to a twentieth embodiment of the present disclosure.

An example of the calculation results of the return loss RLab is illustrated in FIG. 48. In FIG. 48, the horizontal axis represents the frequency and the vertical axis represents the return loss. In this case, Fa0=900 MHz, Fb0=1000 MHz, Fk=700 Mhz, Fo=1200 MHz, and Fs=1 MHz. As the antenna characteristic constants (for example, Kau, Kad, Faru, Fard, Ra, Kbu, Kbd, Fbru, Fbrd, and Rb), the values obtained in FIG. 16 are used. A Smith chart of the calculation results is illustrated in FIG. 49. FIGS. 48 and 49 show examples of outputs by the output unit 85.

Twentieth Embodiment

FIGS. 50 to 53 illustrate a twentieth embodiment of the present disclosure. It should be noted that the same reference numerals are given to the same configurations as those in the nineteenth embodiment. In the twentieth embodiment, one resonant frequency F1 out of resonant frequencies Fa0 and Fb0 in resonance modes A and B is received, and the other resonant frequencies F1*a* and F2*b* when the antenna shape is changed, and lengths (Lm+S)a and (Lm+S)b to the inductance shape are calculated. In the twentieth embodiment, when changing the shape of the antenna, the number Ni of inner protruding portions 33 of an inductance shape 34 is changed.

In the twentieth embodiment, an input unit 82 receives data of one resonant frequency F1 of the resonant frequencies Fa0 and Fb0 in the resonance modes A and B. An antenna shape constant storage unit 86 is provided in place of the antenna characteristic constant storage unit 83. Proportionality constants Ca1(Ni) (refer to Expression (3)) and Cb1(Ni) (refer to Expression (4)) of two wavelengths λa and λb, and constants Ca0(Ni) (refer to Expression (3)) and Cb0(Ni) (refer to Expression (4)) of two wavelengths λa and λb at resonance when the number Ni of inner protruding portions 33 is changed are stored as antenna shape constants in the antenna shape constant storage unit 86.

The calculation unit 84 receives one resonant frequency F1 input by the input unit 82, receives antenna shape constants (Ca1(Ni), Cb1(Ni), Ca0(Ni), Cb0(Ni)) from the antenna shape constant storage unit 86, calculates the other resonant frequencies F1*a*, F2*b* and the lengths (Lm+S)a, (Lm+S)b to the inductance shapes, and transmits the calculation results to the output unit 85. Further, it is preferable that the calculation unit 84 is configured to transmit the calculation results to the antenna shape constant storage unit 86 for storage.

The output unit 85 displays the calculation results received from the calculation unit 84 on the display device, prints the calculation results with the printer, and transmits the calculation results to the external device.

Figure 51:
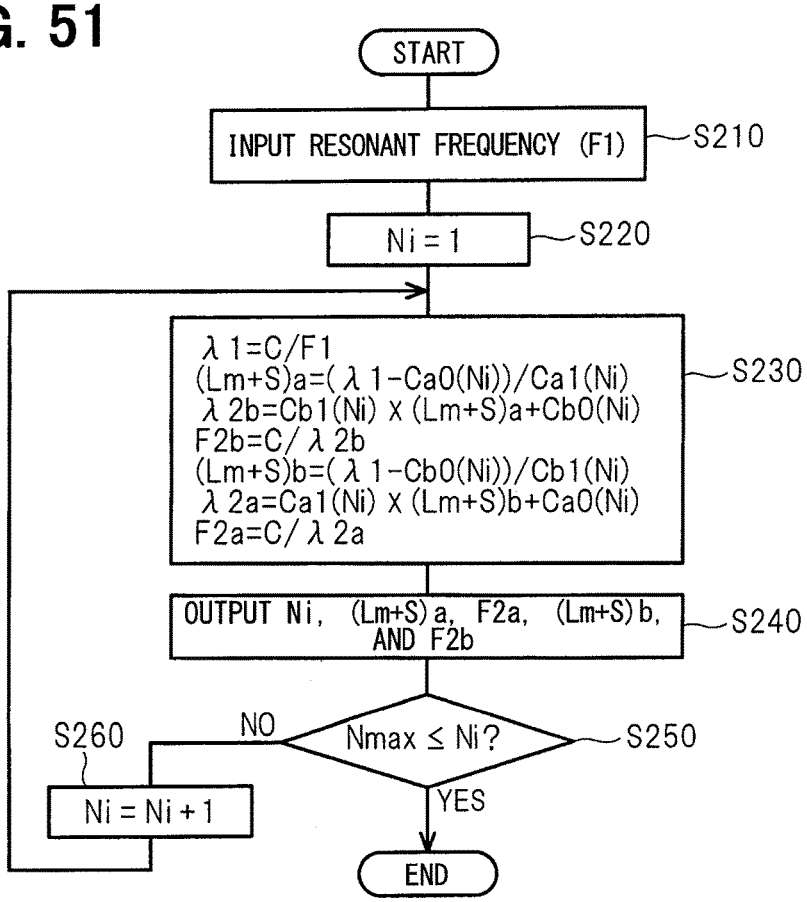
FIG. 51 is a flowchart of calculation control.

Next, the calculation processing by the calculation apparatus 81 for antenna design configured as described above will be described with reference to FIG. 51. A flowchart of FIG. 51 illustrates control contents of a calculation program of the calculation unit 84. In this calculation processing, the other resonant frequencies F2*a* and F2*b* and the lengths (Lm+S)a and (Lm+S)b to the inductance shapes are calculated with a change in the number Ni of inner protruding portions 33 from 1 to the maximum number (Nmax).

First, in Step S210 in FIG. 51, the calculation unit 84 receives one resonant frequency F1 input by the input unit 82, and reads and receives the antenna shape constant stored in the antenna shape constant storage unit 86. Subsequently, the process proceeds to Step S220, where 1 is set to the number Ni.

The process proceeds to Step S230 to calculate the resonant frequencies F2*a*, F2*b* and the lengths (Lm+S)a, (Lm+S)b based on Expressions (3), (4), (5), and (6). In this case, firstly, λ1 is obtained with λ1=C/F1. F2*a*, F2*b* and (Lm+S)a, (Lm+S)b are calculated by the following expressions.

$$(Lm+S)a=(\lambda 1-Ca0(Ni))/Ca1(Ni)$$

$$\lambda 2b=Cb1(Ni)\cdot(Lm+S)a+Cb0(Ni)$$

$$F2b=C/\lambda 2b$$

$$(Lm+S)b=(\lambda 1-Cb0(Ni))/Cb1(Ni)$$

$$\lambda 2a=Ca1(Ni)\cdot(Lm+S)b+Ca0(Ni)$$

$$F2a=C/\lambda 2a$$

C is the speed of light.

Thereafter, the process proceeds to Step S240, and the calculation unit 84 transmits Ni, (Lm+S)a, F2*a*, (Lm+S)b, and F2*b* to the output unit 85. Next, the process proceeds to Step S250, and it is determined whether Ni is equal to or larger than Nmax, or not. In this example, when Ni is smaller than Nmax, the process proceeds to Step S260 to count up Ni (that is, +1). The process proceeds to Step S230, and the process described above is repeatedly executed. If Ni is equal to or larger than Nmax in Step S250, the process proceeds to "YES", and the calculation processing is completed.

Figure 52:
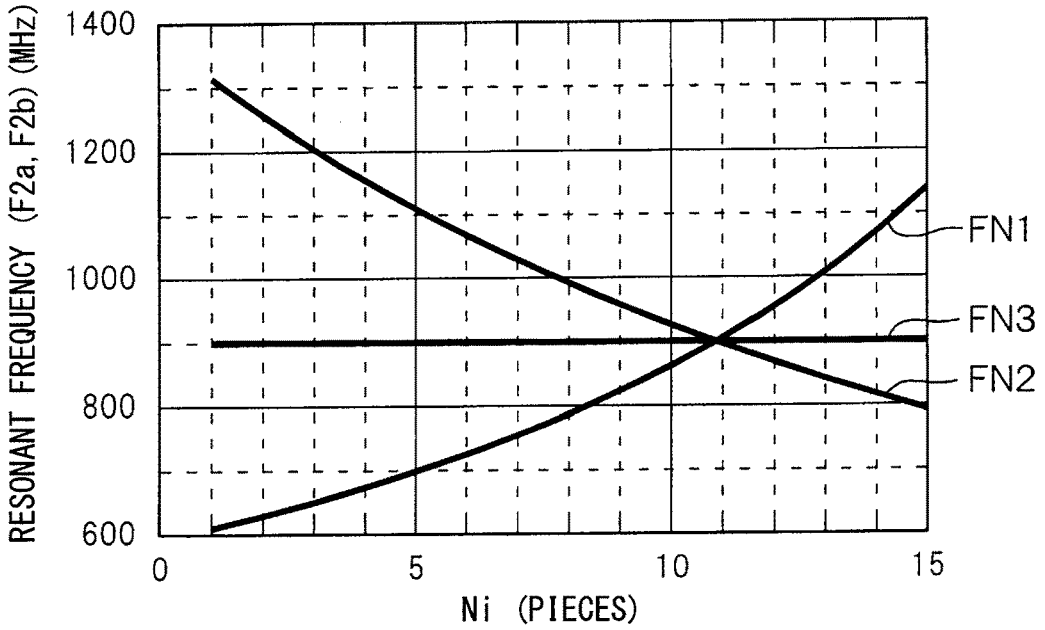
FIG. 52 is a characteristic diagram illustrating a relationship between a resonant frequency and the number of semielliptical shapes.
Figure 53:
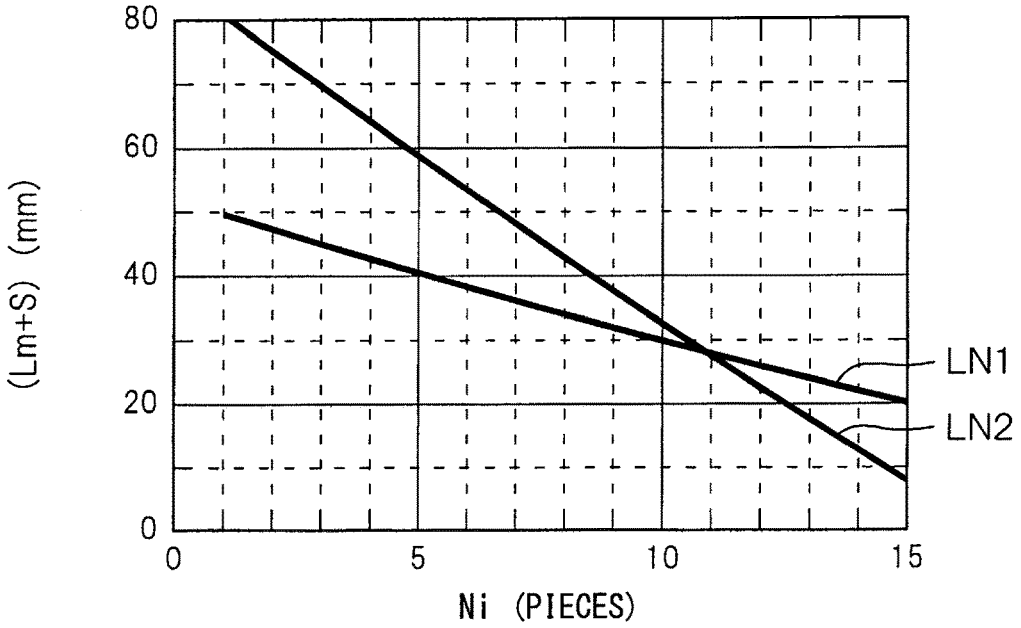
FIG. 53 is a characteristic diagram illustrating a relationship between a length (Lm+S) and the number of semielliptical shapes.

FIG. 52 illustrates an example of calculation results of the other resonant frequencies F2*a* and F2*b* when the number Ni of the inner protruding portions 33 is changed with F1=900 MHz. In FIG. 52, a solid line FN1 indicates the resonant frequency F2*a*, a solid line FN2 indicates the resonant frequency F2*b*, and a solid line FN3 indicates the resonant frequency F1. FIG. 53 illustrates an example of the calculation results of the lengths (Lm+S)a and (Lm+S)b when the number Ni of inner protruding portions 33 is changed with F1=900 MHz. In FIG. 53, a solid line LN1 indicates the length (Lm+S) a, and a solid line LN 2 indicates the length (Lm+S)b. From FIGS. 52 and 53, in designing the number Ni and the length (Lm+S) of the inner protruding portions 33, in order to sufficiently separate F1 and F2*a* (or F2*b*) from each other, that is, for sufficiently reducing the return loss, the design operation can be easily performed.

In the drawings, reference numeral 16 denotes a through-hole, 21 is a deformed folded dipole antenna, 22 is a substrate, 23 is a first element, 24 is a second element, 26 is a first L-shaped portion, 27 is a second L-shaped portion, 28 is a long side portion, 29 is a short side portion, 30 is a long side portion, 31 is a short side portion, 32 is a feeding point, 33 is an inner protruding portion, 34 is an inductance shape, 36 and 37 are opposite side portions, 38 is a coupling side portion, 39 is an inner protruding portion, 40 is an inductance shape, 41 is an inductance shape, 42 is a rectangular spiral structure, 43 is an inductance shape, 45 is a power feeding side linear portion, 46 is a first linear portion, 47 is a second linear portion, 49 is a high frequency circuit, 50 is a printed wiring board, 52 is a connection line, 54 and 55 are both-end connection portions, 60 is an elliptical spiral structure, 61 is a circular spiral structure, 70 is a short-circuit element, 71 is a through hole, 72 is a first element, 73 is a wide conductor, 74 is an input terminal, 75 is a second element, 76 is an L-shaped portion, 77 is an input terminal, 78 is a high frequency circuit, 81 is a calculation apparatus, 82 is an input unit, 83 is an antenna characteristic constant storage unit, 84 is a calculation unit, 85 is an output unit, and 86 is an antenna shape constant storage unit.

It is noted that a flowchart or the processing of the flowchart in the present application includes sections (also referred to as steps), each of which is represented, for instance, as S10. Further, each section can be divided into several sub-sections while several sections can be combined into a single section. Furthermore, each of thus configured sections can be also referred to as a device, module, or means.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A small antenna comprising:

a first element that includes a pair of conductors provided by a wire, one end portion of each of the pair of conductors being a power feeding point; and a second element that is arranged to face the first element with sandwiching a dielectric body, and includes a conductor provided by a wire, wherein:

a part of the wire of each of the first element and the second element has an inductance shape with three or more bending structures or an inductance shape with a spiral structure;

a first resonance mode, in which a current direction of current flowing through the first element is same as a current direction of current flowing through the second element, has a first resonant frequency (Fa0);

a second resonance mode, in which the current direction of current flowing through the first element is opposite to the current direction of current flowing through the second element, has a second resonant frequency (Fb0); and a length from each power feeding point to the inductance shape is determined to hold the first resonant frequency of the first resonance mode within a range from a frequency slightly higher than the second resonant frequency of the second resonance mode to a high anti-resonant frequency of the second resonance mode, or a range from a frequency slightly lower than the second resonant frequency of the second resonance mode to a low anti-resonant frequency of the resonance mode.

2. The small antenna according to claim 1, wherein:

the length from each power feeding point to the inductance shape is determined to hold the second resonant frequency of the second resonance mode within a range from a frequency slightly higher than the first resonant frequency of the first resonance mode to a high anti-resonant frequency of the first resonance mode, or a range from a frequency slightly lower than the first resonant frequency of the first resonance mode to a low anti-resonant frequency of the first resonance mode.

3. The small antenna according to claim 1, wherein:

the frequency slightly higher than the second resonant frequency of the second resonance mode is defined as $((1+\Delta fm)/(1-\Delta fm))Fb0$;

the frequency slightly higher than the second resonant frequency satisfies an equation of $(1+\Delta fm)/(1-\Delta fm))Fb0<Fa0$;

$\Delta fm$ is a frequency ratio of a degradation range boundary;

$\Delta fm$ is defined as an equation of $\Delta fm=\sqrt{(RaRb\Delta a\Delta b)}$;

Ra is a resonance resistance value of the first resonance mode;

Rb is a resonance resistance value of the second resonance mode;

$\Delta a$ is defined as an equation of $\Delta a=(\Delta au+\Delta ad)/2$, $\Delta a=\Delta au$, or $\Delta a=\Delta ad$;

$\Delta au$ is defined as an equation of $\Delta au=(Fau-Fa0)/Fa0$;

$\Delta au$ is a frequency ratio at which a reactance of the first resonance mode changes from 0 to 1;

Fau is a frequency at which the reactance of the first resonance mode is 1;

Fa0 is the first resonant frequency of the first resonance mode;

$\Delta ad$ is defined as an equation of $\Delta ad=(Fa0-Fad)/Fa0$;

$\Delta ad$ is a frequency ratio at which the reactance of the first resonance mode changes from −1 to 0;

Fad is a frequency at which the reactance of the first resonance mode is −1,

Δb is defined as an equation of Δb=(Δbu+Δbd)/2, Δb=Δbu, or Δb=Δbd;

Δbu is defined as an equation of Δbu=(Fbu−Fb0)/Fb0;

Δbu is a frequency ratio at which a reactance of the second resonance mode changes from 0 to 1;

Fbu is a frequency at which the reactance of the second resonance mode is 1;

Fb0 is the second resonant frequency of the second resonance mode;

Δbd is defined as an equation of Δbd=(Fb0−Fbd)/Fb0;

Δbd is a frequency ratio at which the reactance of the second resonance mode changes from −1 to 0; and Fbd is a frequency at which the reactance of the second resonance mode is −1; or the frequency slightly lower than the second resonant frequency of the second resonance mode is defined as ((1−Δfm)/(1+Δfm))Fb0; and the frequency slightly lower than the second resonant frequency satisfies an equation of ((1−Δfm)/(1+Δfm))Fb0>Fa0.

4. The small antenna according to claim 2, wherein:

the frequency slightly higher than the first resonant frequency of the first resonance mode is defined as ((1+Δfm)/(1−Δfm))Fa0;

the frequency slightly higher than the first resonant frequency satisfies an equation of (1+Δfm)/(1−Δfm))Fa0<Fb0;

Δfm is a frequency ratio of a degradation range boundary;

Δfm is defined as an equation of Δfm=√(RaRbΔaΔb);

Ra is a resonance resistance value of the first resonance mode;

Rb is a resonance resistance value of the second resonance mode;

Δa is defined as an equation of Δa=(Δau+Δad)/2, Δa=Δau, or Δa=Δad;

Δau is defined as an equation of Δau=(Fau−Fa0)/Fa0;

Δau is a frequency ratio at which a reactance of the first resonance mode changes from 0 to 1;

Fau is a frequency at which the reactance of the first resonance mode is 1;

Fa0 is the first resonant frequency of the first resonance mode;

Δad is defined as an equation of Δad=(Fa0−Fad)/Fa0;

Δad is a frequency ratio at which the reactance of the first resonance mode changes from −1 to 0;

Fad is a frequency at which the reactance of the first resonance mode is −1,

Δb is defined as an equation of Δb=(Δbu+Δbd)/2, Δb=Δbu, or Δb=Δbd;

Δbu is defined as an equation of Δbu=(Fbu−Fb0)/Fb0;

Δbu is a frequency ratio at which a reactance of the second resonance mode changes from 0 to 1;

Fbu is a frequency at which the reactance of the second resonance mode is 1;

Fb0 is the second resonant frequency of the second resonance mode;

Δbd is defined as an equation of Δbd=(Fb0−Fbd)/Fb0;

Δbd is a frequency ratio at which the reactance of the second resonance mode changes from −1 to 0; and Fbd is a frequency at which the reactance of the second resonance mode is −1, or the frequency slightly lower than the first resonant frequency of the first resonance mode is defined as ((1−Δfm)/(1+Δfm))Fa0; and the frequency slightly lower than the first resonant frequency satisfies an equation of ((1−Δfm)/(1+Δfm))Fa0>Fb0.

5. The small antenna according to claim 1, wherein:

the first resonant frequency of the first resonance mode and the second resonant frequency of the second resonance mode are obtained by equations:

$$\lambda a = Ca1*(Lm+S)+Ca0;$$

$$\lambda b = Cb1*(Lm+S)+Cb0;$$

$$Fa0 = C/\lambda a; \text{ and}$$

$$Fb0 = C/\lambda b,$$

where

Ca1 is a proportionality constant of λa,

Ca0 is a constant of λa,

Cb1 is a proportionality constant of λb,

Cb0 is a constant of λb; and the length from each power feeding point to the inductance shape is determined that the first resonant frequency and the second resonant frequency satisfy an equation of:

$$((1+\Delta fm)/(1-\Delta fm))Fb0<Fa0<Fbru;$$

$$((1-\Delta fm)/(1+\Delta fm))Fb0>Fa0>Fbrd;$$

$$((1+\Delta fm)/(1-\Delta fm))Fa0<Fb0<Faru; \text{ or}$$

$$((1-\Delta fm)/(1+\Delta fm))Fa0>Fb0>Fard,$$

where

Fard is a low anti-resonant frequency of the first resonance mode and the reactance is −∞, Faru is a high anti-resonant frequency of the first resonance mode and the reactance is ∞, Fbrd is a low anti-resonant frequency of the second resonance mode and the reactance is −∞, and Fbru is a high anti-resonant frequency of the second resonance mode, and the reactance is ∞.

6. The small antenna according to claim 1, wherein:

a width of at least a part of each wire other than the inductance shape is configured to be larger than a width of the inductance shape.

7. The small antenna according to claim 6, wherein:

the width of each wire larger than the width of the inductance shape is set to bring an impedance of the first resonant frequency closer to a standard impedance.

8. The small antenna according to claim 1, wherein:

the wire other than the power feeding point includes a short-circuit element that connects the first element and the second element.

9. The small antenna according to claim 1, wherein:

the wire other than the inductance shape of the first element and the wire other than the inductance shape of the second element are bent.

10. The small antenna according to claim 1, wherein:

the first element and the second element are arranged on a printed wiring board for providing a high frequency circuit.

11. The small antenna according to claim 10, wherein:

another wire for connecting each power feeding point of the first element and an input and output terminal of the high frequency circuit is arranged on the printed wiring board.

12. The small antenna according to claim 1, wherein:
the wide conductor of the first element is provided by a ground of the high frequency circuit.

13. The small antenna according to claim 1, wherein:
the inductance shape with the three or more bending structures is a shape by aligning one or more semi-elliptical shapes.

14. The small antenna according to claim 1, wherein:
the inductance shape with the three or more bending structures is a shape by aligning one or more triangles.

15. The small antenna according to claim 1, wherein:
the inductance shape with the three or more bending structures is a shape by aligning one or more elliptical shapes.

16. The small antenna according to claim 1, wherein:
the inductance shape with the three or more bending structures is a shape by aligning one or more square shapes.

17. The small antenna according to claim 1, wherein:
the inductance shape with the spiral structure is a rectangular spiral structure.

18. The small antenna according to claim 1, wherein:
the inductance shape with the spiral structure is an elliptical spiral structure.

19. The small antenna according to claim 1, wherein:
the inductance shape disposed on each of the pair of conductors of the first element is different from each other.

20. The small antenna according to claim 1, wherein:
a numerical number of various shapes in the inductance shape arranged on each of the pair of conductors of the first element and being a shape by aligning one or more various shapes is different from each other.

21. A small antenna comprising:
a first element that includes a wire and a wide conductor; and
a second element that is arranged to face the wire of the first element with sandwiching a dielectric body, and includes a conductor provided by a wire, wherein:
a connecting portion between the wire of the first element and the wide conductor has a power feeding point, and an end portion of the second element has a power feeding point;
a part of the wire of each of the first element and the second element has an inductance shape with three or more bending structures or an inductance shape with a spiral structure;
a first resonance mode, in which a current direction of current flowing through the first element is same as a current direction of current flowing through the second element, has a first resonant frequency;
a second resonance mode, in which the current direction of current flowing through the first element is opposite to the current direction of current flowing through the second element, has a second resonant frequency; and
a length from each power feeding point to the inductance shape is determined to hold the first resonant frequency of the first resonance mode within a range from a frequency slightly higher than the second resonant frequency of the second resonance mode to a high anti-resonant frequency of the second resonance mode, or a range from a frequency slightly lower than the second resonant frequency of the second resonance mode to a low anti-resonant frequency of the second resonance mode.

22. A calculation apparatus for designing a small antenna, which includes: a first element that has a pair of conductors provided by a wire, one end portion of each of the pair of conductors being a power feeding point; and a second element that is arranged to face the first element with sandwiching a dielectric body, and has a conductor provided by a wire, wherein:
a part of the wire of each of the first element and the second element has an inductance shape with three or more bending structures or an inductance shape with a spiral structure;
a first resonance mode, in which a current direction of current flowing through the first element is same as a current direction of current flowing through the second element, has a first resonant frequency;
a second resonance mode, in which the current direction of current flowing through the first element is opposite to the current direction of current flowing through the second element, has a second resonant frequency; and
the calculation apparatus receives the first resonant frequency and the second resonant frequency, and calculates one of an admittance, an impedance, a reflection coefficient, and a return loss of the small antenna.

23. The calculation apparatus for antenna design according to claim 22, wherein:
the admittance is defined by equations of:

$$Yab=Ya+Yb;$$

$$Ya=1/Za;$$

$$Yb=1/Zb;$$

$$Za=Ra+jXa; \text{ and}$$

$$Zb=Rb+jXb,$$

where Ra is a resonance resistance value of the first resonance mode,
Xa is a reactance value of the first resonance mode,
j is an imaginary number,
Rb is a resonance resistance value of the second resonance mode, and
Xb is a reactance value of the second resonance mode.

24. The calculation apparatus for antenna design according to claim 22, wherein:
when an equation of $Fa0 \leq F < Faru$ is satisfied, the reactance value of the first resonance mode is defined as an equation of $Xa=Kau(1-(F/Fa0)^2)/(1-(F/Faru)^2)$,
where
F is a frequency for obtaining the impedance,
Faru is a high anti-resonant frequency of the first resonance mode and the reactance is ∞,
Fa0 is a first resonant frequency of the first resonance mode, and the reactance is 0, and
Kau is an upper proportionality constant of the first resonance mode;
when an equation of $Fard < F \leq Fa0$ is satisfied, the reactance value of the first resonance mode is defined as an equation of $Xa=Kad(1-(F/Fa0)^2)/(1-(F/Fard)^2)$,
where
Fard is a low anti-resonant frequency of the first resonance mode (A) and the reactance is −∞, and
Kad is a lower proportionality constant of the first resonance mode;
when an equation of $Fb0 \leq F < Fbru$ is satisfied, the reactance value of the second resonance mode is defined as an equation of $Xb=Kbu(1-(F/Fb0)^2)/(1-(F/Fbru)^2$,
where
Fbru is a high anti-resonant frequency of the second resonance mode and the reactance is ∞, Fb0 is a second resonant frequency of the second resonance mode and the reactance is 0, and Kbu is an upper proportionality constant of the second resonance mode; and when an equation of Fbrd <F≤Fb0 is satisfied, the reactance value of the second resonance mode is defined as an equation of $Xb=Kbd(1-(F/Fb0)^2)/(1-(F/Fbrd)^2)$, where Fbrd is a low anti-resonant frequency of the second resonance mode and the reactance is −∞, and Kbd is a lower proportionality constant of the second resonance mode.

25. A calculation apparatus for designing a small antenna, which includes: a first element that has a wire and a wide conductor; and a second element that is arranged to face the wire of the first element with sandwiching a dielectric body, and has a conductor provided by a wire, a connecting portion between the wire of the first element and the wide conductor having a power feeding point, and an end portion of the second element having a power feeding point, wherein:

a part of the wire of each of the first element and the second element has an inductance shape with three or more bending structures or an inductance shape with a spiral structure;

a first resonance mode, in which a current direction of current flowing through the first element is same as a current direction of current flowing through the second element, has a first resonant frequency;

a second resonance mode, in which the current direction of current flowing through the first element is opposite to the current direction of current flowing through the second element, has a second resonant frequency; and the calculation apparatus receives the first resonant frequency and the second resonant frequency, and calculates one of an admittance, an impedance, a reflection coefficient, and a return loss of the small antenna.

26. A calculation apparatus for designing a small antenna, which includes: a first element that has a pair of conductors provided by a wire, one end portion of each of the pair of conductors being a power feeding point; and a second element that is arranged to face the first element with sandwiching a dielectric body, and has a conductor provided by a wire, wherein:

a part of the wire of each of the first element and the second element has an inductance shape with three or more bending structures or an inductance shape with a spiral structure; and the calculation apparatus receives one resonant frequency of the first element and the second element, and calculates one of an other resonant frequency of the first element and the second element and an antenna shape.

27. The calculation apparatus for antenna design according to claim 26, wherein:

when an equation of λ1=λa is satisfied, the other resonant frequency is calculated by:

$$(Lm+S)a=(\lambda 1-Ca0)/Ca1;$$

$$\lambda 2b=Cb1(Lm+S)a+Cb0; \text{ and}$$

$$F2b=C/\lambda 2b,$$

where

λ1 is a wavelength of the one resonant frequency and is defined as an equation of λ1=C/F1, C is a speed of light, F1 is the one resonant frequency, λa is a wavelength at a resonance of the first resonance mode of the first element, (Lm+S)a is a length of the first element up to the inductance shape, Ca1 is a proportionality constant of λa, Ca0 is a constant of λa, Cb1 is a proportionality constant of λb, Cb0 is a constant of λb, λ2*b* is a wavelength of the other resonant frequency, and F2*b* is the other resonant frequency;

when an equation of λ1=λb is satisfied, the other resonant frequency is calculated by:

$$(Lm+S)b=(\lambda 1-Cb0)/Cb1;$$

$$\lambda 2a=Ca1(Lm+S)b+Ca0; \text{ and}$$

$$F2a=C/\lambda 2a,$$

where

λ1 is a wavelength of the one resonant frequency, and is defined as an equation of λ1=C/F1, C is a speed of light, F1 is the one resonant frequency, λb is a wavelength at a resonance of the second resonance mode of the second element, (Lm+S)b is a length of the second element up to the inductance shape, Ca1 is a proportionality constant of λa Ca0 is a constant of λa, Cb1 is a proportionality constant of λb, Cb0 is a constant of λb, λ2*a* is a wavelength of the other resonant frequency, and F2*a* is the other resonant frequency.

28. The calculation apparatus for antenna design according to claim 27, wherein:

a numerical number of inductance shapes is defined as Ni, and Ni is a variable; and the other resonant frequency or the antenna shape is calculated by replacing the proportionality constant of Ca1 of λa with the proportionality constant of Ca1(Ni) of λa, replacing the constant of Ca0 of λa with the constant of Ca0(Ni) of λa, replacing the proportional constant of Cb1 of λb with the proportionality constant of Cb1(Ni) of λb, and replacing the constant of Cb0 of λb with the constant of Cb0(Ni) of λb.

29. A calculation apparatus for designing a small antenna, which includes: a first element that has a wire and a wide conductor; and a second element that is arranged to face the wire of the first element with sandwiching a dielectric body, and includes a conductor provided by a wire, a connecting portion between the wire of the first element and the wide conductor having a power feeding point, and an end portion of the second element having a power feeding point, wherein:

a part of the wire of each of the first element and the second element has an inductance shape with three or more bending structures or an inductance shape with a spiral structure; and the calculation apparatus receives one resonant frequency of the first element and the second element, and calculates one of an other resonant frequency of the first element and the second element and an antenna shape.

30. A small antenna comprising:

a first element that includes a pair of conductors provided by a wire, one end portion of each of the pair of conductors being a power feeding point; and a second element that is arranged to face the first element with sandwiching a dielectric body, and includes a conductor provided by a wire, wherein:

a part of the wire of each of the first element and the second element has an inductance shape with three or more bending structures or an inductance shape with a spiral structure;

a length from a center of each of the first element and the second element to the inductance shape is determined to separate a first resonant frequency of a first resonance mode, in which a current direction of current flowing through the first element is same as a current direction of current flowing through the second element, from a second resonant frequency of a second resonance mode, in which the current direction of current flowing through the first element is opposite to the current direction of current flowing through the second element; and a width of at least a part of each wire other than the inductance shape of the first element or the second element is configured to be wider than a width of the inductance shape.

31. The small antenna according to claim 30, wherein:

a length from a center of each of the first element and the second element to the inductance shape is defined as (Lm+S);

the wavelength of the first resonant frequency is defined as λa; and the wavelength of the second resonant frequency is defined as λb, where λa is defined as an equation of $\lambda a = Ca1*(Lm+S)+Ca0$, λb is defined as an equation of $\lambda b = Cb1*(Lm+S)+Cb0$, Ca1 is a proportionality constant of λa, Ca0 is a constant of λa, Cb1 is a proportionality constant of λb, Cb0 is a constant of λb, and the length (Lm+S) is set to satisfy an equation of $\lambda a \neq \lambda b$.

32. The small antenna according to claim 31, wherein:

the wire of the pair of conductors other than the feeding point includes a short-circuit element that connects the first element and the second element; and a position of the short-circuit element is set to satisfy an equation of $\lambda a \neq \lambda b$.

33. The small antenna according to claim 30, wherein:

the width of each wire larger than the width of the inductance shape is set to bring an impedance of the first resonant frequency closer to a standard impedance.

* * * * *